US012416214B2

(12) United States Patent
Roy et al.

(10) Patent No.: US 12,416,214 B2
(45) Date of Patent: Sep. 16, 2025

(54) SEVERE PLASTIC DEFORMATION OF DEGRADABLE MATERIAL

(71) Applicant: SCHLUMBERGER TECHNOLOGY CORPORATION, Sugar Land, TX (US)

(72) Inventors: Indranil Roy, Missouri City, TX (US); Gregoire Jacob, Rosharon, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 849 days.

(21) Appl. No.: 17/655,893

(22) Filed: Mar. 22, 2022

(65) Prior Publication Data

US 2022/0212253 A1 Jul. 7, 2022

Related U.S. Application Data

(63) Continuation of application No. 15/531,026, filed as application No. PCT/US2015/061825 on Nov. 20, 2015, now abandoned.

(60) Provisional application No. 62/085,001, filed on Nov. 26, 2014.

(51) Int. Cl.
*E21B 33/12* (2006.01)
*E21B 29/00* (2006.01)

(52) U.S. Cl.
CPC ..... *E21B 33/12* (2013.01); *E21B 29/00* (2013.01)

(58) Field of Classification Search
CPC ..... E21B 23/01; E21B 23/06; E21B 2200/08; E21B 23/04; E21B 23/0413; E21B 34/142
See application file for complete search history.

(56) References Cited

U.S. PATENT DOCUMENTS

| | | | | |
|---|---|---|---|---|
| 5,309,748 | A | 5/1994 | Jarrett et al. | |
| 5,400,633 | A | 3/1995 | Segal et al. | |
| 5,513,512 | A | 5/1996 | Segal | |
| 6,197,129 | B1 | 3/2001 | Zhu et al. | |
| 6,399,215 | B1 | 6/2002 | Zhu et al. | |
| 6,895,795 | B1 | 5/2005 | Chaudhury et al. | |
| 7,152,448 | B2 | 12/2006 | Zhu et al. | |
| 9,057,242 | B2 * | 6/2015 | Mazyar | E21B 47/006 |
| 9,068,428 | B2 * | 6/2015 | Mazyar | E21B 34/06 |
| 9,605,508 | B2 * | 3/2017 | Xu | E21B 33/12 |
| 10,100,601 | B2 * | 10/2018 | King | E21B 33/134 |
| 10,202,820 | B2 * | 2/2019 | Xu | C22C 29/12 |
| 10,888,926 | B2 | 1/2021 | Roy et al. | |
| 11,021,926 | B2 * | 6/2021 | Smith | E21B 29/02 |
| 11,408,253 | B1 * | 8/2022 | Deng | E21B 40/001 |
| 2005/0126666 | A1 | 6/2005 | Zhu et al. | |

(Continued)

OTHER PUBLICATIONS

Chauhan, M. et a., "High-Strain-Rate Superplasticity in Bulk Cryomilled Ultra-Fine-Grained 5083 Al", Metallurgical and Materials Transactions A, 2006, 37(9), pp. 2715-2725.

(Continued)

*Primary Examiner* — Steven A MacDonald

(74) *Attorney, Agent, or Firm* — Jeffrey D. Frantz

(57) ABSTRACT

A method can include processing material via at least one severe plastic deformation process to form a degradable component where the material includes aluminum and one or more metals selected from a group of alkali metals, alkaline earth metals, group 12 transition metals, and basic metals having an atomic number equal to or greater than 31.

20 Claims, 24 Drawing Sheets

(56) References Cited

U.S. PATENT DOCUMENTS

2005/0161224 A1* 7/2005 Starr ..... E21B 33/134 166/308.1
2007/0181224 A1* 8/2007 Marya ..... C22C 21/003 148/420
2008/0105438 A1 5/2008 Jordan et al.
2009/0061229 A1 3/2009 Earthman et al.
2009/0151949 A1 6/2009 Marya et al.
2009/0270901 A1 10/2009 Kelleher et al.
2012/0006561 A1* 1/2012 Johnson ..... E21B 23/04 166/373
2012/0080189 A1 4/2012 Marya et al.
2012/0118582 A1* 5/2012 Soni ..... E21B 23/0413 166/66.5
2013/0146144 A1* 6/2013 Joseph ..... E21B 23/04 251/366
2013/0299192 A1* 11/2013 Xu ..... E21B 33/13 166/241.6
2014/0246209 A1 9/2014 Themig et al.
2014/0261922 A1 9/2014 Thomas et al.
2014/0262327 A1 9/2014 Xu et al.
2016/0040492 A1* 2/2016 Vinson ..... E21B 23/08 166/386
2016/0177661 A1* 6/2016 Xu ..... C22C 29/16 166/292
2016/0376869 A1* 12/2016 Rochen ..... E21B 33/128 166/135
2017/0355016 A1 12/2017 Roy et al.
2018/0030807 A1* 2/2018 Martin ..... E21B 23/04
2018/0304368 A1 10/2018 Roy et al.
2020/0032610 A1* 1/2020 Smith ..... E21B 33/12
2020/0291739 A1* 9/2020 Zeng ..... E21B 23/0413
2021/0017834 A1* 1/2021 Sundarraj ..... E21B 23/06
2023/0084218 A1* 3/2023 Roselier ..... E21B 33/1208 166/387
2023/0175345 A1* 6/2023 Jacob ..... E21B 33/134 166/386

OTHER PUBLICATIONS

Roy, I. et al., "Thermal Stability in Bulk Cryomilled Ultrafine-Grained 5083 AI Alloy", Metallurgical and Materials Transactions A, 2006, 37(3), pp. 721-730.
Maung, K. et al., "Thermal stability of cryomilled nanocrystalline aluminum containing diamantane nanoparticles", Journal of Materials Science, 2011, 46(11), pp. 6932-6940.
International Search Report and Written Opinion of International Patent Application No. PCT/US2015/061825 dated Mar. 4, 2016, 16 pages.
International Preliminary Report on Patentability of International Patent Application No. PCT/US2015/061825 dated Jun. 8, 2017, 12 pages.
Schade, Chris "Automization". ASM Handbook, vol. 7, Powder Metallurgy, p. 58-71 (Year: 2015).

* cited by examiner

Grain Composition
Sample 1

"Triple Point" Composition
Sample 2

Particle
1210

Boundaries
1220

Subboundaries
1230

SEVERE PLASTIC DEFORMATION OF DEGRADABLE MATERIAL

RELATED APPLICATION

This application claims the benefit of and priority to a U.S. Provisional Patent Application Ser. No. 62/085,001, filed 26 Nov. 2014, which is incorporated by reference herein.

BACKGROUND

Various types of materials are used in equipment, operations, etc. for exploration, development and production of resources from geologic environments. For example, equipment may be used in one or more of a sensing operation, a drilling operation, a cementing operation, a fracturing operation, a production operation, etc.

SUMMARY

A method can include processing material via at least one severe plastic deformation process to form a degradable component where the material includes aluminum and one or more metals selected from a group that includes alkali metals, alkaline earth metals, group 12 transition metals, and basic metals having an atomic number equal to or greater than 31. A degradable component of a borehole tool can include material that includes grain material that includes an aluminum alloy and discontinuous grain boundary material that includes one or more metals selected from a group that includes alkali metals, alkaline earth metals, group 12 transition metals, and basic metals having an atomic number equal to or greater than 31. A method can include processing material via equal channel angle pressing to generate processed material where the material includes aluminum and one or more metals selected from a group that includes alkali metals, alkaline earth metals, group 12 transition metals, and basic metals having an atomic number equal to or greater than 31; and processing the processed material via surface mechanical attrition treatment processing to form a near surface layer that includes properties that differ from properties of an adjacent layer of the processed material. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

DETAILED DESCRIPTION

Figure 1:
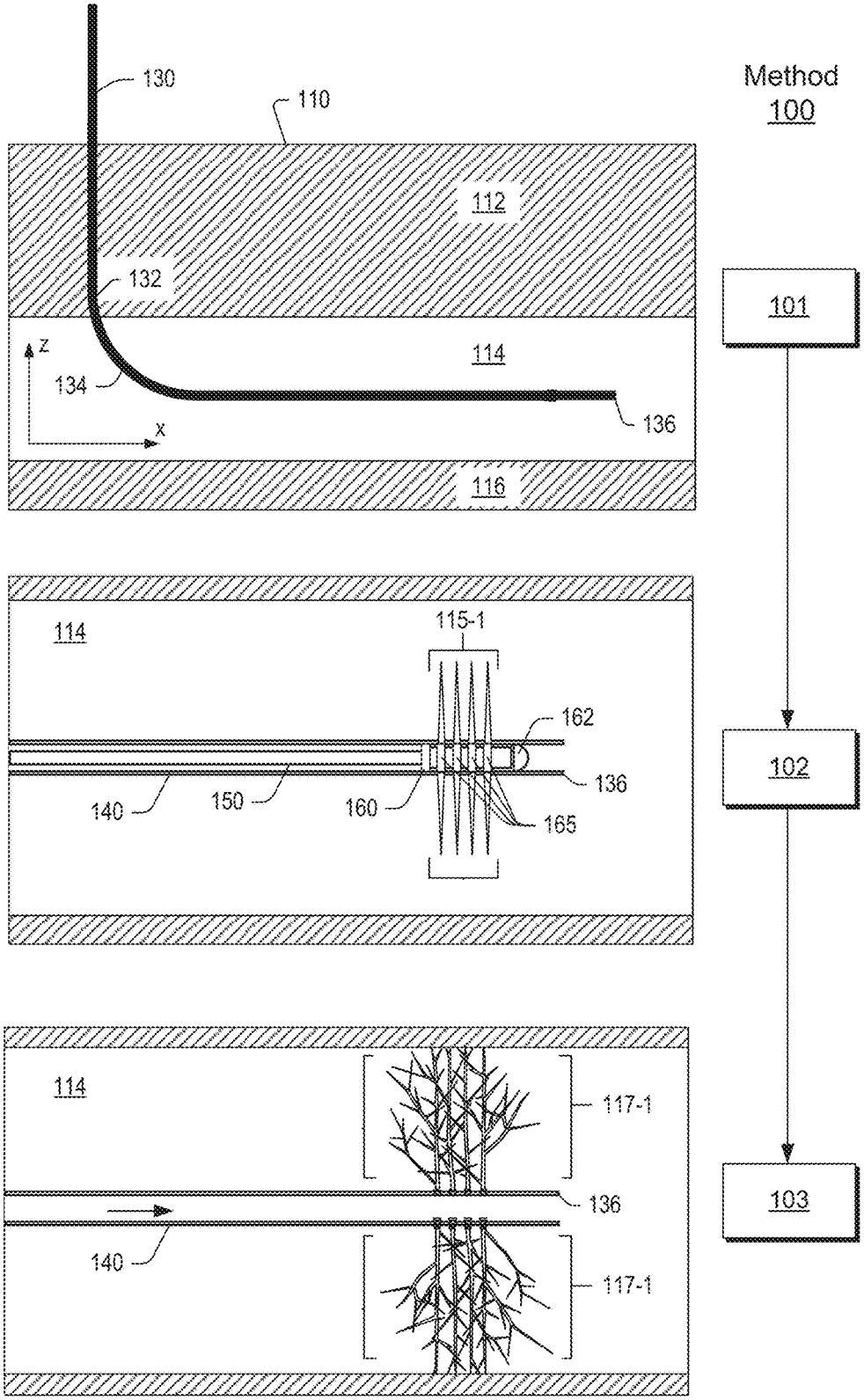
FIGS. 1 and 2 illustrate an example of a method and examples of equipment for fracturing a geologic environment.

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

As an example, a material or materials may be processed to form processed material. In such an example, the processed material may be machined, formed, etc. to produce a part or parts. As an example, a part may be a component or a portion of a component. A part may be included in equipment, which may be suitable for use in an environment such as, for example, a downhole environment. As an example, equipment may be drilling equipment, cementing equipment, fracturing equipment, sampling equipment, or other type of equipment. As an example, equipment may be borehole equipment. As an example, a tool may be a borehole tool, for example, suitable to perform a function or functions in a downhole environment in a borehole.

As to cementing equipment, such equipment may be used in one or more downhole cementing operations. As an example, cement may be placed adjacent to a liner. As an example, a liner may be a string of casing in which the top does not extend to the surface but instead is suspended from inside another casing string. As an example, a liner hanger may be used to attach or hang one or more liners from an internal wall of another casing string.

As an example, a method may include operating one or more components of a liner hanger system. As an example, a lower completion may be a portion of a well that is at least in part in a production zone or an injection zone. As an example, a liner hanger system may be implemented to perform one or more operations associated with a lower completion, for example, including setting one or more components of a lower completion, etc. As an example, a liner hanger system may anchor one or more components of a lower completion to a production casing string.

As an example, equipment may include one or more plugs, one or more seats that can receive a respective plug, etc. In such an example, it may be desirable that a plug and/or a seat have properties suited for one or more operation or operations. Properties may include mechanical properties and may include one or more other types of properties (e.g., chemical, electrical, etc.). As an example, it may be desirable that a plug and/or a seat degrade. For example, a plug and/or a seat may be manufactured with properties such that the plug and/or the seat degrade when exposed to one or more conditions. In such an example, where the plug acts to block a passage, upon degradation, the passage may become unblocked. As an example, a component (e.g., a plug, a seat, etc.) may degrade in a manner that facilitates one or more operations. As an example, a component or a portion of a component may degrade in stages. For example, consider a plug that degrades from a first size to a second smaller size. In such an example, the second smaller size may allow the plug to move (e.g., from a first seat to a second seat, etc.). As an example, a plug tool may be a degradable tool. As an example, a plug tool may be degradable in part. For example, consider a plug tool with a degradable seat or degradable seats. In such an example, a plug may be seated in a degradable seat that upon degradation of the seat, the plug may pass through the seat (e.g., become unplugged with respect to that seat). As an example, a system can include a plug tool that is degradable at least in part and can also include one or more degradable plugs (e.g., balls, cylinders, etc.).

As an example, at least a portion of a borehole tool may be broken via interaction with a tool where at least some of resulting pieces are degradable. For example, a tool may apply force (e.g., contact force, drilling force or other force) to a plug, a plug tool, etc. such that the applied force causes breaking into pieces of at least a portion of the plug, at least a portion of the plug tool, etc. In such an example, the pieces may be relatively large and degrade to relatively small pieces (e.g., which may pass through one or more openings, etc.).

As mentioned, equipment may include fracturing equipment where such equipment may be employed to generate one or more fractures in a geologic environment. As an example, a method to generate fractures can include a delivery block for delivering fluid to a subterranean environment, a monitor block for monitoring fluid pressure and a generation block for generating fractures via fluid pressure. As an example, the generation block may include activating one or more fractures. As an example, the generation block may include generating and activating fractures. As an example, activation may occur with respect to a pre-existing feature such as a fault or a fracture. As an example, a pre-existing fracture network may be at least in part activated via a method that includes applying fluid pressure in a subterranean environment. The foregoing method may be referred to as a treatment method or a "treatment". Such a method may include pumping an engineered fluid (e.g., a treatment fluid) at high pressure and rate into a reservoir via one or more bores, for example, to one or more intervals to be treated, which may cause a fracture or fractures to open (e.g., new, pre-existing, etc.).

As an example, a fracture may be defined as including "wings" that extend outwardly from a bore. Such wings may extend away from a bore in opposing directions, for example, according in part to natural stresses within a formation. As an example, proppant may be mixed with a treatment fluid to keep a fracture (or fractures) open (e.g., porous) when a treatment is complete. Hydraulic fracturing may create high-conductivity communication with an area of a formation and, for example, may bypass damage that may exist in a near-wellbore area. As an example, stimulation treatment may occur in stages. For example, after completing a first stage, data may be acquired and analyzed for planning and/or performance of a subsequent stage.

Size and orientation of a fracture, and the magnitude of the pressure to create it, may be dictated at least in part by a formation's in situ stress field. As an example, a stress field may be defined by three principal compressive stresses, which are oriented perpendicular to each other. The magnitudes and orientations of these three principal stresses may be determined by the tectonic regime in the region and by depth, pore pressure and rock properties, which determine how stress is transmitted and distributed among formations.

Where fluid pressure is monitored, a sudden drop in pressure can indicate fracture initiation of a stimulation treatment, as fluid flows into the fractured formation. As an example, to break rock in a target interval, fracture initiation pressure exceeds a sum of the minimum principal stress plus the tensile strength of the rock. To determine fracture closure pressure, a process may allow pressure to subside until it indicates that a fracture has closed. A fracture reopening pressure may be determined by pressurizing a zone until a leveling of pressure indicates the fracture has reopened. The closure and reopening pressures tend to be controlled by the minimum principal compressive stress (e.g., where induced downhole pressures exceed minimum principal stress to extend fracture length).

After performing fracture initiation, a zone may be pressurized for furthering stimulation treatment. As an example, a zone may be pressurized to a fracture propagation pressure, which is greater than a fracture closure pressure. The difference may be referred to as the net pressure, which represents a sum of frictional pressure drop and fracture-tip resistance to propagation (e.g., further propagation).

As an example, a method may include seismic monitoring during a treatment operation (e.g., to monitor fracture initiation, growth, etc.). For example, as fracturing fluid forces rock to crack and fractures to grow, small fragments of rock break, causing tiny seismic emissions, called microseisms. Equipment may be positioned in a field, in a bore, etc. to sense such emissions and to process acquired data, for example, to locate microseisms in the subsurface (e.g., to locate hypocenters). Information as to direction of fracture growth may allow for actions that can "steer" a fracture into a desired zone(s) or, for example, to halt a treatment before a fracture grows out of an intended zone. Seismic information (e.g., information associated with microseisms) may be used to plan one or more stages of fracturing operations (e.g., location, pressure, etc.).

Figure 2:
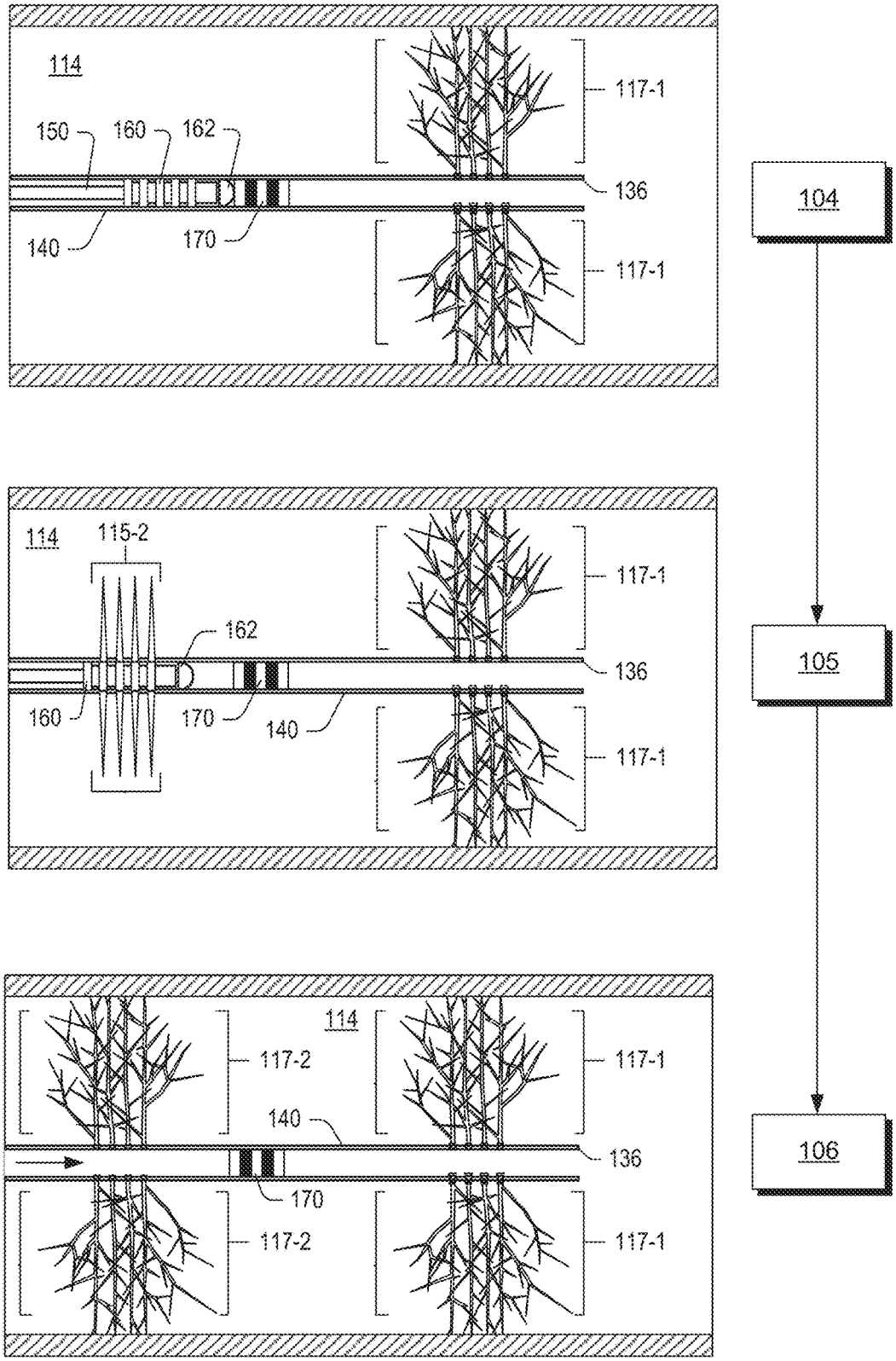

FIGS. 1 and 2 show an example of a method 100 that includes generating fractures. As shown, the method 100 can include various operational blocks such as one or more of the blocks 101, 102, 103, 104, 105 and 106. The block 101 may be a drilling block that includes drilling into a formation 110 that includes layers 112, 114 and 116 to form a bore 130 with a kickoff 132 to a portion defined by a heel 134 and a toe 136, for example, within the layer 114.

As illustrated with respect to the block 102, the bore 130 may be at least partially cased with casing 140 into which a string or line 150 may be introduced that carries a perforator 160. As shown, the perforator 160 can include a distal end 162 and charge positions 165 associated with activatable charges that can perforate the casing 140 and form channels 115-1 in the layer 114. Next, per the block 103, fluid may be introduced into the bore 130 between the heel 134 and the toe 136 where the fluid passes through the perforations in the casing 140 and into the channels 115-1. Where such fluid is under pressure, the pressure may be sufficient to fracture the layer 114, for example, to form fractures 117-1. In the block 103, the fractures 117-1 may be first stage fractures, for example, of a multistage fracturing operation.

Per the block 104, additional operations are performed for further fracturing of the layer 114. For example, a plug 170 may be introduced into the bore 130 between the heel 134 and the toe 136 and positioned, for example, in a region between first stage perforations of the casing 140 and the heel 134. Per the block 105, the perforator 160 may be activated to form additional perforations in the casing 140 (e.g., second stage perforations) as well as channels 115-2 in the layer 114 (e.g., second stage channels). Per the block 106, fluid may be introduced while the plug 170 is disposed in the bore 130, for example, to isolate a portion of the bore 130 such that fluid pressure may build to a level sufficient to form fractures 117-2 in the layer 114 (e.g., second stage fractures).

In a method such as the method 100 of FIGS. 1 and 2, it may be desirable that a plug (e.g., the plug 170) includes properties suited to one or more operations. Properties of a plug may include mechanical properties (e.g., sufficient strength to withstand pressure associated with fracture generation, etc.) and may include one or more other types of properties (e.g., chemical, electrical, etc.). As an example, it may be desirable that a plug degrades, that a plug seat degrades, that at least a portion of a borehole tool degrades, etc. For example, a plug may be manufactured with properties such that the plug withstands, for a period of time, conditions associated with an operation and then degrades (e.g., when exposed to one or more conditions). In such an example, where the plug acts to block a passage for an operation, upon degradation, the passage may become unblocked, which may allow for one or more subsequent operations.

Figure 11:
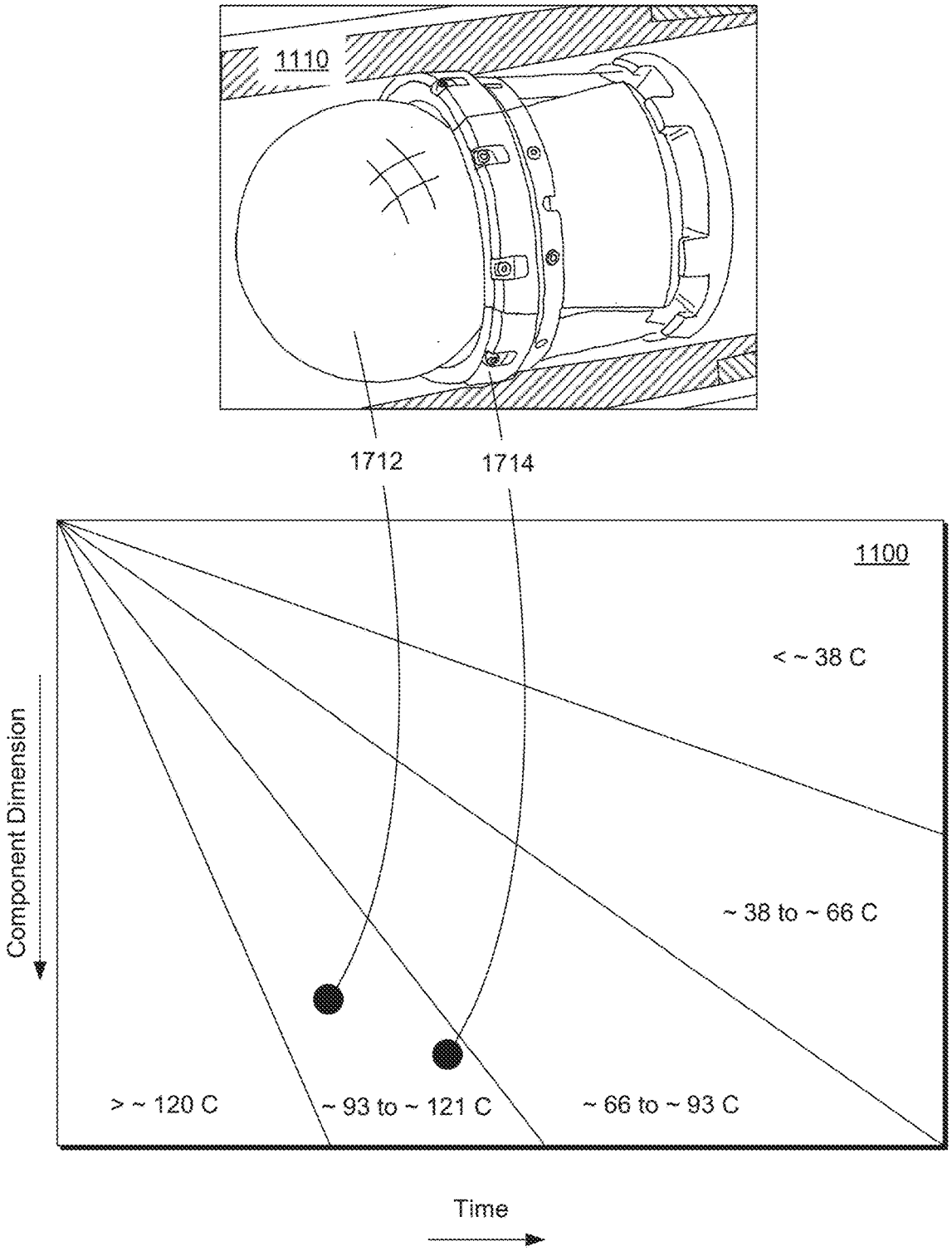
FIG. 11 illustrates an example of a plot of a component parameter versus degradation time and an example of a system.

As an example, a component may be degradable upon contact with a fluid such as an aqueous ionic fluid (e.g., saline fluid, etc.). As an example, a component may be degradable upon contact with well fluid that includes water (e.g., consider well fluid that includes oil and water, etc.). As an example, a component may be degradable upon contact with a fracturing fluid (e.g., a hydraulic fracturing fluid). FIG. 11 shows an example plot 1100 of degradation time versus a component dimension for various temperatures where a component is in contact with a fluid that is at least in part aqueous (e.g., including water as a medium, a solvent, a phase, etc.).

Figure 3:
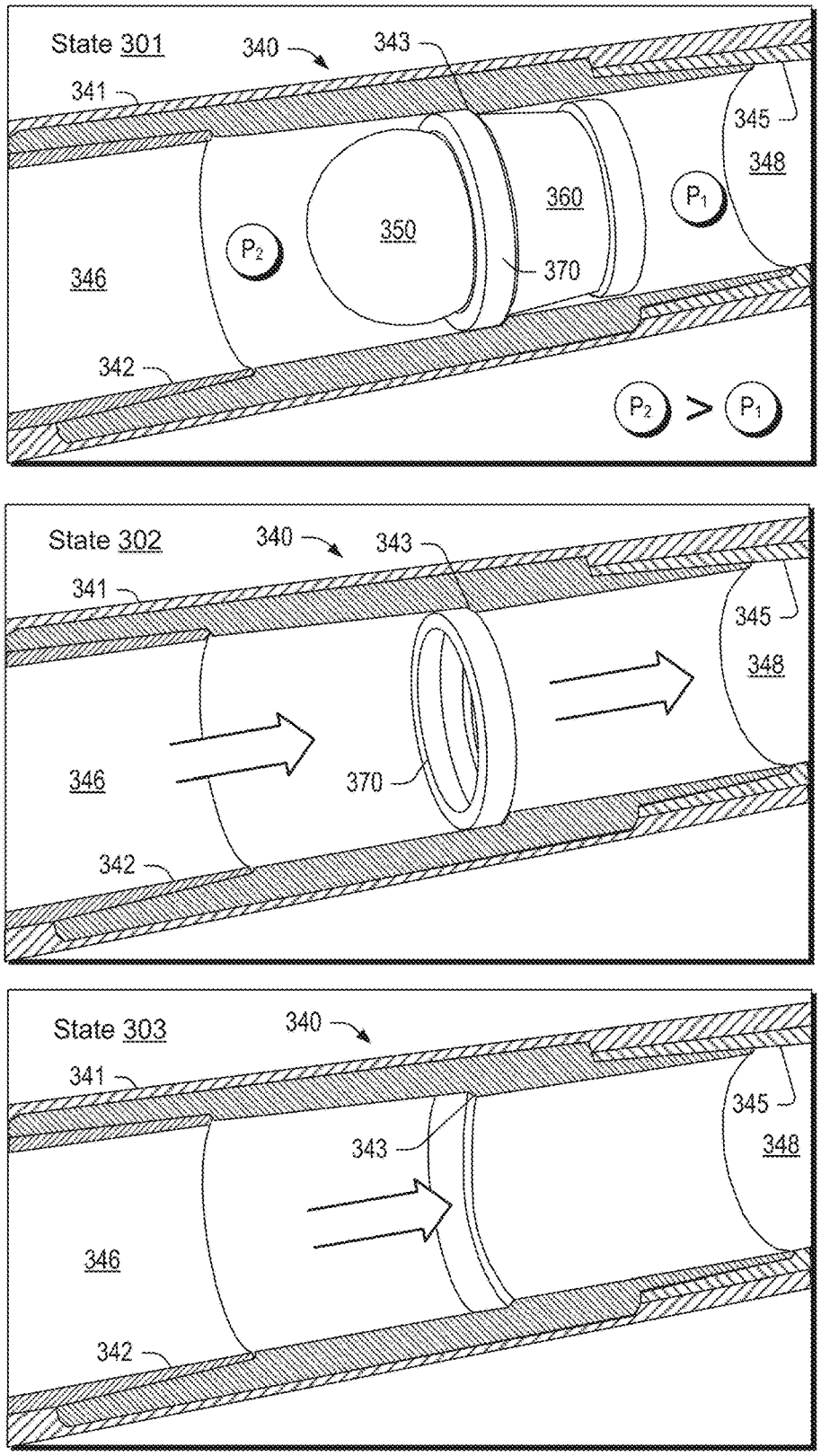
FIG. 3 illustrates an example of equipment in various example operational states.

FIG. 3 shows an example of equipment in various states 301, 302 and 303. As shown, the equipment can include a casing 340 that include various components 341, 342, 343 and 345. For example, the component 342 may define a bore 346 and the component 345 may define a bore 348 where the component 343 includes features (e.g., reduced diameter, conical shape, receptacle, etc.) that can catch a ring component 370 that is operatively coupled to a plug component 360 where the ring component 370 and the plug component 360 may position and seat a plug 350 in the casing 340. As an example, a seal may be formed by the plug 350 with respect to the plug component 360 and/or the ring component 370 and, for example, a seal may be formed by the ring component 370 with respect to the component 343. In such an approach, the seals may be formed in part via fluid pressure in a manner where increased pressure acts to increase seal integrity (e.g., reduce clearances that may be subject to leakage). As an example, the ring component 370 may be an upper component (e.g., a proximal component) of a plug seat and the plug component 360 may be a lower component (e.g., a distal component) of the plug seat.

As shown in the state 301, the plug 350 may be seated such that the bore 346 (e.g., of a first zone) is separated (e.g., isolated) from the bore 348 (e.g., of a second zone) such that fluid pressure in the bore 346 (see, e.g., $P_2$) may be increased to a level beyond fluid pressure in the bore 348 (see, e.g., $P_1$). Where the plug 350 and the plug component 360 are degradable, for example, upon contact with fluid that may pressurize the bore 348, degradation of the plug 350 and the plug component 360 may transition the equipment from the state 301 to the state 302. As shown in the state 302, fluid may pass from the bore 346 to the bore 348, for example, via an opening of the ring component 370. Where the ring component 370 is degradable, for example, upon contact with fluid in the bore 346, degradation of the ring component 370 may transition the equipment from the state 302 to the state 303. In the state 303, the casing 340 may be the remaining equipment of the state 301 (e.g., the plug 350, the plug component 360 and the ring component 370 are at least in part degraded).

As an example, the plug 350, the plug component 360 and the ring component 370 may be components of a dissolvable plug and perforation system that may be used to isolate zones during stimulation (see, e.g., the method 100 of FIGS. 1 and 2). Such equipment may be implemented in, for example, cemented, uncemented, vertical, deviated, or horizontal bores (e.g., in shale, sandstone, dolomite, etc.).

As an example, the plug component 360 and the ring component 370 may be conveyed in a bore via a pump down operation (e.g., which may move the components 360 and 370 along a bore axis direction). As an example, a component or components may include adjustable features, for example, that allow a change in diameter to facilitate seating in a receptacle disposed in a bore. For example, a tool may interact with a component or components to cause a change in diameter or diameters (e.g., a change in form of one or more components). In the changed state, the component or components may catch and seat in a receptacle disposed in a bore (e.g., seat in a shoulder of a receptacle component).

As an example, the plug component 360 and the ring component 370 may be seated in a receptacle by a tool that may include one or more perforators. Once seated, the tool may be repositioned to perforate casing and form channels (e.g., in a layer or layers of rock). As an example, repositioning may occur multiple times, for example, to form multiple sets of perforations and multiple sets of channels. As an example, after perforating and channel formation, the plug 350 may be pumped down to contact the plug component 360 and/or the ring component 370, for example, to form a seal that can isolate one zone from another zone (e.g., one interval from another interval). Fluid pressure may be increased in an isolated zone as defined by the plug 350, the plug component 360 and the ring component 370 as positioned in a receptacle disposed in a bore such that the fluid enters channels via perforations of the isolated zone and generates fractures (e.g., new fractures, reactivated fractures, etc.).

Figure 4:
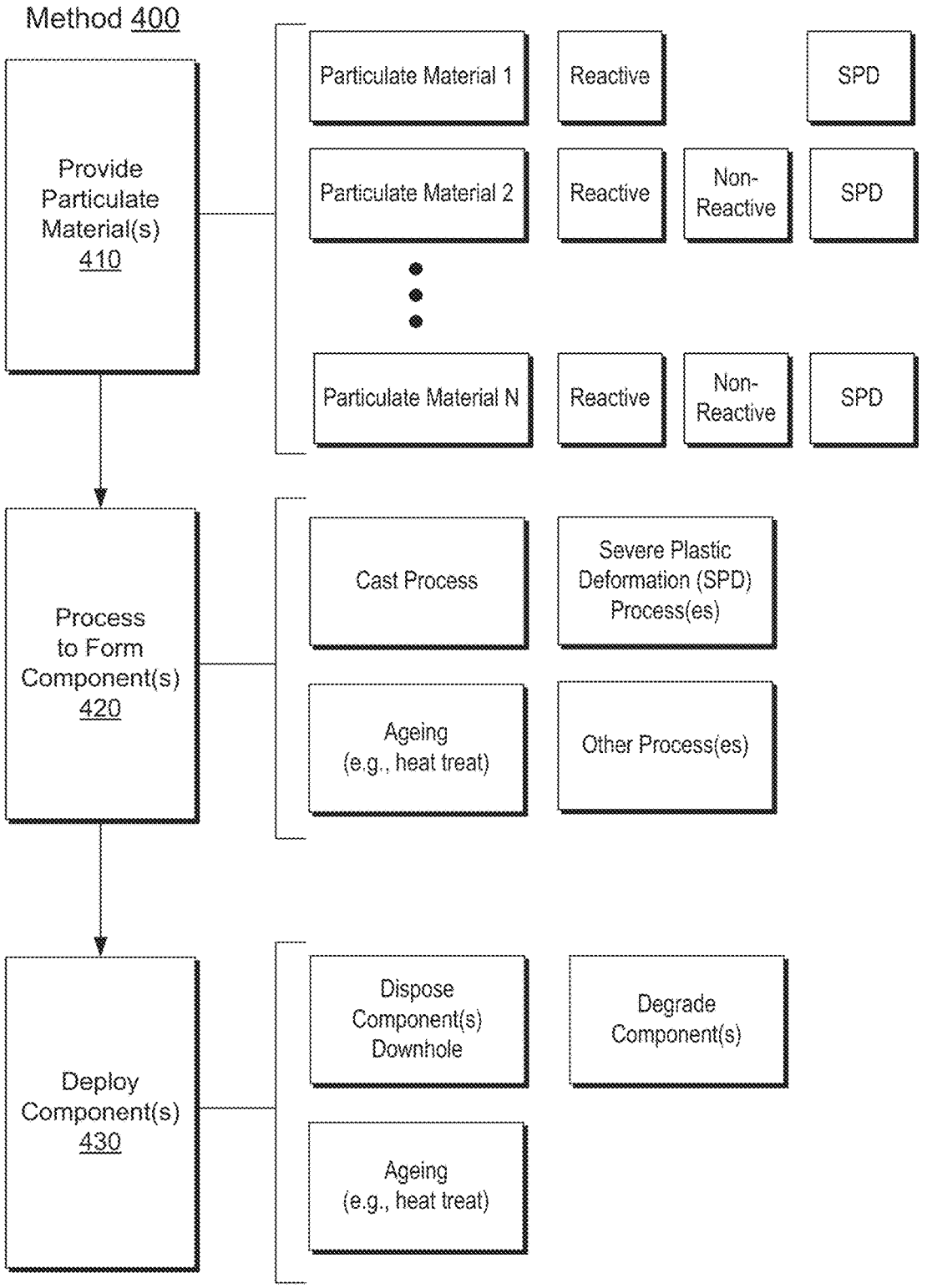
FIG. 4 illustrates an example of a method.

FIG. 4 shows an example of a method 400 that includes a provision block 410 for providing one or more particulate materials, a process block 420 for processing material(s) to form one or more components and a deployment block 430 for deploying one or more components, for example, as formed per the process block 420 and optionally one or more additional components.

As shown in FIG. 4, the provision block 410 can include providing one or more different types of particulate materials where at least one of the particulate materials is reactive in that it can degrade (e.g., degrade in an aqueous solution). As an example, one or more of the particulate materials may be produced by and/or subjected to one or more severe plastic deformation (SPD) processes. As an example, a material may be processed via cryomilling as an SPD process. Cryomilling can include milling material(s) in a cryogen (e.g., liquid nitrogen, liquid argon, etc.) to achieve desired structural characteristics that can be due in part to suppression of recovery and recrystallization.

As shown in FIG. 4, the process block 420 can include one or more processes. For example, consider a casting process, an ageing process, an SPD process and/or one or more other processes. As an example, ageing of one or more components can include, for example, ageing of one or more stock materials from which a component or components may be formed. As an example, ageing can include heat treating.

As shown in FIG. 4, the deployment block 430 can include disposing one or more components in a downhole environment and degrading at least one of the one or more components in the downhole environment. As an example, the deployment block 430 may also include ageing of one or more components in an environment or environments in which a component or components may be deployed. As an example, ageing can include heat treating.

As an example, a component may be treated by a process that effectively treats the entire component, such a process may include one or more of the following: solution heat treatment (e.g., for dissolution of soluble phases), quenching (e.g., for development of supersaturation), and age hardening (e.g., precipitation of solute atoms either at room temperature, often referred to as natural aging, or at elevated temperature, often referred to as artificial aging or precipitation heat treatment).

As an example, heat treating can include any of a variety of heating operations or cooling operations performed for purposes of changing mechanical properties, metallurgical structure, or residual stress state of a metal or alloy component. As to aluminum alloys, heat treating may include one or more operations performed to increase strength and hardness of precipitation-hardenable alloys.

An aluminum alloy that can be precipitation hardened, may be referred to as a "heat-treatable" alloy; noting that some aluminum alloys demonstrate no substantial strengthening by heating or cooling and may be referred to as "non-heat-treatable" alloys, which may depend primarily on cold work to increase strength. In general, heating to decrease strength and increase ductility (e.g., via annealing) may be used with heat-treatable or non-heat-treatable aluminum alloys.

An attribute of a precipitation-hardening alloy can be temperature-dependent equilibrium solid solubility, characterized by increasing solubility with increasing temperature. A condition for precipitation strengthening of supersaturated solid solutions can involve formation of finely dispersed precipitates during aging heat treatment (which may include natural ageing and/or artificial ageing). Various heat-treatable alloys are based on ternary or quaternary systems with respect to solutes involved in developing strength by precipitation.

As an example, the method 400 of FIG. 4 may employ one or more of natural ageing and artificial ageing. As an example, ageing of a component deployed in a downhole environment may be referred to as natural ageing, for example, natural ageing of a component during deployment and/or in a deployed state.

As an example, the method 400 may employ solution annealing as an ageing process. Solution annealing may aim to put coarse grains into solution while retaining finer grains from going into solution. In such an example, the finer grains may be thermally stable cryomilled nano grains. As an example, solution annealing may be performed via one or more temperature thermal cycles.

As an example, the method may employ ageing to induce precipitate hardening of solution annealed coarse grain counterparts while promoting slight grain growth of finer grains. In such an example, the finer grains may be thermally stable cryomilled nano grains. As an example, ageing may be employed to abet overall ductility of a solid consolidated from particulate material, which may be a blend of particulate materials. As an example, ageing may be performed via one or more temperature thermal cycles.

As an example, one or more thermal processes (e.g., ageing processes) may be performed to achieve one or more of increased strength, retained and/or improved ductility or elongation to failure, promotion of distinct plastic deformation after thermal treatment, strain hardening through dislocation strengthening, increased stiffness of a consolidated bulk solid, promotion of resistance to initiation of a crack by blunting of crack tips, and improved thermal stability of a solid.

As an example, a component (e.g., consider an aluminum alloy with a melting point of around 650 degrees C. or 923 K), when deployed downhole in a downhole fluidic environment, can undergo degradation of its mechanical properties where downhole temperatures are in a range of about 150 degrees C. or 423 K to about 200 degrees C. or 473 K. Such changes can proceed over time, noting that temperature may vary with respect to time.

As an example, a parameter may be defined as a ratio of a downhole environment temperature (e.g., a wellbore temperature) to a melting point temperature (e.g., average melting point temperature) of a material such as, for example, an alloy. Such a ratio may be given as $T_d/T_m$ where the temperatures are provided in Kelvin. As an example, consider parameter values of about 0.46 to 0.51; noting that a parameter value greater than about 0.4 can be an indicator of susceptibility to creep under load.

As an example, mechanical properties of a deployed component may be temperature de-rated. As an example, depending on function of a component, temperature may be an enabler, rather a detriment, for example, where temperature helps to naturally age a deployed structural part.

As an example, while under load, a part may be cooled down by fluid pumped downhole (e.g., injected downhole). In such an example, the part may be less affected by temperature of a downhole environment. However, where flow of such an injection fluid stops, heating may occur due to heat energy of the downhole environment.

As an example, in the method 400, the deployment block 430 may include adjusting temperature of an environment in which a component is disposed. For example, an injection fluid may be at a first temperature and act to maintain a component at or near that first temperature while production fluid may be at a second temperature and act to maintain a component at or near the second temperature. As another example, a component may exist in an environment at an environmental temperature where there is substantially no flow of fluid. In such an example, a component may be at or settle to a temperature that is substantially the same as the environmental temperature.

As an example, the method 400 can include selecting materials and processing materials in a manner such that a component formed from such materials can respond to natural ageing. In such an example, natural ageing may improve mechanical properties of the component when deployed downhole.

As an example, an environment may be a harsh environment, for example, an environment that may be classified as being a high-pressure and high-temperature environment (HPHT). A so-called HPHT environment may include pressures up to about 138 MPa (e.g., about 20,000 psi) and temperatures up to about 205 degrees C. (e.g., about 400 degrees F. and about 480 K), a so-called ultra-HPHT environment may include pressures up to about 241 MPa (e.g., about 35,000 psi) and temperatures up to about 260 degrees C. (e.g., about 500 degrees F. and about 530 K) and a so-called HPHT-hc environment may include pressures greater than about 241 MPa (e.g., about 35,000 psi) and temperatures greater than about 260 degrees C. (e.g., about 500 degrees F. and about 530 K). As an example, an environment may be classified based in one of the aforementioned classes based on pressure or temperature alone. As an example, an environment may have its pressure and/or temperature elevated, for example, through use of equipment, techniques, etc. For example, a SAGD operation may elevate temperature of an environment (e.g., by 100 degrees C. or more; about 370 K or more). As an example, an environment may be a geothermal environment.

As an example, a particulate material may be a powder. As an example, a powder may be defined as a dry, bulk solid composed of a number of particles that may, for example, flow relatively freely when shaken, tilted, etc. As an example, a powder may be a sub-class of a granular material. As an example, a particulate material may be a flowable material (e.g., flow relatively freely when shaken, tilted, etc.).

As an example, a particulate material such as, for example, a powder, may be characterized by one or more properties, parameters, dimensions, etc. As an example, a particulate material may be characterized by one or more particle sizes. Where a particle is spherical, the particle may be quantitatively defined by its diameter (e.g., or radius). Where a particle has an irregular shape that is not-spherical, a dimension may be defined by a diameter corresponding to the volume of the particle as equated to the volume of a sphere. As an example, a particle may be ellipsoidal and, for example, defined by a major axis length and/or a minor axis length.

As an example, a particle may include a shape other than spherical, ellipsoidal, etc. As an example, consider needle or rod shaped particles that may be characterized at least in part by an aspect ratio of a longest dimension to a shortest dimension (e.g., consider an aspect ratio of about 5 to 1 or more). As another example, consider plate or platelet shape particles, which may be characterized at least in part by planar dimensions and a thickness dimension.

As an example, particulate matter may be characterized at least in part by one or more of a particle population mean as an average size of a population of particles, a particle population median as a size where approximately 50 percent of the population is below and approximately 50 percent is above, and a particle population mode or modes, for example, a size with highest frequency.

As an example, particulate material may include particles that are substantially spherical in shape (e.g., optionally characterized by sphericity). In such an example, a particle may be characterized by a particle size that corresponds to a diameter (e.g., assuming spherical shape). As an example, a powder may include particles with corresponding particle sizes that are within a range of less than about 100 microns and greater than about 10 microns.

As an example, particles may include crystalline structures, for example, a particle may be greater than about 80 weight percent crystalline. In such an example, a particle may include an amorphous structure, for example, a particle may be less than about 20 weight percent amorphous and greater than about 80 weight percent crystalline.

Crystals tend to have relatively sharp, melting points as component atoms, molecules, or ions tend to be ordered with regularity (e.g., with respect to neighbors). An amorphous solid can exhibit particular characteristics, for example, upon cleaving or breaking, an amorphous solid tends to produce fragments with irregular surfaces and an amorphous solid tends to exhibit poorly defined patterns in X-ray imaging. An amorphous, translucent solid may be referred to as a glass.

Various types of materials may solidify into an amorphous form where, for example, a liquid phase is cooled with sufficient rapidity. Various solids may be intrinsically amorphous, for example, because atoms do not fit together with sufficient regularity to form a crystalline lattice or because impurities disrupt formation of a crystalline lattice. For example, although the chemical composition and the basic structural units of a quartz crystal and quartz glass are the same (e.g., $SiO_2$ and linked $SiO_4$ tetrahedra), arrangements of atoms in space are not. Crystalline quartz includes an ordered arrangement of silicon and oxygen atoms; whereas, in quartz glass, atoms are arranged relatively randomly. As an example, when molten $SiO_2$ is cooled rapidly (e.g., at a rate of about 4 K/min), it can form quartz glass; whereas, large quartz crystals (e.g., of the order of a centimeter or more) may have had cooling times of the order of years (e.g., thousands of years).

Aluminum crystallizes relatively rapidly; whereas, amorphous aluminum may form when liquid aluminum is cooled at a rate of, for example, about $4\times10^{13}$ K/s. Thus, cooling rate of aluminum can determine how atoms arrange themselves (e.g., regularly or irregularly).

As an example, a particle may be polycrystalline, for example, composed of crystallites (e.g., grains) that can vary in size and orientation. As an example, grain size may be determined using a technique such as X-ray diffraction, transmission electron microscopy, etc.

A grain boundary may be defined as the interface between two grains in a polycrystalline material. Grain boundaries, defects in crystal structure, tend to decrease electrical and thermal conductivity of material. Grain boundaries may be sites for precipitation of one or more phases, which may be referred to as grain boundary material. Grain boundaries may disrupt motion of dislocations through a material. As an example, reduction of grain size may improve strength, for example, as described by the Hall-Petch relationship.

As an example, grain boundaries may meet at a so-called grain boundary triple point (GBTP). At a GBTP (e.g., a volumetric space), a phase or phases (e.g., of grain boundary material) may exist that differ from that of crystalline material in a grain.

As an example, a powder may include particles that include grain sizes of less than about 2 microns. As an example, grain sizes may be less than about 1 micron. As an example, average grain sizes may be less than about 0.5 microns (e.g., less than about 500 nm). As an example, average grain sizes may be less than about 200 nm. As an example, material that exists between grains may be of a dimension of an order of tens of nanometers to an order of hundreds of nanometers. As an example, material that exists between grains may be of a dimension that is less than an average grain size. For example, consider grains with an average grain size of the order of hundreds of nanometers and grain boundary material with an inter-grain spacing dimension of the order of tens of nanometers.

As an example, a powder particle may include grains that include one or more materials at their boundaries. For example, a grain may be bound by a select material at its boundaries. As an example, a grain boundary material may coat a grain such that the grain is substantially encapsulated by the grain boundary material. As an example, a grain boundary material may be described as "wetting" a grain, for example, a grain boundary material may be continuous and wet an entire surface (e.g., boundary) of a grain. As an example, a particle can include grains that are in a continuum of a grain boundary material. In such an example, the grains may be spaced from each other by the grain boundary material. As an example, a size of the boundary (or the spacing between grains) may be of the order of tens of nanometers to hundreds of nanometers. The spacing between grains (e.g., the size of the grain boundary) may be determined at least in part based on the surface tension of the grain boundary material and the grain. Thus, for example, spacing may vary depending on the material in the grain boundary and the material of the grain. As an example, strength of a powder particle may be approximated at least in part by a relationship such as, for example: $\propto 1/\sqrt{\bar{d}}$, where $\bar{d}$ is the average grain size and $\sigma$ is the energy of the grain boundary.

As an example, to form a continuous grain boundary, a boundary forming component of a melt may be greater than about two percent by weight. For example, consider a melt of an aluminum alloy and gallium where the gallium is present at a weight percent greater than about two percent and less than about 20 percent (e.g., optionally less than about 10 percent, and in some examples less than about five percent). In such an example, atomization of the melt can form particles with grains that reside in a continuum of grain boundary material that includes gallium (e.g., a substantially continuous boundary material that includes gallium). In such an example, more than about 90 percent of the gallium can be preferentially segregated to the grain boundary (e.g., located within the grain boundary material). While higher percentages of gallium may optionally be included in a melt, in general, a higher the percentage of gallium can result in formation of globular nodules within a particle. Such globular nodules can result in a reduction of mechanical strength of a particle. Where a powder is to be used to form a part or a tool (e.g., a downhole tool) that is to withstand certain mechanical force(s), yet be degradable, the powder may be formed of a melt that is tailored to meet mechanical force and degradability criteria. As an example, a degradability criterion may be met by including at least about two percent by weight of a select material (e.g., or materials) in a melt. In such an example, a powder formed by the melt can be at least about two percent by weight of the select material (e.g., considering material conservation). As an example, a powder may be of at least about two percent by weight of a select material (e.g., or select materials).

As an example, a melt may include greater than about 80 percent by weight of an aluminum alloy and greater than about two percent by weight of a select material or materials. In such an example, consider as the select material, or materials, one or more of gallium, indium, tin, bismuth, and lead. As an example, a select material or materials may include one or more basic metals where, for example, basic metals include gallium, indium, tin, thallium, lead and bismuth (e.g., basic metals of atomic number of 31 or greater). As an example, grain boundary material may include aluminum, which is a basic metal with an atomic number of 13, in addition to one or more other basic metals. As an example, a basic metal may be a post-transition metal (e.g., metallic elements in the periodic table located between the transition metals (to their left) and the metalloids (to their right) and including gallium, indium and thallium; tin and lead; and bismuth). As an example, a melt may optionally include mercury, which is a transition metal (e.g., a group 12 transition metal). As an example, a powder formed of such a melt can include mercury, which may be a boundary material that bounds grains of particles of the powder. As an example, a melt may optionally include zinc, which is a transition metal (e.g., a group 12 transition metal).

As an example, a melt and a powder formed from the melt can include one or more alkali metals. For example, consider one or more of lithium, sodium, and potassium. As an example, a melt and a powder formed from the melt can include one or more alkaline earth metals. For example, consider one or more of beryllium, magnesium, calcium, strontium and barium. As an example, a powder and/or a melt may include one or more rare earth elements. As an example, a powder and/or a melt may include scandium, thallium, etc.

As an example, one or more of an alkali metal, an alkaline earth metal, or a basic metal may be used as the select material or materials for a melt. As an example, a melt may include gallium and indium. The gallium and indium may preferentially segregate to the grain boundary, for example, during a severe plastic deformation process, resulting in a desired powder particle. Materials of an aluminum alloy, such as, for example, aluminum, magnesium, silicon, copper, for example, may also appear in the grain boundary.

As an example, consider cooling a melt that includes aluminum, magnesium and gallium such that grains form with a first amount of gallium and such that at the boundaries of the grains material forms with a second amount of gallium that exceeds the first amount of gallium. In such an example, the material at the boundaries may be characterized as gallium enriched. In such an example, the amount of gallium in the grains may be negligible (e.g., grains may be formed of an aluminum alloy substantially devoid of gallium).

As an example, a material may include aluminum (e.g., melting point of about 1220 degrees F., about 660 degrees C. or about 930 K), magnesium (e.g., melting point of about 1200 degrees F., about 650 degrees C. or about 920 K) and gallium (e.g., melting point of about 86 degrees F., about 30 degrees C. or about 300 K). Such a material may be provided in a molten state and cooled to form grains and boundaries where the boundaries are enriched in gallium (e.g., a low melting point material of the bulk material).

As an example, a material may include gallium, indium and tin. In such an example, gallium, indium (e.g., melting point of about 314 degrees F., about 157 degrees C. or about 430 K) and tin (e.g., melting point of about 450 degrees F., about 232 degrees C. or about 500 K) may alloy (e.g., forming a eutectic alloy with a melting point of about −19 degrees C., about −2 degrees F. or about 250 K). Such a material may be provided in a molten state and cooled to form grains and boundaries where the boundaries are enriched in at least gallium (e.g., as an alloy of gallium, indium and tin as a low melting point material of the bulk material).

As an example, a material may include aluminum, magnesium and copper (e.g., melting point of about 1990 degrees F., about 1090 degrees C. or about 1360 K). In such an example, the material may experience an increase in strength when subjected to solution heat treatment and quenching. As an example, an aluminum, magnesium and copper alloy may increase in strength and exhibit considerable ductility upon ageing at ambient temperature (e.g., about 25 degrees C. or about 300 K).

As an example, an alloy may be characterized by a series designation. For example, consider the following series that include aluminum: 1000 series alloys that include a minimum of 99 weight percent aluminum content by weight, 2000 series alloys that include copper, 3000 series alloys that include manganese, 4000 series alloys that include silicon, 5000 series alloys that include magnesium, 6000 series alloys that include magnesium and silicon, 7000 series alloys that include zinc, and 8000 series alloys that include one or more other elements not covered by other series (e.g., consider aluminum-lithium alloys).

As an example, alloys that include aluminum may be represented by designations such as: 1xx.x series that include a minimum of 99 percent aluminum, 2xx.x series that include copper, 3xx.x series that include silicon, copper and/or magnesium, 4xx.x series that include silicon, 5xx.x series that include magnesium, 7xx.x series that include zinc, 8xx.x series that include tin and 9xx.x that include other elements.

As to 1000 series alloys, with aluminum of 99 percent or higher purity, such alloys may be characterized by considerable resistance to corrosion, high thermal and electrical conductivity, low mechanical properties and workability, while tending to be non-heat treatable.

As to 2000 series alloys, these include copper as an alloying element, which tends to impart strength, hardness and machinability; noting that such alloys tend to be heat treatable.

As to 3000 series alloys, these include manganese as an alloying element and they tend to have a combination of corrosion resistance and formability while tending to be non-heat treatable.

As to 5000 series alloys, these include magnesium as an alloying element, which may be, for example, optionally included along with manganese to impart a moderate- to high-strength, non-heat-treatable alloy. A 5000 series alloy may be weldable and relatively resistance to corrosion (e.g., even in marine applications).

As to 6000 series alloys, these include magnesium and silicon in various proportions to form magnesium silicide, which makes them heat treatable. Magnesium-silicon (or magnesium-silicide) alloys tend to possess good formability and corrosion resistance with high strength.

As to 7000 series alloys, these include zinc as an alloying element and, for example, when coupled with a smaller percentage of magnesium, such alloys may tend to be heat-treatable and of relatively high strength.

As an example, a material may be degradable and, for example, an alloy may be degradable (e.g., a degradable alloy). As an example, a material may degrade when subject to one or more conditions (e.g., over time). For example, consider one or more environmental conditions and/or "artificial" conditions that may be created via intervention, whether physical, chemical, electrical, etc. As an example, conditions can include temperature, pressures (e.g., including loads and forces), etc.

As an example, a degradable alloy may degrade at least in part due to presence of internal galvanic cells (e.g., that provide for galvanic coupling), for example, between structural heterogeneities (e.g. phases, internal defects, inclusions, etc.). As an example, a degradable material may resist passivation or, for example, formation of one or more stable protective layers.

As an example, a degradable alloy can include one or more alloying elements "trapped" in "solid solution". As an example, a material may include a metal such as aluminum, which may be impeded from passivating or building a resilient protective layer (e.g., aluminum oxide such as $Al_2O_3$).

As an example, a material can include one or more ceramics. For example, a material can include an inorganic, nonmetallic solid that includes metal, nonmetal or metalloid atoms, at least in part held in ionic and covalent bonds. A ceramic may be regular and/or irregular in structure, for example, atoms may be regularly oriented and crystalline, semi-crystalline and/or amorphous (e.g., ceramic glass). As an example, a ceramic may be an oxide (e.g., alumina, beryllia, ceria, zirconia, etc.). As an example, a ceramic may be a nonoxide (e.g., carbide, boride, nitride, silicide, etc.). As an example, a ceramic may include an oxide and a nonoxide.

As an example, a material can include one or more oxides. As an example, during processing of an alloy in the presence of oxygen, one or more oxides may form. For example, consider an alloy that includes aluminum where alumina (e.g., an aluminum oxide, $Al_2O_3$) forms. As another example, consider an alloy that includes silicon where silica (e.g., a silicon oxide, $SiO_2$) forms. As an example, an oxide may be a dispersed material in a particle. As an example, an oxide may be of a size of about 10 nm or less and optionally about 5 nm or less.

As an example, a material can include concentrations of one or more solute elements, for example, trapped in interstitial and in substitutional solid solutions. As an example, concentrations, which may be spatially heterogeneous, of such one or more solute elements, may be controlled through chemical composition, processing, etc. As an example, consider rapid cooling where solubility is higher than at ambient temperature or temperature of use.

As an example, a material may include one or more elements or phases that liquate (e.g., melt, etc.) once elevated beyond a certain temperature, pressure, etc., which for alloys may be predictable from phase diagrams, from thermodynamic calculations (e.g., as in the CALPHAD method), etc.

As an example, a material may "intentionally" fail via liquid-metal embrittlement, for example, as in an alloy that includes gallium and/or indium. As an example, a degradable material may include an alloy or alloys and possess phases that may be susceptible to creep (e.g., superplastic) deformation (e.g., under intended force, etc.), possess phases that are brittle (e.g., which may rupture in response to impact, etc.).

As an example, a degradable material may include a calcium alloy such as, for example, calcium-lithium (Ca—Li), calcium-magnesium (Ca—Mg), calcium-aluminum (Ca—Al), calcium-zinc (Ca—Zn), calcium-lithium-zinc (Ca—Li—Zn), etc. As an example, in a calcium-based alloy, lithium may be included in concentrations, for example, between about 0 to about 10 weight percent (e.g., to enhance reactivity, etc.). As an example, concentrations ranging from about 0 to about 10 weight percent of one or more of aluminum, zinc, magnesium and silver may enhance mechanical strength.

As an example, a material may include one or more magnesium-lithium (Mg—Li) alloys, for example, enriched with tin, bismuth and/or one or more other low-solubility alloying elements.

As an example, a material can include one or more alloys of aluminum. As an example, a material may include one or more of an aluminum-gallium (Al—Ga) alloy and an aluminum-indium (Al—In) alloy. As an example, a material may include one or more of an aluminum-gallium-indium (Al—Ga—In) and an aluminum-gallium-bismuth-tin (Al—Ga—Bi—Sn) alloy.

As an example, a material can include aluminum, gallium and indium. For example, consider a material with an alloy of about 80 weight percent aluminum, about 10 weight percent gallium and about 10 weight percent indium. Such a material may include Vickers microhardness (500 g) of about 32 (#1), 34 (#2), 34 (#3), 30 (#4), 35 (#5), 36 (#6) and 33 (average) and estimated strength of about 100 (MPa), 15 (ksi) and 1.5 (normalized).

As an example, a component may be formed of material that provides a desired degradation rate and desired mechanical properties (e.g., strength, etc.). As an example, a degradation rate may depend upon one or more conditions (e.g., temperature, pressure, fluid environments), which may be exist in an environment and/or may be achieved in an environment (e.g., via one or more types of intervention). As an example, a material may be conditionally degradable (e.g., degradable upon exposure to one or more conditions).

As an example, a material may be a metal matrix composite (MMC), which is a composite material with at least two constituent parts, one being a metal, the other material may be a different metal or another material, such as a ceramic or organic compound. When at least three materials are present, it may be referred to as a hybrid composite. As an example, a MMC may be complementary to a cermet.

As an example, a method may utilize one or more powder metallurgy (PM) techniques. As an example, one or more powder metallurgy techniques may be utilized to form particulate material. As an example, one or more powder metallurgy techniques may be utilized to form a blend of particulate materials. As an example, one or more powder metallurgy techniques may be utilized to form a component or components, for example, from a blend of particulate materials.

Figure 5:
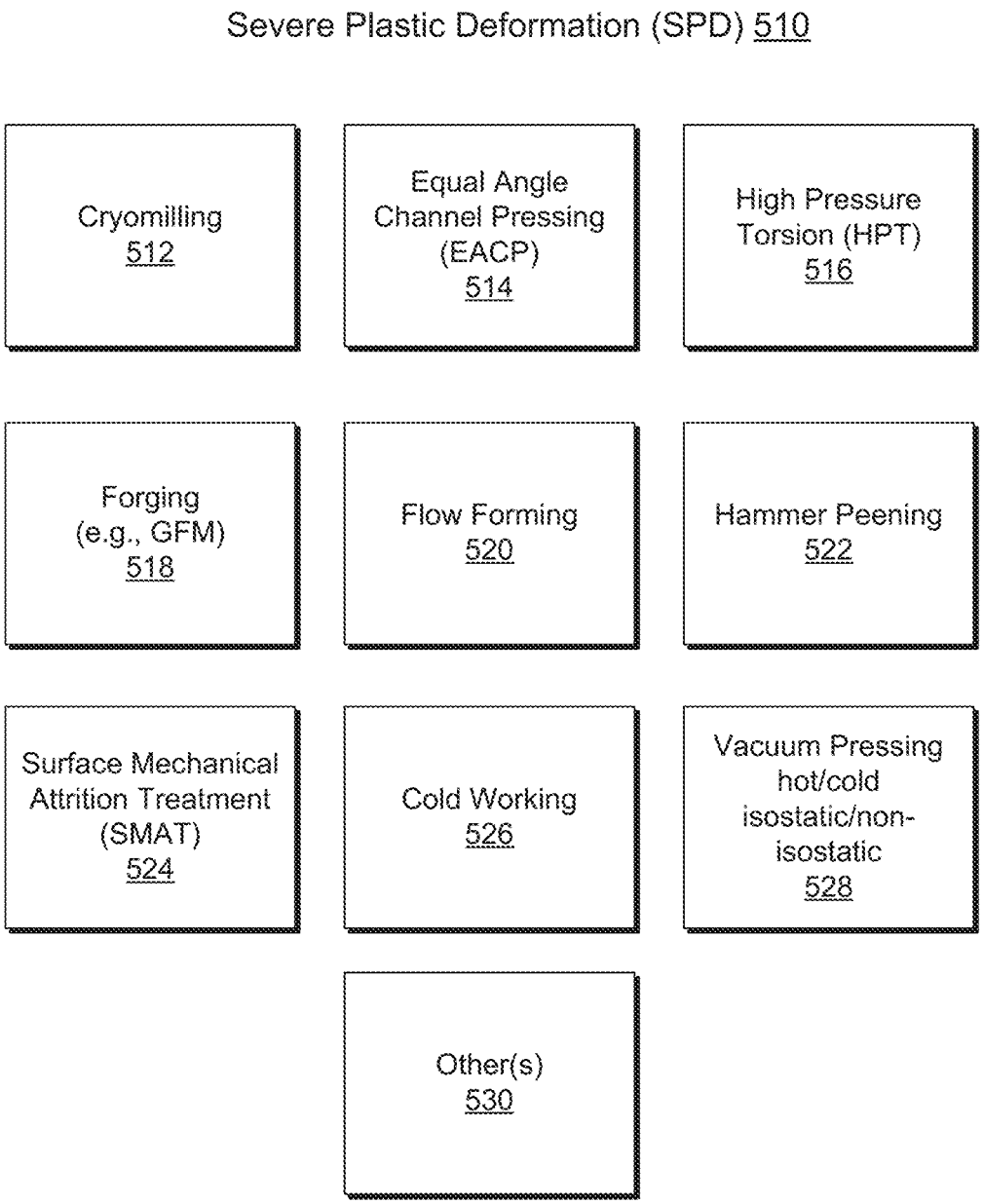
FIG. 5 illustrates some examples of severe plastic deformation processes.

FIG. 5 shows some examples of types of severe plastic deformation (SPD) processes 510, including cryomilling 512, equal channel angular pressing (ECAP) 514, high pressure torsion (HPT) 516, forging 518 (e.g., via a general forging machine, etc.), flow forming 520, hammer peening 522, surface mechanical attrition treatment (SMAT) 524, cold working 526, vacuum pressing 528 (e.g., hot and/or cold, isostatic and/or non-isostatic), and one or more other types of severe plastic deformation processes 530.

As an example, one or more SPD processes may be applied to material to produce equiaxed ultrafine grain (UFG) size (e.g., less than about 500 nm) or nanocrystalline (NC) structures (e.g., less than about 100 nm).

As an example, one or more SPD processes may be applied to material to refine structures in the material. For example, consider a material with grain sizes in a range from about 10 microns to about 100 microns and applying an SPD process that reduces the grain sizes to less than about 10 microns. As an example, one or more SPD processes may be applied, for example, to increase yield strength of material.

As an example, an SPD process may result in grain-boundary strengthening (e.g., Hall-Petch strengthening). For example, an SPD process may reduce grain size, which, in turn, increases the number of grain boundaries. As grain boundaries can act as pinning points, they can impede dislocation movement, which, in turn, can increase yield strength. Hall-Petch strengthening can exhibit a lower limit as to size where, for example, phenomena such as grain boundary diffusion may occur. In grain boundary diffusion, a lattice may resolve applied stress by grain boundary sliding, resulting in a decrease in yield strength.

As an example, a nanocrystalline material may exhibit a lower limit as to size (e.g., consider a size of about 10 nm) where, for smaller sizes, the yield strength may remain relatively constant or decrease. Such a phenomenon may be referred to as the reverse or inverse Hall-Petch relation, which may be driven by one or more of dislocation-based, diffusion-based, grain-boundary shearing-based, and/or multi-phase-based mechanisms.

As an example, a method can include refining grains to develop a nano to ultrafine grained microstructure. In such an example, refined grains may increase material strength (e.g., via Hall-Petch strengthening) and/or may increase ductility (e.g., via abetting grain boundary sliding, which may result in an alloy with high strain rate superplasticity that can enhance formability, workability, etc.).

As an example, a method can include dispersion strengthening, for example, via introduction of dispersoids (e.g., second phase particles, etc.). In such an example, consider introduction of one or more types of oxides and/or breakup of one or more types of oxide layers that may be formed around metal particles during a process such as, for example, gas atomization (e.g., in the presence of oxygen). As an example, a method can include introducing one or more types of dispersoids, for example, to increase thermal stability of material. For example, consider a method that introduces dispersoids into a bulk alloy synthesized through a powder metallurgy route where the introduction of the dispersoids (e.g., second phase particles, etc.) can increase drag within the bulk alloy.

As an example, a material may be tailored as to one or more of its mechanical properties and/or its dissolution characteristics (e.g., degradation characteristics) via one or more processes, which can include one or more SPD processes. In such an example, the material may be refined as to its grain size and/or the defect structure of its grain boundaries. As mentioned, the Hall-Petch relation can exhibit a minimum size, which may be surpassed depending on desired properties and/or characteristics of a material. For example, such a material may still be strengthened when compared to a non-SPD processed material yet include a structure size that is less than the minimum Hall-Petch relation size, which may, for example, benefit dissolution (e.g., in a desired manner).

As to ductility, consider altering grain boundary angles via one or more SPD processes where, for example, a SPD process that promotes low angle grain boundaries may result in lower ductility when compared to a SPD process that promotes high angle grain boundaries. In such an example, consider ECAP equipment that may be used to process material to achieve a desired range of grain boundary angles; noting that dislocation density may also be tailored by number of passes along one or more ECAP routes.

As an example, one or more SPD processes may be applied to material to refine grain sizes where refinement of grain size increases the number of grain boundaries. In turn, grain boundaries act to impede dislocation movement as the number of dislocations within a grain can have an effect on how easily dislocations can traverse grain boundaries and travel from grain to grain. As an example, a dislocation density may be defined by a dimension for dislocation lines divided by a unit volume. As the dislocation density of a material increases, resistance to dislocation motion by other dislocations can become more pronounced. In such an example, imposed stress to deform a material may increase with increasing cold work.

As an example, the ability of a material to plastically deform can depend on the ability of dislocations in the material to move. In such an example, hardness and strength (e.g., yield strength and tensile strength) can be related to the ease with which plastic deformation can be made to occur; for example, by reducing mobility of dislocations, mechanical strength of a material may be enhanced (e.g., leading to greater mechanical force to initiate plastic deformation of the material). In contrast, as dislocation motion becomes less constrained, a material may be more amenable to deformation (e.g., a softer and weaker material).

As explained above, a material may be tailored via one or more of SPD processing and introduction of dispersoids. Such a material may be at least in part dissolvable (e.g., degradable). For example, a method can include one or more of SPD processing and dispersoid introduction for tailoring mechanical properties of a material for a particular use and/or tailoring degradation characteristics for a particular use.

Figure 6:
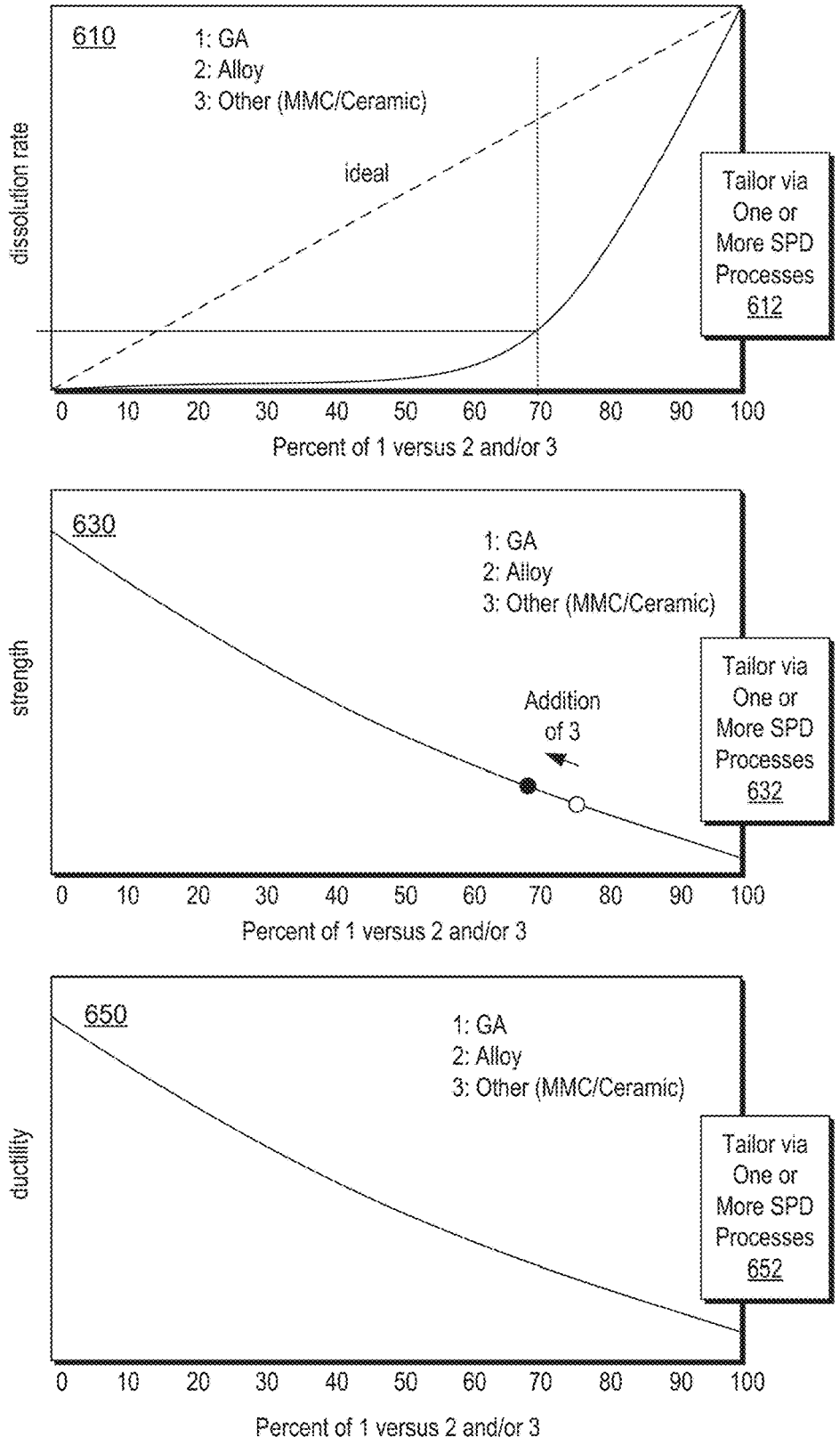
FIG. 6 illustrates examples of plots of relationships.

FIG. 6 shows example plots 610, 630 and 650 where the plot 610 illustrates an approximate relationship between dissolution rate and percent of a first material versus one or more other materials (e.g., a second material, a third material, etc.), where the plot 630 illustrates an approximate relationship between strength and percent of a first material versus one or more other materials (e.g., a second material, a third material, etc.), and where the plot 650 illustrates an approximate relationship between ductility and percent of a first material versus one or more other materials (e.g., a second material, a third material, etc.).

FIG. 6 also shows blocks 612, 632 and 652, which indicate that one or more SPD processes may be applied to tailor dissolution rate as in the plot 610, strength as in the plot 630 and/or ductility as in the plot 650. The examples of relationships shown in the plots 610, 630 and 650 may be used, for example, in combination with one or more SPD processes (e.g., consider examples of FIG. 5).

As an example, a method may include one or more heat treatments (e.g., thermal treatments). In such an example, time may be a factor over which a component may be subjected to one or more heat treatments. As an example, families of plots may be provided where, for example, temperature-time profile information allows for providing a component with particular characteristics that occur at a particular time or times.

In the plot 610, where the first material is a powder of degradable material formed at least in part via gas atomization (e.g., GA), the dissolution rate of a bulk material formed of the constituent materials may be less than an "ideal". For example, the bulk material may exhibit a relatively low dissolution rate (e.g., less than about 20 percent of a dissolution rate of the first material itself), until the first material approaches a certain percentage or range of percentages of the total. As an example, the change in dissolution rate may be more sensitive to the percentage of the first material in a particular range (e.g., a relatively high slope in dissolution rate versus percentage of the first material).

As an example, strength as in the plot 630 may be a characteristic of a bulk material (e.g., as formed into a component) that quantifies an ability to withstand an applied load without failure. As an example, strength may be characterized by one or more of yield strength (e.g., stress to cause an amount of plastic strain), compressive strength, tensile strength or ultimate tensile strength, fatigue strength, and impact strength.

As an example, ductility as in the plot 650 may be a characteristic of a bulk material (e.g., as formed into a component) that quantifies an ability to deform under tensile stress (e.g., consider fracture strain as a measure).

As illustrated in the plots 610, 630 and 650, a bulk material may be formed of various constituent materials to achieve one or more desired properties such as dissolution rate, strength and ductility.

As an example, a component may be formed of a bulk material that is a blend of a plurality of materials, which may be particulate materials. In such an example, mixing to form a blend may make, for example, a high strength degradable alloy with tailored dissolution and adequate ductility for load bearing applications. Such an approach may be achieved, for example, through a powder metallurgy (PM) route of blending of various powders.

Powder metallurgy (PM) processing can be suitable for materials that are or include light metals. For example, rapid solidification and mechanical attrition processes can produce PM alloys having improved mechanical properties. Such PM alloys may be characterized by, for example, one or more of: (1) high strength; (2) reduced density; (3) increased modulus; and (4) high-temperature properties.

As an example, near-nanostructured or ultrafine-grained (UFG) materials may be defined as materials having grain sizes whose linear dimensions are in the range of, for example, about 100 nm to about 500 nm. Such materials may optionally be or include alloys and, for example, be formed at least in part via one or more severe plastic deformation (SPD) processes. For example, an atomized powder may be subjected to one or more SPD processes.

In contrast to coarse-grained counterparts, near-nanostructured or UFG materials may benefit from reduced size or dimensionality of near nanometer-sized crystallites as well as, for example, from numerous interfaces between adjacent crystallites.

As an example, a bulk material or a portion thereof may be a metal matrix composite (MMC). In such an example, a component may be formed of such a material where the component or a portion thereof may be high strength and water reactive or degradable. Such a component may be suitable for load bearing applications. As an example, a bulk material and/or a component may be formed using a process that implements one or more powder metallurgy (PM) techniques.

As an example, a structural scale may be selected to achieve mechanical properties of an alloy. As an example, a structural scale may be selected to achieve a desired strength, as may be obtained by an ability to impede motion of dislocations with obstacles (e.g., as inversely proportional to the mean-free-path between the obstacles).

As an example, a material can include dispersed particles where the size or sizes of such particles (e.g., and shape or shapes) may be selected (e.g., or achieved during processing) such that the dispersed particles are less apt to serve as fracture-initiating flaws (e.g., when compared to larger particles).

As an example, a process can include rapid cooling to achieve a desired rate of cooling of material. As an example, a powder metallurgy (PM) process can refine features and improve properties of material. For example, grain size can be reduced because of the short time available for nuclei to grow during solidification. As an example, rapid cooling can increase one or more alloying limits in aluminum, for example, by enhancing supersaturation, which can enable greater precipitation-hardening with a reduction in undesirable segregation effects that may occur when ingot metallurgy (IM) alloys are over-alloyed. Moreover, elements that are low in solubility (e.g., practically insoluble) in a solid state may be soluble in a liquid state and may be relatively uniformly dispersed in powder particles during a process that employs rapid solidification. Non-equilibrium metastable phases or atom 'clusters' that do not exist in more slowly cooled ingots may be created by employing a rapid solidification rate; such phases can increase strength.

As an example, a process can include introduction of strengthening features via powder surfaces, for example, as scale of particles becomes finer, surface-to-volume ratio of the particles increases.

As an example, one or more oxides can be introduced on a desired scale from powder surfaces by mechanical attrition, for example, to result in oxide dispersion strengthening (ODS).

As an example, a process may include introducing one or more carbides ($B_4C$, SiC, etc.). As an example, a process may include introducing one or more insoluble dispersoids (e.g., one or more materials that are practically insoluble in one or more defined environments).

As an example, a process can include cold-working powder particles by ball-milling. For example, a process can include cold-working powder particles in a cryogenic medium (e.g., or cryogenic media). Such a process can result in increased dislocation strengthening and, upon consolidation, a finer grain (and sub-grain) size which can be further stabilized by one or more ceramic dispersoids (e.g., as may be introduced during such a SPD process).

As an example, processed powder (e.g., particulate material) can be consolidated to form a metal matrix composite (MMC). For example, consider a process that consolidates particulate material to form a billet, which may be subjected to one or more additional forming operations.

As an example, a process may include directly consolidated particulate material into a product form. For example, one or more of extruding, forging, rolled sheeting, etc., may be employed.

As to formation of a MMC, in comparison to an unreinforced solid made from consolidating powder, the MMC may exhibit an ability to blunt crack tips, for example, if a crack initiation event in the MMC occurs or, for example, if a crack is nucleated at a tri-axial stress state. A MMC may exhibit resistance to the initiation of a crack. A MMC may provide support to an overall structure by preventing ceramic particulate material or reinforcement material to be bisected by dislocation transport or de-cohesion from the matrix during plastic deformation due to mechanical bonding to the powder interior during a SPD process. Such an approach may impart desirable load bearing strength as well as, for example, desirable ductility that can resist cracking and, for example, resist subsequent failure through a shear mode.

As explained, a component may be subjected to one or more heat treatments. Table 1, below, includes information pertaining to heat treatment.

TABLE 1

Heat Treatment Trial Example

| | Without | With |
|---|---|---|
| Diameter: | 0.1255 in | 0.1250 in |
| Area: | 0.0124 sq in | 0.0123 sq in |
| Specimen Gage Length: | 1.0000 in | 1.0000 in |
| Tensile Strength: | 50970 psi | 62200 psi |
| Peak Load: | 632 lbf | 765 lbf |
| Tangent Modulus: | 9074480 psi | 9855730 psi |
| Load at Offset: | 446 lbf | 693 lbf |
| Stress at Offset: | 35950 psi | 56320 psi |
| Elongation at Offset: | 0.0055 in | 0.0079 in |
| Proportional Limit: | 0.0021 in | 0.0050 in |
| Percent Elongation: | 0.5550% | 0.7870% |
| Total Elongation: | 2.5000% | 2.8000% |
| Pretest Punch Length: | 1.00 in | 1.00 in |
| Posttest Punch Length: | 1.025 in | 1.028 in |

Specifically, Table 1 includes mechanical property values of a hot isostatic pressed (HIPed) water reactive solid alloy formed in part by blending un-milled IGA powder with cryomilled IGA powder and a solid alloy formed in part by blending un-milled IGA powder with cryomilled IGA powder that has been heat treated to promote precipitate hardening (PH). Without heat treatment, yield strength of the solid is about 25 ksi and the ultimate tensile strength is about 51 ksi; the ductility of the solid is about 7 percent and stiffness is around 9000 ksi. With heat treatment, yield strength of the solid is about 50 ksi and the ultimate tensile strength is about 62 ksi; the ductility of the solid is about 7.5 percent and stiffness is around 10,000 ksi.

As an example, a method can include naturally ageing one or more components in a wellbore at one or more wellbore temperatures for one or more periods of time to thereby alter properties of the one or more components, which may be at least in part degradable.

As an example, a component may have an operational lifetime in a wellbore that is less than about 8 hours and then age in a manner at least in part thermally that causes the component to fail more readily. In such an example, where the component is degradable in the wellbore environment, ageing may assist with degradation, for example, via one or more failure mechanisms (e.g., elongation to failure, etc.).

As an example, a material may undergo Ostwald ripening where a portion of smaller entities dissolve and redeposit on larger entities. For example, consider small crystalline grains dissolving and constituents thereof redepositing onto larger crystalline grains such that the larger crystalline grains increase in size. Near a larger crystalline grain, a zone may exist, which may be due to a gradient or gradients in composition. As an example, intermetallic precipitates may form about a larger crystalline grain, which may be considered a macroscopic process (e.g., on a scale of about 50 microns).

As an example, a material may be treated to undergo Ostwald ripening and halo-ing to achieve desired properties, which can include dissolution rate, strength and/or ductility. For example, a haloed entity in the material may dissolve at a rate that differs from smaller entities in the material. As an example, a treatment may aim to achieve a population density of haloed entities to smaller entities, for example, to tailor one or more of dissolution rate, strength and ductility.

As an example, a water reactive or degradable powder can be blended with thermally stable nanocrystalline grains processed by cryomilling and further stabilized by inclusion of one or more types of dispersoids (e.g., SiC, $B_4C$, $Al_2O_3$, etc.). Such an approach may help to enhance potential shear failure of high strength UFG and/or nano alloy with less ductility.

As an example, a method can include heat treating a solid that includes a MMC. In such an example, crack blunting ability of the solid may be enhanced by the heat treating. Such an enhancement may be via formation of precipitates that can pin agglomerated coarse particles. For example, consider a solid that includes a MMC that has an ability to blunt cracks and heat treating that solid to form precipitates that can further blunt cracks. In such an example, the heat treating may be performed before deployment of the solid (e.g., as a component), during deployment of the solid and/or after deployment of the solid. In such an example, the solid may degrade over time when subjected to conditions in a downhole environment in to which the solid is being deployed and/or is deployed.

As an example, a method can include consolidating a blend of un-milled coarse powder(s) with a cryomilled-blend of water reactive or degradable powder (e.g., in a range of about 5 percent to about 95 percent) and one or more ceramic dispersoids (e.g., SiC, $B_4C$, $Al_2O_3$, etc.). In such an example, the average size of the water reactive powders or otherwise degradable powder is larger than the average size of the one or more ceramic dispersoids. As an example, a consolidated solid can include a multimodal grain size distribution where dispersoids can provide additional ductility.

As an example, a method can include blending water reactive or degradable powder (e.g., in a range of about 5 percent to about 95 percent) with a material that includes thermally stable nanocrystalline grains processed by cryomilling. In such an example, the method may include consolidating of the blend (e.g., via one or more of HIPing, vacuum hot pressing (VHP), extrusion, etc.) to form a solid. In such an example, the solid may optionally be further processed by solution annealing and ageing to develop intermetallic precipitates and stabilize nano and/or coarse grain structures (e.g., increasing thermal stability). As an example, a precipitate hardened (PH) alloy may provide a mechanism of crack blunting, for example, if a crack is initiated in a matrix, while increasing stiffness. Such an approach can help to enhance potential shear failure of a high strength UFG and/or nano alloy with less ductility.

As an example, a method can include consolidating a blend of water reactive or degradable powder from an inert gas atomization (IGA) tank, a first cyclone and a second cyclone, for example, to help maximize yield from melt that is atomized and to help produce a multi-powder size distribution. In such an example, the blend (e.g., in a range of about 5 percent to about 95 percent) may be further blended, for example, with thermally stable nanocrystalline grains processed by cryomilling and further blended with one or more dispersoids (e.g., SiC, $B_4C$, $Al_2O_3$, etc.). The bulk alloy from such a blend, for example, when heat treated to promote intermetallic particulates, may provide additional strengthening due to thermally stable finer powder from the first and second cyclones in contrast to the IGA tank yield.

Figure 7:
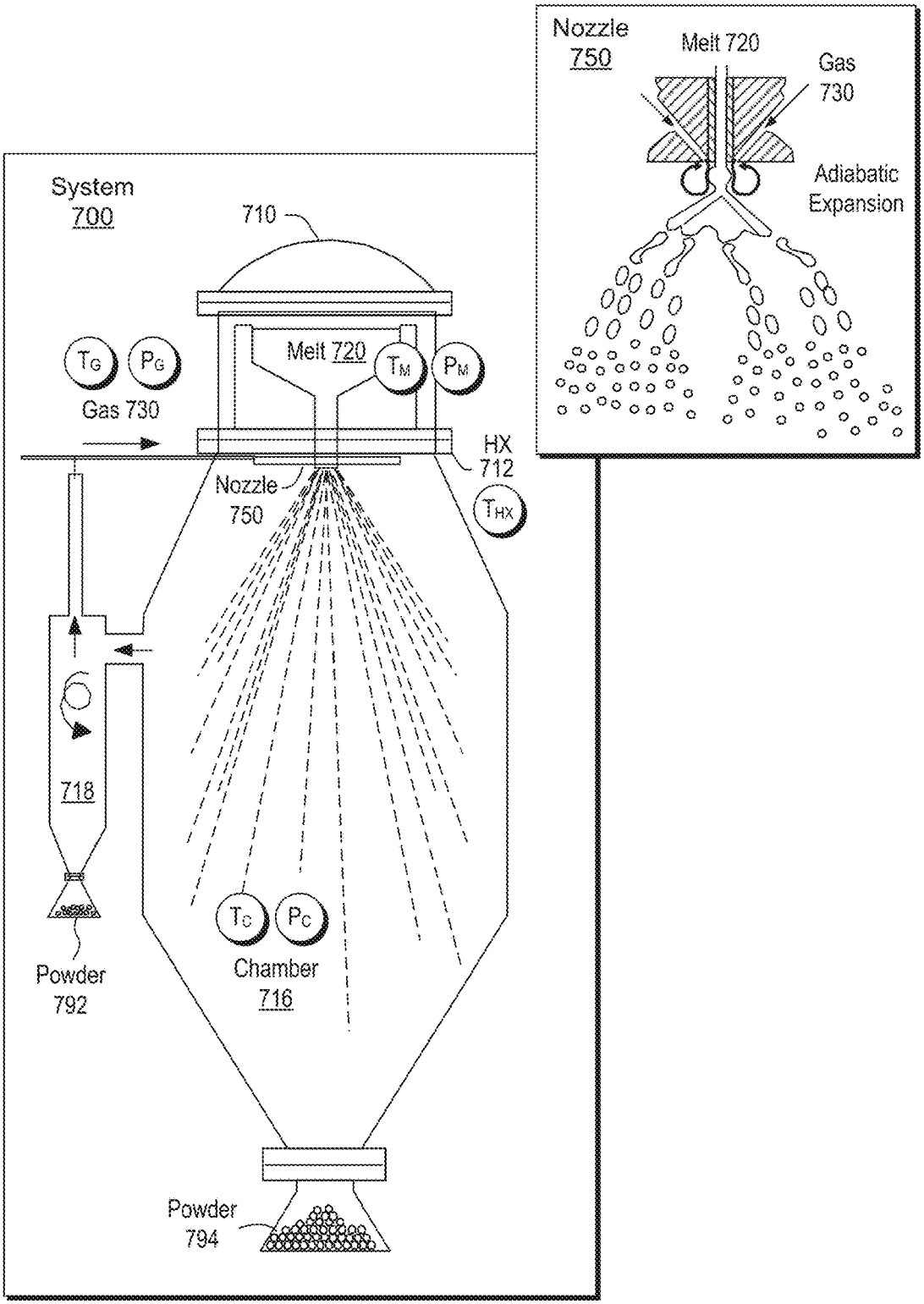
FIG. 7 illustrates an example of a system.

FIG. 7 shows an example of a system 700 that can process a melt 720 using gas 730 to form particles. In such an example, the particles may be composed of melt constituents and/or composed of melt constituents and optionally one or more gas constituents (e.g., consider oxygen in the gas 720 forming an oxide such as alumina upon exposure to aluminum in the melt 720). Particles formed via the system 700 may be powder particles. The system 700 may be considered to be a powder metallurgical system that can be implemented using powder metallurgy technology.

As shown in FIG. 7, the system 700 includes a vacuum induction furnace 710, an optional heat exchanger 712 (HX), a chamber 716, a cyclone chamber 718, and a nozzle 750. As illustrated, a rapid expansion of the gas 730 as provided to the nozzle 750 can break up the melt 720, which may form a thin sheet and subsequently ligaments, ellipsoids and/or spheres (e.g., particles). In an example of an inert gas atomization process, particles formed may be substantially spheroidal. As an example, an atomization process may be a gas atomization process (e.g., including inert and/or non-inert gas), a water atomization process, a mechanical pulverization process, etc.

Particles may be collected in the chamber 716 and in the cyclone chamber 718, which can allow gas to exit and optionally recycle (e.g., with make-up gas, etc. to maintain a gas composition where multiple gases may be used). In such an example, the cyclone chamber 718 may collect particles that are finer than the particles collected in the chamber 716. Particles of either or both chambers 716 and 718 may be combined, separated, etc.

As an example, the system 700 may include multiple cyclones, which may be in parallel and/or in series. For example, the system 700 may include a cyclone in fluid communication with the cyclone 718. As an example, particles collected (e.g., powder particles) may be of different size distributions, etc., depending on where the particles are collected (e.g., chamber 716, cyclone 718, other cyclone, etc.).

As to operational parameters of an atomization process, consider, for example, alloy composition, melt feed rate, melt temperature, melt viscosity, heat exchanger temperature (e.g., heat transfer rate, etc.), gas pressure and temperature, type of gas, nozzle geometry, etc. Gas atomization may produce particles that are substantially spherical in their shapes and that include grains and grain boundaries. As an example, gas atomization may produce particles that include crystalline structure and/or amorphous structure.

As an example, a melt temperature (see, e.g., $T_M$) may be a superheated temperature. As an example, a melt temperature may be greater than about 650 degrees C. (e.g., greater than about 700 degree C. and optionally greater than about 800 degrees C.). As an example, a chamber such as the chamber 716 may be at a temperature of about 70 degrees C. (e.g., a temperature of the order of hundreds of degrees C. less than a melt temperature). As an example, gas may expand relatively adiabatically, which may facilitate cooling of melt and reducing thermal shock.

As an example, heat transfer may occur within a system such as the system 700 such that particles are crystalline, amorphous or crystalline and amorphous.

As an example, a method may include cooling melt at a rate that causes at least a portion of a particle formed from the melt to be amorphous. For example, a method may include cooling via a cryogenic cooled target (e.g., consider the heat exchanger 712 of the system 700). As an example, a cryogenic cooled target may be positioned in front of an atomizing nozzle, for example, to achieve a cooling rate (e.g., $R_C$) where vitrification occurs for atomized (melt) droplets (e.g., to be at least in part a metallic glass structure, which may be a bulk metallic glass structure). As an example, a material may be characterized at least in part by a glass transition temperature ($T_g$) where below that temperature an amorphous material may be glassy (e.g., whereas above $T_g$ it may be molten).

As an example, a method may include introduction of a gas at a low temperature. For example, consider introduction of helium in an atomization stream (e.g., introduction of helium as a gas, in a gas provided to a nozzle or nozzles).

As an example, a method may include increasing the superheating temperature of a melt, which may increase a driving force (e.g., a temperature differential) as to heat transfer (e.g., cooling). As an example, a method may include forming particles of a particular size or smaller such that heat transfer may occur more rapidly for the particles. For example, consider selecting a nozzle dimension (e.g., diameter, slit width, etc.) to achieve a particular particle size. As an example, a method may include analyzing dendrite arm spacing during cooling and adjusting one or more parameters of a gas atomization process such that amorphous particles may be formed.

As an example, a melt may be analyzed as to one or more properties such as, for example, a glass-transition or vitrification temperature (e.g., $T_g$). As an example, a system may be operated such that transformation takes place at the glass-transition temperature, $T_g$, below an equilibrium temperature for the solidification (e.g., a liquidus temperature, TL), which may act to "freeze" an atomized melt in a non-equilibrium state (e.g., at least in part as an amorphous material). As an example, a liquidus temperature may be the maximum temperature at which crystals can co-exist with a melt in thermodynamic equilibrium. As an example, a method may consider a solidus temperature (Ts) that quantifies a point at which a material crystallizes. As an example, for a material, a gap may exist between its liquidus and solidus temperatures such that material can include solid and liquid phases simultaneously (e.g., akin to a slurry).

As an example, a method may include cooling a melt to produce an amorphous melt-span ribbon. In such an example, the ribbon may be further processed, for example, by mechanical crushing of the ribbon to form a powder.

As an example, a water reactive powder (e.g., a degradable powder) may be processed to form a component or components. In such an example, the powder may be produced by gas atomization (e.g., using one or more gases, optionally one or more inert gases), by ball milling, by crushing or other mechanical means, by sol-gel, etc.

As an example, a powder may include particles of one or more particle size distributions. For example, consider D90 less than about 44 microns (e.g., a mesh size of about 325), D90 less than about 60 microns, D90 less than about 90 microns, etc.

As an example, a material may be subjected to one or more SPD processes. As an example, a method can include employing one or more SPD processes.

As an example, where a method includes processing via ECAP, the method can include shearing of grains in consolidated or unconsolidated powder through a channeled die at low to high angles. As an example, ECAP can include passing material through a die (e.g., or dies) at various angles, which may abet refining of grains (e.g., of a water reactive powder), for example, to achieve a desired minimum grain size (e.g., after a certain number of ECAP passes). As an example, a method can include ECA pressing, for example, at one or more temperatures. In such an example, the pressing may cause in situ consolidation of powder into a solid. Such a solid may be further consolidated into an approximately 100 percent dense billet (e.g., via forging, extrusion, etc.).

As an example, a method can include performing ECAP to abet refining of grains, for example, to achieve a minimum grain size (e.g., after a certain number of ECAP passes).

As an example, a method can include performing cryomilling to abet refining of grains, for example, to achieve a minimum grain size (e.g., after a certain duration of milling).

As an example, a method can include performing HPT to abet refining of grains, for example, to achieve a minimum grain size (e.g., after a certain number of HPT turns or revolutions).

As an example, a method can include performing cold working to abet refining of grains, for example, to achieve a minimum grain size (e.g., after a certain percentage of cold working).

As an example, a powder or a blend of powders may be processed to achieve one or more desired properties such as, for example, one or more desired properties of strength, ductility, fracture toughness, thermal stability, microstructure, etc.

As an example, a desired strength may be achieved at least in part via control of grain size. As an example, a desired ductility may be achieved at least in part via control of grain size. As an example, a desired fracture toughness may be achieved at least in part via control of grain size. As an example, a desired thermal stability may be achieved at least in part via control of grain size. As an example, a desired microstructure may be achieved at least in part via control of grain size.

As an example, a method may include controlling grain size. For example, consider alternating grain size from the point of inflection of an inverse Hall-Petch trend (e.g., varying for different alloys, consider about 50 nm) to an upper limit of ultrafine grains (e.g., about 1000 nm or 1 micron). As an example, a method can include controlling grain size by controlling one or more parameters of one or more SPD processes (e.g., cryomilling time, ECAP passes, HPT turns or revolutions, percentage of cold work, etc.).

As an example, a method can include controlling properties of material via grinding the material with one or more grinding media. In such an example, a method may include controlling size of a grinding medium and/or controlling ratio of a grinding medium to material.

As an example, a method can include processing water reactive powder via one or more SPD processes, for example, to tailor dissolution rate in a fluid, to tailor dissolution rates in various fluids, etc. As an example, a fluid may be a hydraulic fracturing fluid. As an example, a fluid may include a salt concentration or concentrations of salts. For example, consider a fluid that includes one or more of NaCl, KCl and $MgCl_2$. As an example, a fluid may be an aqueous fluid. Such an aqueous fluid may include one or more salts. As an example, a method may include varying percentages of one or more inhibited acid that may be used in one or more spearheading operations during hydraulic fracturing. As an example, a method can include tailoring dissolution rate (e.g., degradation rate) by controlling grain size. As an example, one or more SPD processes may be used for refining grains, for example, to achieve a minimum grain size (e.g., optionally altering grain size from the point of inflection of an inverse Hall-Petch trend).

As an example, dissolution rate (e.g., degradation rate) may be influenced by disruption of a continuous grain boundary network. One or more characteristics of such a network may be influenced by one or more SPD processes (e.g., consider a number of ECAP passes, etc.). As an example, dissolution rate (e.g., degradation rate) may be influenced by precipitation of an additional phase of dispersoids, for example, as may be processed during high temperature ECAP and/or one or more other SPD processes.

As an example, a method can include precipitating second phase dispersoids. In such an example, the properties of such dispersoids may be influenced by choice of one or more cryogenic media. For example, consider use of one or more of liquid nitrogen and liquid argon. As an example, precipitation of second phase dispersoids may be influenced by choice of one or more grinding media. For example, consider use of one or more of low alloy/carbon steel balls, stainless steel balls, Ni alloy balls, ceramic balls, etc.

As an example, a method can include making a high strength degradable alloy with ductility from a brittle cast equivalent for load bearing applications via powder metallurgy (PM) technology. In such an example, the high strength degradable alloy may be utilized in a variety of contexts including, for example, downhole contexts (see, e.g., various components of FIGS. 1, 2 and 3).

As an example, a degradable alloy may be designed to dissolve upon exposure to one or more downhole conditions. As an example, a degradable alloy may be used to make at least a portion of one or more downhole tools or apparatuses that can withstand pressures, such as those used in a fracturing operation (see, e.g., FIGS. 1, 2 and 3). For example, a degradable alloy may be used to create one or more components used in a fracturing operation. For example, a degradable alloy may be used in some embodiments as an obstruction member (e.g., a dart, a ball, etc.) and/or one or more parts of a seat configured to catch the obstruction member. As a material may be designed to dissolve under downhole conditions (e.g., after completion of at least a portion of a fracturing operation), one or more components made of the degradable alloy can disappear (e.g., optionally without further intervention).

As an example, fine-grained (FG) materials may be defined as materials having grain sizes whose linear dimensions are of the order of about $10^{-6}$ meters or a micrometer (e.g., μm, or micron, μ). In some embodiments, one or more physical properties of such FG materials may result in enhanced strength when compared to a coarse-grained counterpart, for example, due to Hall-Petch strengthening of a FG material. As an example, a FG material may exhibit fair elongation to failure when compared to a coarse-grained counterpart.

As an example, a FG material may exhibit characteristics associated with reduced size or dimensionality of fine crystallites as well as from numerous interfaces between adjacent crystallites. As an example, a FG material may be formed where material of crystallites (e.g., grains) have a first composition and where material between crystallites (e.g., at grain boundaries) have a second composition that differs from the first composition. For example, where a bulk FG material includes aluminum and gallium, a second composition (e.g., of material between grains) may be gallium enriched when compared to a first composition (e.g., of material forming grains).

Various routes exist for engineering alloys with fine grains. For example, SPD may result in formation of an ultra-fine or a nanostructure in a bulk material. As another example, consider the system 700 of FIG. 7 where gas atomization (e.g., using inert and/or other gas or gasses) may result in production of controlled fines. For example, consider a gas atomization process that can generate particles that may be characterized at least in part by size (e.g., consider a size distribution of about 10 microns to about 20 microns). In such an example, grains in particles may be of the order of about a micron. As an example, particles may be formed via gas atomization that include grains of the order of less than about one micron (e.g., optionally less than about half a micron).

Consolidation of a powder to form a solid may be accomplished, for example, via one or more processes. For example, consider using hot isostatic pressing (HIPing) and/or vacuum hot pressing (VHF') followed by back extrusion, a warm working technique, etc. In such examples, a product may be a component, which may be, for example, a homogeneous engineering solid with desired mechanical properties and fracture toughness. As an example, a product may be a component that includes heterogeneity, for example, consider a surface subject to SMAT such that near surface material differs at least structurally from other material disposed a greater distance from the surface.

As an example, a consolidated solid (e.g., as produced at least in part from a powder) may include thermally stable fine grains that resist grain growth due to thermal activation, which may oppose degradation in their mechanical properties at elevated temperatures. As an example, combinations of high strength, enhanced ductility and/or high strain rate superplasticity may manifest in an alloy due to various competing mechanisms, for example, grain boundary sliding, etc. As an example, one or more SPD processes may be applied to one or more consolidated solids to augment mechanical properties (e.g., to achieve one or more target criteria).

As an example, a degradable alloy (e.g., water reactive, etc.) may be processed to from a segregated brittle cast solid, a high strength engineering alloy, etc. As an example, a degradable alloy may be prepared via inert gas atomization (IGA) followed by consolidation via one or more SPD processes, optionally followed by extrusion. In such an example, a resulting bulk alloy may include one or more sub-structural features. For example, consider a resulting bulk alloy that includes oxide particles resulting from breakup of oxide layers that are formed around metal particles during gas atomization to provide enhanced thermal stability and strength by mitigating dislocation motion.

As an example, a process may include one or more of the following: refining grains to develop a nano to ultrafine grained microstructure; Hall-Petch strengthening to increase strength; forming desirable grain boundaries to increase ductility (e.g., abetting grain boundary sliding to make a treated alloy high strain rate superplastic to enhance formability and working); dispersion strengthening (e.g., via introduction of one or more additional phase particles/oxides, which may result from the breakup of oxide layers that are formed around metal particles during gas atomization); and increasing thermal stability of a bulk alloy (e.g., synthesized through powder metallurgy technology via introduction of particles of an additional phase, which may impact drag).

As an example, a processed material (e.g., a resulting alloy, etc.) may exhibit one or more of the following: increased strength and ductility, relatively uniform properties (e.g., bulk homogeneity in comparison to a brittle, precipitate hardened cast counterpart material), increased thermal stability, and an ability to abet strain hardening through dislocation strengthening.

As an example, a method may include one or more of the following processes and/or produce a material that includes one or more properties listed below (e.g., of a desired high strength degradable alloy): inert gas atomization (IGA) of a brittle cast melt with controlled flow through one or more nozzles (e.g., optionally of varying sizes) to yield powder particles of varying mesh size; particulate (approximately 80 percent to approximately 100 percent (e.g., approximately 90 percent) screened distribution) with sizes varying between about 10 microns and about 70 microns (e.g., between about 20 microns and about 60 microns).

Figure 8:
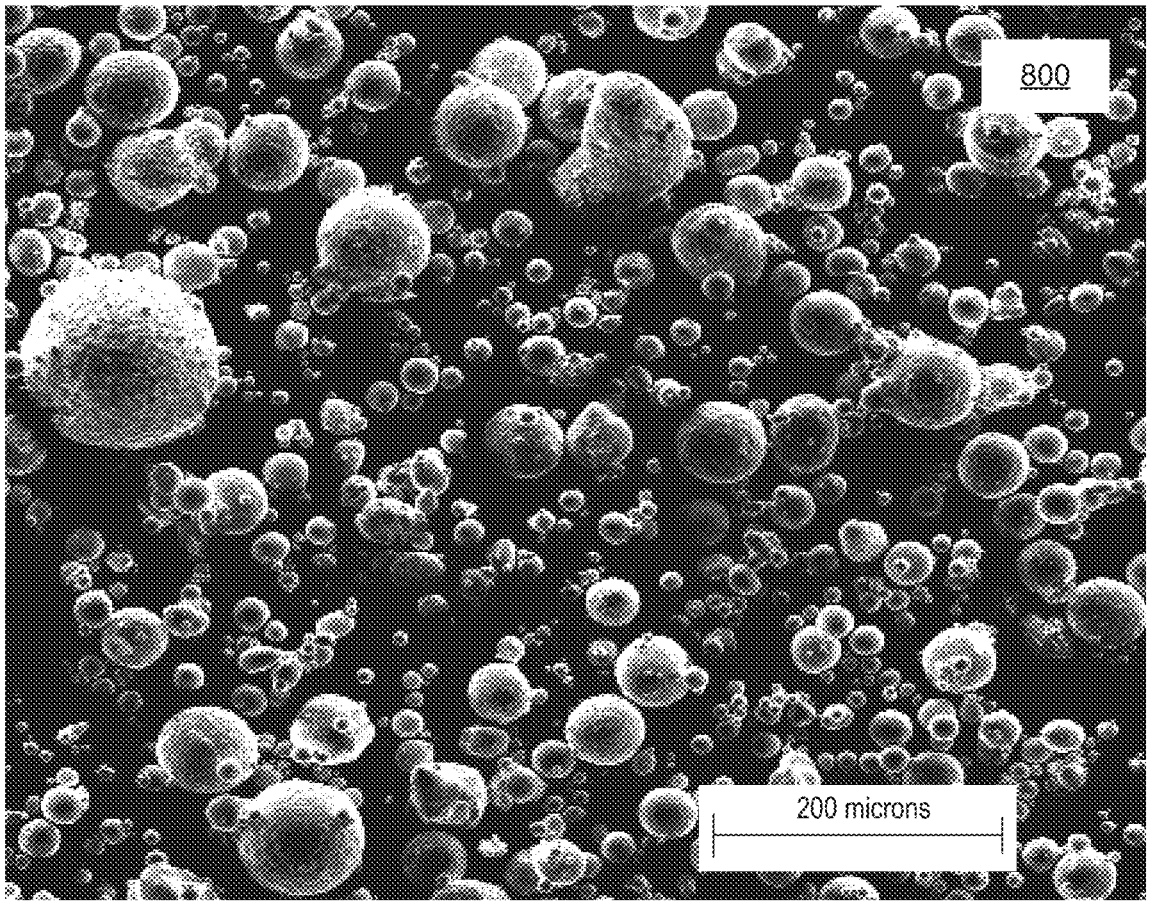
FIG. 8 illustrates an example of a micrograph of an example of particles.

FIG. 8 shows a scanning electron micrograph 800 of particles produced via gas atomization of a brittle cast melt. Such particles may be formed by cooling the melt as it exits a nozzle (see, e.g., the nozzle 750 of the system 700 of FIG. 7). Such cooling may be adiabatic cooling. For example, adiabatic cooling can occur when pressure on an adiabatically isolated system is decreased, allowing it to expand, thus causing it to do work on its surroundings. When the pressure applied on a parcel of gas is reduced, the gas in the parcel is allowed to expand; as the volume increases, the temperature falls as internal energy decreases.

As an example, a gas atomization process may "capture" melt in a particle as a supersaturated solid solution. As an example, a particle may include properties that can reduce segregation of alloying constituents in solid solution. As an example, a gas atomization process may yield fine to ultrafine grain microstructure in particles that form a powder.

Figure 9:
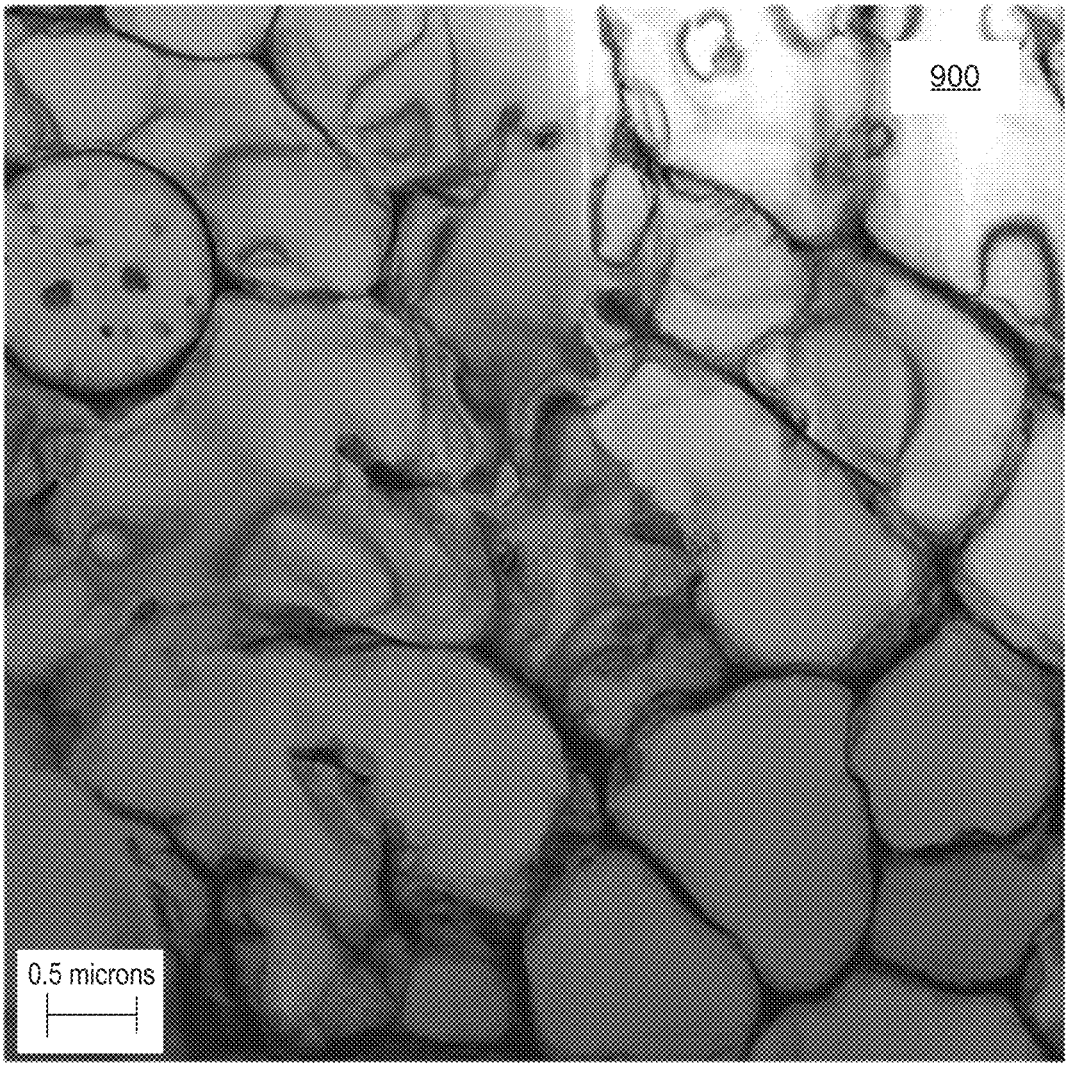
FIG. 9 illustrates an example of a micrograph of an example of a particle.

FIG. 9 shows an example of a transmission electron micrograph (TEM) 900 of a particle of a powder. The TEM 900 shows ultrafine grains with darker grain boundaries; noting focus ion beam (FIB) sample preparation. Specifically, the TEM 900 shows that the particle includes grains with dimensions of the order of about one micron or less. The TEM 900 shows various grains that include dimensions of about 0.5 microns.

As an example, a process can generate particles with grains where, for example, the processing provides for segregation of one or more low melting point constituents at grain boundaries. In such an example, the one or more low melting point constituents can coat grains and through such coating form a galvanic couple.

As an example, particles of a powder may include grain boundary interfaces where intermetallic precipitates can form during one or more ageing process, which may, for example, result in additional strengthening of the material (e.g., alloy, alloy and ceramic, etc.).

As an example, a process may provide for weakening of grain boundary interfaces in a component formed of a powder produced via gas atomization, which may help to promote embrittlement of the boundaries and further enhance a degradation mechanism (e.g., or degradation mechanisms). For example, consider a particle of a material that includes aluminum and gallium where gallium enrichment at grain boundary interfaces may promote embrittlement of the boundaries and where at least gallium interacts with fluid in a manner that causes degradation of the particle. As an example, a component formed of such particles (e.g., via processing of such particles) may degrade upon exposure to fluid and via embrittlement.

As an example, a material may include one or more oxide dispersoids, which may provide enhanced thermal stability and strengthening, for example, due to pinning of grain boundaries and dislocations.

As an example, differential cooling of a warm powder may abet diffusion of one or more low melting point constituents from a trapped supersaturated solid solution to a grain interior along a grain boundary, for example, causing liquid-metal embrittlement, which may enhance a degradation mechanism (e.g., consider a mechanism where gallium interacts with fluid in a manner that causes degradation).

Figure 10:
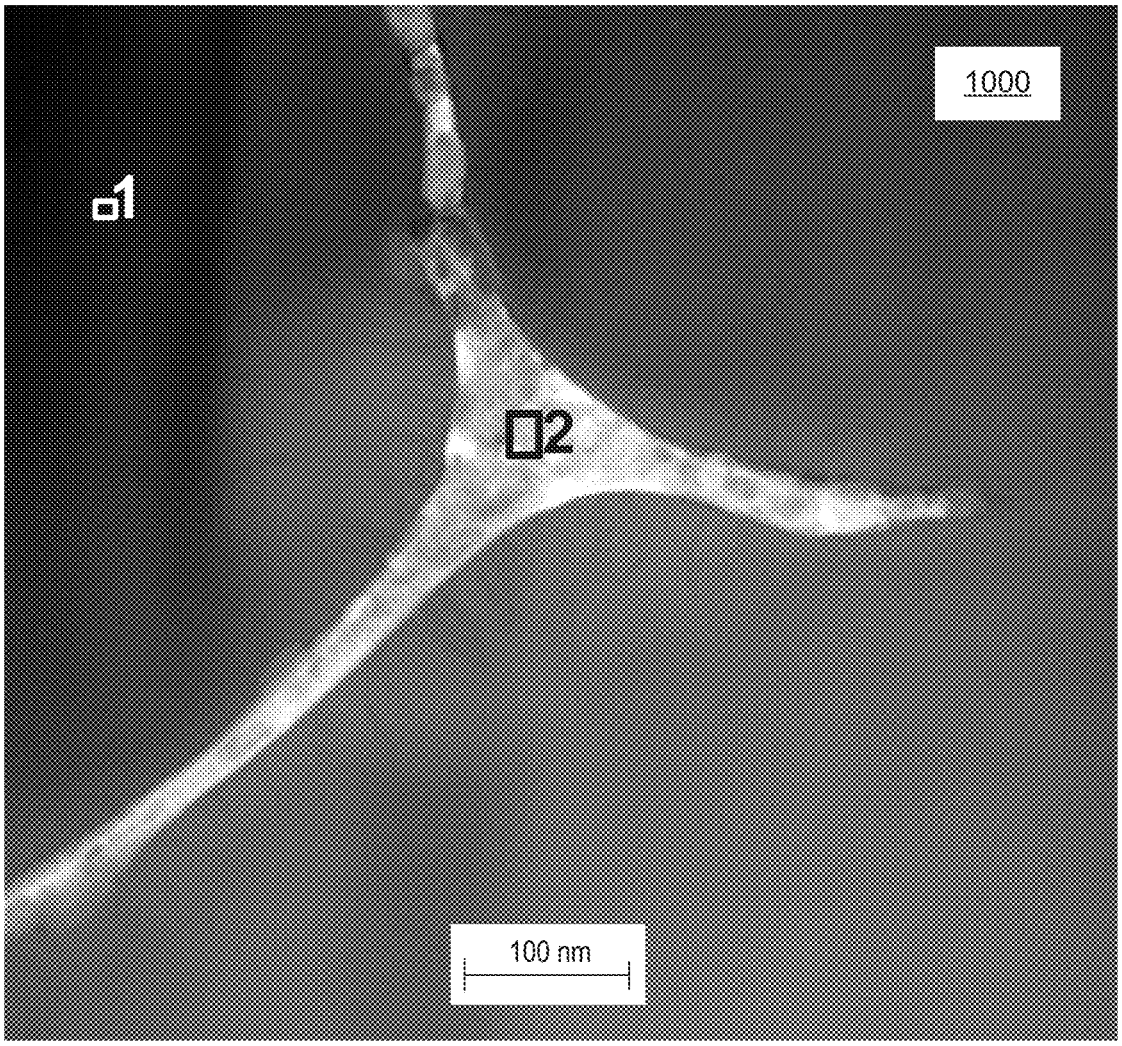
FIG. 10 illustrates an example of a micrograph of an example of a particle.

FIG. 10 shows an example of a TEM 1000 that includes a triple junction between three grains (e.g., a GBTP) in a particle of a powder. The TEM 1000 shows contrast and compositional differences between the grain boundary and the grain; noting Focus Ion Beam (FIB) sample preparation. The TEM 1000 includes two windows that correspond to samples: Sample 1 for grain material composition and Sample 2 for grain boundary material composition.

As an example, a method can include energy-dispersive X-ray (EDX) analysis of composition of a sample (e.g., Sample 1 of the TEM 1000 and Sample 2 of the TEM 1000). EDX is an analytical technique that can be applied for elemental analysis or chemical characterization of a sample. EDX involves interaction of a source of X-ray excitation (e.g., electrons) and a sample where, for example, a number and energy of X-rays emitted from the sample can be measured by an energy-dispersive spectrometer (e.g., EDS). As energy of X-rays can be characteristic of the difference in energy between two shells, and of the atomic structure of an element from which they were emitted, this allows the elemental composition of the sample to be measured.

As an example, in a particle, material at a grain boundary may be enriched in gallium when compared to material in a grain. As an example, in a particle, material at a grain boundary may be enriched in indium when compared to material in a grain. As an example, in a particle, material at a grain boundary may be enriched in gallium and indium when compared to material in a grain.

As an example, a particle may include material at a grain boundary that, upon analysis, generates gallium counts at one or more energies of less than about 2 keV and generates counts gallium counts at one or more energies greater than about 8 keV. In such an example, a ratio of counts may be about two to one. As an example, such a particle may include material at a grain boundary that, upon analysis, generates indium counts at energies from about 2 keV to about 5 keV. In such an example, such counts may be less than counts of a maximum gallium count at an energy greater than about 8 keV and less than counts of a maximum gallium count at an energy less than about 2 keV.

As an example, a powder may respond to dissolution and may be reactive (e.g., upon exposure to fluid, etc.). As an example, a powder may be consolidated, for example, to produce a relatively homogeneous solid that has a desired rate of degradation (e.g., when subjected to one or more conditions). As an example, a process such as SMAT may be applied to alter near surface properties and, for example, dissolution characteristics of a solid. As an example, a consolidated solid may exhibit a high strength and fair ductility. As an example, degradation of powder, and hence a consolidated solid made at least in part therefrom, can be controlled by blending of one or more other powders (e.g., of one or more mesh sizes, etc.).

As an example, one or more ceramic and/or other particulates may be added to a powder (e.g., or powders) to form a metal matrix composites (MMC). In such an example, such addition(s) may achieve higher stiffness or Young's modulus and, for example, abet blunting of crack tips initiated during a fracture event. As an example, one or more consolidated solids from blended powders may yield high strength and good ductility.

As an example, one or more consolidated solids, as made from one or more degradable alloy powders and/or blended powders, may respond to ageing to augment strength and one or more associated mechanical properties.

As an example, processing may alter strength, ductility or strength and ductility. The strength of a material may be defined as the material's ability to withstand an applied load without failure. Strength may characterize a material, for example, via calculations of stresses, strains, stresses and strains, etc. For example, consider predicting response of a structure under loading and its susceptibility to various failure modes, which can take into account material properties such as its yield strength, ultimate strength, Young's modulus, and Poisson's ratio. Mechanical macroscopic properties (e.g., geometric properties) such as length, width, thickness, boundary constraints, abrupt changes in geometry, etc. may be considered when determining strength of a material.

Ductility pertains to deformation under tensile stress (e.g., measurable by stretching material). Malleability pertains to deformation under compressive stress (e.g., measureable by hammering or rolling material). Ductility and malleability are mechanical properties that pertain to plasticity (e.g., extent to which a material can be plastically deformed without fracture).

An alloy can include crystalline, amorphous or mixed structure (e.g. partially crystalline, partially amorphous). Features characterizing the structure can include grains, grain boundaries, phases, inclusions, etc. As an example, one or more features may be of the order of macroscopic, micron or submicron scale, for instance nanoscale. Shape, size, shape and size, etc. may be characteristics that can influence mechanical properties and, for example, reactivity.

As an example, a reactive material may include an element that tends to form positive ions when its compounds are dissolved in a liquid solution and whose oxides form hydroxides rather than acids with water. As an example, a material may disintegrate. For example, consider an alloy that loses structural integrity and becomes dysfunctional for instance due to grain-boundary embrittlement or dissolution of one of its elements. As an example, a byproduct of degradation from grain boundaries may not necessarily include an ionic compound such as a hydroxide and may include a metallic powder residue (e.g., consider severely embrittled aluminum alloys of gallium and indium).

As an example, a material may be electrically conductive and may include a metallic luster. As an example, a material may possess a relatively high mechanical strength in tension, shear and compression (e.g., exhibit a relatively high hardness).

As an example, a material may be degradable and, for example, an alloy may be degradable (e.g., a degradable alloy). As an example, a material may degrade when subject to one or more conditions (e.g., over time). For example, consider one or more environmental conditions and/or "artificial" conditions that may be created via intervention, whether physical, chemical, electrical, etc. As an example, conditions can include temperature, pressures (e.g., including loads and forces), etc.

As an example, a component may be consolidated from a blend of particulate materials that include at least one age-hardenable particulate material. In such an example, the blend can include one or more degradable particulate materials and one or more non-degradable particulate materials. As an example, a component may be age-hardened prior to deployment, during deployment and/or after deployment.

As an example, a blend of particulate materials can include an aluminum alloy that may be an age-hardenable aluminum alloy. In such an example, the blend can include particulate material that is degradable, for example, when exposed to an aqueous environment. As an example, a component may be formed of a blend of materials where the component is age-hardenable and degradable in an aqueous environment (e.g., a downhole environment that includes water).

As an example, one or more thermal treatment processes may be applied to material to, for example, increase thermal stability, increase strength, increase stiffness, retain or improve ductility or elongation to failure, and/or promote crack arresting properties. Such a material may be an engineered high strength water reactive or degradable alloy that optionally includes a metal matrix composite (MMC). Such a material may be suitable for load bearing applications. As an example, a material may be processed at least in part through powder metallurgy (PM).

As an example, a material can include cryomilled nanocrystalline grains, which may be thermally stable. For example, a cryomilled nano and/or UFG solid may be thermally stable up to about 0.8 of an alloy's melting point.

As an example, a method can include thermal treatment of a water reactive or degradable alloy that includes a MMC, which may be consolidated into a component, for example, from a blend of cryomilled and un-milled particulate material. In such an example, the method can include solution annealing, which may act to put coarse un-milled grains into solution and promote precipitate hardening during an ageing cycle in an annealed fraction. In such an example, cryomilled nano grains may be retained from going into solution due to their enhanced thermal stability, however, growth may occur to a multimodal nano and/or UFG size abetting ductility to the blended solid.

As an example, a method can include refining grains to develop a nano to ultrafine grained microstructure. Such a method may achieve increased strength, for example, via Hall-Petch strengthening and/or may achieve increased ductility by abetting grain boundary sliding, thus possibly making a treated alloy high strain rate superplastic, resulting in better formability and working.

As an example, heat or thermal treatment can include solution annealing, for example, to put coarse grains into solution while retaining thermally stable cryomilled nano grains from going into solution. Such a process may include following a temperature thermal cycle or cycles.

As an example, heat or thermal treatment can include ageing, for example, to induce precipitate hardening of solution annealed coarse grain counterparts while promoting slight grain growth of thermally stable cryomilled nano grains, for example, to abet ductility of a solid consolidated from particulate materials. Such a process may include following a temperature thermal cycle or cycles.

As an example, thermal processing can increase strength, retain and/or improve ductility or elongation to failure, promote distinct plastic deformation after thermal treatment, abet strain hardening through dislocation strengthening, increase stiffness of a consolidated bulk solid, promotes resistance to initiation of a crack by blunting of crack tips, improve thermal stability of a consolidated bulk solid, etc.

As an example, a blend of materials can optionally include ceramic particulates and/or other particulates that can effectuate dispersion strengthening to form a MMC. For example, a method can include introduction of second phase particles (e.g., optionally oxides), which may result from the breakup of oxide layers that are formed around metal particles during a process such as a gas atomization process. As an example, a method can include introducing ceramic particulates during one or more SPD processes. As an example, a method can alter structure of material in a manner that allows for mechanical bonding of ceramic dispersoids within powder particulates, which may provide for strengthening of a solid consolidated at least in part from the powder.

As an example, a method can include increasing thermal stability of bulk alloy synthesized through application of powder metallurgy, for example, by introduction of second phase particles (e.g., that increase drag).

As an example, a method can process material to increase strength; retain and/or improve ductility or elongation to failure; promote distinct plastic deformation after thermal treatment; abet strain hardening through dislocation strengthening; increase stiffness of consolidated bulk solid processed via one or more thermal treatments; and/or resist initiation of a crack by blunting of crack tips, for example, if a crack initiation event in a matrix occurs or, for example, if a crack is nucleated at a tri-axial stress state.

As an example, a method can include processing material to provide structural support, for example, by preventing ceramic particulate or reinforcement material to be bisected by dislocation transport or de-cohesion from a matrix during plastic deformation. Such a method may impart a mechanism that acts at least in part due to mechanical bonding to powder particulate interiors during a SPD process.

As an example, a thermal treatment (e.g., one or more of solution annealing, ageing, etc.) may be applied during and/or after formation of a consolidated solid from a blend of un-milled gas atomized powder with cryomilled gas atomized (GA) powder. As an example, an un-milled GA powder can be a water reactive powder. As an example, an un-milled GA powder can be formed of a melt of a heat treatable aluminum alloy series (e.g., consider 6XXX and/or 7XXX series). As an example, a cryomilled GA powder can be water reactive powder (e.g., degradable in an aqueous environment). As an example, a cryomilled GA powder can be formed of a melt of a heat treatable aluminum alloy series (e.g., consider 6000, 7000 series). As an example, a blend can be stabilized by ceramic particulates (e.g., SiC, $B_4C$, $Al_2O_3$, etc.) to produce a metal matrix composite (MMC). In such an example, addition of ceramic particulates may be before cryomilling or, for example, during blending of un-milled and cryomilled GA powders.

As an example, a method can include blending GA powders that can have different, close or similar peak age properties and thermal cycles.

As an example, a method can include solution annealing of a bulk solid consolidated from blended cryomilled and un-milled powders. In such an example, solution annealing may aim to put un-milled component(s) (e.g., coarse grained) into solution (e.g., for a set time duration) while retaining structure of highly thermally stable cryomilled (e.g., nano grain) counterparts; noting that some grain growth may occur in nano-cryomilled grains, for example, transforming them to nano and/or ultra-fine duplex grains, which may abet additional ductility post thermal treatment.

As an example, a method can include applying a thermal treatment that develops intermetallic precipitates where dispersoids "halo" coarse particulates, for example, pinning them to provide for thermal stability, strength, improved stiffness, improved elongation to failure, strain hardening and/or distinct plastic deformation. As an example, a precipitate hardened (PH) alloy may provide a mechanism of crack blunting, for example, if a crack is initiated in a matrix while increasing stiffness. Such an approach may help to enhance potential shear failure of high strength UFG and/or nano alloy with less ductility.

As an example, a method can include ageing of a solution annealed solid, which may induce intermetallic precipitation and thereby increase thermal stability, strength, stiffness, retain or improves ductility, and/or promote crack arresting properties.

As an example, a component may include a high strength water reactive alloy processed using one or more powder metallurgy (PM) processes. In such an example, the component may experience improvement of one or more mechanical properties when deployed in a wellbore, for example, due to heat energy (e.g., in situ thermal treatment). In such an example, the component may be degradable.

As an example, a component may degrade upon exposure to water in an aqueous environment and may strengthen upon exposure to heat energy. A degradation mechanism and a strengthen mechanism may act simultaneously, sequentially, etc. As an example, strengthening may occur over a first period of time and degradation may occur over a second period of time. In such an example, an overlap may exist between the first period of time and the second period of time. As an example, a component may be utilized in an operation where strengthening and degradation mechanisms impart the component with characteristics that benefit a pre-operation phase, an operation phase and/or a post-operation phase.

As an example, a method can include blending powders and consolidating the blended powders to produce a solid. Such a solid may then undergo natural ageing when exposed to wellbore conditions, which may, for example, improve its mechanical properties over time. For example, a component may achieve a peak age condition with tailored dissolution and adequate ductility for load bearing applications.

As an example, powder metallurgy can include one or more of production of powder; compaction of powder by forming or molding; sintering of compacted powders; and machining of sintered articles.

As an example, a metal powder may be manufactured via one or more techniques, for example, depending on type of metal and alloy and desired properties. For example, a powder may be manufactured by reduction of oxides and other chemical techniques; atomization of metallic melts; pulverization of solids; electrolysis of water solutions or molten salts; etc.

As an example, dense particles of different chemical composition may be obtained by atomizing molten metal or alloys. For example, a metal stream can be atomized by process that may include one or more of atomizing in water, air, or an inert gas (e.g., argon or nitrogen).

As an example, a powder may be screened and, for example, subject to heat under a reducing atmosphere (e.g., consider surfaces of particles that are oxidized).

As an example, an atomization process may be employed to obtain one or more alloy powders, which may include an even distribution of alloying metals in the volume of each particle.

As an example, a PM alloy may circumvent segregation associated with ingot metallurgy (IM) product (casting etc.), where cooling from a molten state tends to be relatively slow, which may be detrimental to workability, etc.

In a PM process, an increased cooling rate may be employed compared to an IM process where, for example, the increased cooling rate may result in an extension of solid solubility limits that can lead to larger volume fractions of finer second-phase particles and/or formation of metastable phases.

As an example, a PM process may produce relatively homogeneous powder particles with substantial uniformity and with fine microstructure. Such characteristics may result enhanced mechanical properties.

As an example, an extension of phase fields and creation of additional phases can relate to supercooling, as achieved via one or more powder metallurgy techniques. As an example, microstructural refinement can occur in part due to reduced diffusion distances.

As an example, rapid cooling via a PM process can result in an increased tolerance to trapped elements (e.g., compared to material obtained via an IM process). For example, in a PM process, material may experience reduced segregation, especially as to sites such as grain boundaries. If a consolidated bulk alloy is made by hot isotropic pressing (HIPing) of particulate material(s), a lack of texture can result in a homogenous solid (e.g., in contrast to a highly textured IM product). As an example, a PM approach can also allow for addition of one or more powders that may have different compositions, for example, at a loose powder stage. In such an example, microstructures and mechanical properties may be tailored (e.g., before, during or after one or more processes). As an example, a nanostructured alloy produced via a PM processing route can exhibit ultra-high strength, increased modulus, etc.

As an example, a method can include blending powders from different alloys where, for example, an alloy may be age-hardenable or non-age-hardenable and/or degradable or non-degradable. As an example, an aluminum alloy may be selected from the 5000 series or from the 7000 series. As an example, a blend of powders can include particles with nanocrystalline grains. As an example, a blend of powder can include milled particles, for example, mechanically milled particles (e.g., consider cryomilling). As an example, a blend of powders can include one or more dispersoids. As an example, a blend of powders may include or may be formed to include a metal matrix composite (MMC). As an example, a blend of powders may be consolidated to form a component that can be subject to direct ageing where the component responds to direct ageing by an alteration in one or more mechanical properties. In such an example, direct ageing may be or include naturally ageing at one or more wellbore temperatures.

As an example, a method can include refining grains and developing a nano to ultrafine grained microstructure through rapid solidification into powder. In such an example, the powder may be consolidated to form a component that may exhibit, for example, increased strength (e.g., via Hall-Petch strengthening); and/or increased ductility (e.g., by abetting grain boundary sliding, thus possibly making a treated alloy high strain rate superplastic, resulting in better formability and working); increased thermal stability (e.g., forming the component via a powder metallurgy route, optionally introducing second phase particles (e.g., for drag)).

As an example, a method can include tailoring dissolution of a component. For example, such a method may include consolidating blended powders of one or more non-degradable alloys with one or more degradable powders.

As an example, a method can include producing a high strength water reactive alloy via one or more PM processes. In such an example, the alloy may be formed into a component. As an example, such a component may be deployed into an environment where, for example, improvement of mechanical properties occurs for at least a period of time in the environment. For example, the component may strengthen, harden, etc., when deployed in a wellbore due in part to natural ageing in wellbore conditions and the component may degrade when exposed to certain wellbore conditions.

As an example, a method can include blending of water reactive or degradable powder with one or more other powders where the water reactive or degradable powder is in a range of about 5 percent to about 95 percent of the weight of a blend. In such an example, a powder may be an age-hardenable non-degradable powders (e.g., consider aluminum 6000 and 7000 series); may be a strain hardenable non-degradable powders (e.g., consider aluminum 5000 series, etc.); may be a powder that includes highly thermally stable nanocrystalline grains processed by cryomilling; may be a powder that includes highly thermally stable nanocrystalline grains processed by cryomilling that are further stabilized by dispersoids (e.g., SiC, $B_4C$, $Al_2O_3$, etc.), for example, to produce a metal matrix composite (MMC); etc.

As an example, a method can include direct ageing of a solid formed by consolidating a blend of powders or a processed blend of powders to improve mechanical properties of the solid at one or more wellbore temperatures.

As an example, a method can include partial solution annealing of a solid formed at least in part via consolidation of a blend of powders. In such an example, a duration may be selected for solution annealing that aims to put coarse grained alloying particulates into solution while retaining a substantial amount of highly thermally stable particulates with nanocrystalline grains; noting that some grain growth may be expected for nanocrystalline grains. Such a method may optionally include deploying the consolidated solid (e.g., as a component) and subsequent ageing of the consolidated solid (e.g., as a component) at wellbore conditions and/or naturally when deployed in a wellbore. In such an example, the solid may undergo precipitate hardening as a response.

As an example, a method may produce a component at least in part via consolidation of a blend of powders where the component exhibits one or more of increased strength and ductility; a tailored dissolution rate; inter-granular corrosion and cracking as degradation mechanism; galvanic coupling between dissimilar powders to promote degradation; increase thermal stability; and continuous improvement of mechanical properties when deployed in a wellbore (e.g., due to thermal effects).

As an example, a method can include blending of water reactive or degradable powder with one or more age-hardenable non-degradable powders (e.g., consider 6000 and 7000 series aluminum alloys) to produce a high strength water reactive alloy through one or more PM processes. In such an example, a component formed by the produced alloy may exhibit continuous improvement of mechanical properties when deployed in a wellbore, for example, by allowing the produced alloy to naturally age in wellbore conditions.

As an example, a water reactive alloy and an age hardenable alloy (e.g., consider a 7000 series aluminum alloy such as 7075) may be age-hardenable and may reach peak age conditions when heat treated at a set temperature for a given time duration.

As an example, a blend may include a blend ratio of between about 0.05 to about 0.95 of degradable material to and age-hardenable material. In such an example, a component formed from the blend may be direct age-hardenable at one or more wellbore temperatures, which may augment mechanical properties. In such an example, augmented mechanical properties may exist for a particular duration of time and be beneficial to performance of the component in a wellbore; thereafter, a degradation mechanism may degrade the component.

As an example, a method can include blending of water reactive or degradable powder with one or more strain hardenable non-degradable powders where the water reactive or degradable powder is in a range of about 5 percent to about 95 percent of the weight of a blend. In such an example, a strain hardenable non-degradable powder may include an aluminum alloy (e.g., consider a 5000 series alloy, etc.). In such an example, a resulting blend may be processed to form a component. For example, consider a component made of a high strength water reactive alloy through one or more PM processes where the component may be deployed in an environment that promotes ageing. As an example, consider such a component undergoing continuous improvement of mechanical properties for a period of time when deployed in a wellbore (e.g., naturally ageing under wellbore conditions).

As an example, a component may include a water reactive alloy that is age-hardenable and a strain hardenable alloy. In such an example, when heat treated at a set temperature (e.g., a wellbore temperature) for a given time duration, the strain hardenable alloy may provide for work hardening under strain beyond its yield to allow the component to perform under desired conditions.

As an example, a blend may include a blend ratio of between about 0.05 to about 0.95 of degradable and age-hardenable material and one or more other materials, a direct age hardenable response at wellbore temperatures can be achieved to augment the mechanical properties, further supported by strain hardening of the one or more other materials.

As an example, a method can include blending of water reactive or degradable powder with material that includes highly thermally stable nanocrystalline grains processed by cryomilling. In such an example, a blend may include a blend ratio of between about 0.05 to about 0.95 (e.g., water reactive or degradable powder to other material). In such an example, a component formed using the blend may exhibit improvement of mechanical properties when deployed in a wellbore, for example, where naturally ageing occurs under wellbore conditions.

As an example, in a component, one or more coarse grained polycrystalline heat treatable material can age-harden when heat treated at a set temperature that may be a targeted (e.g., predicted or expected) wellbore temperature (e.g., for a given time duration). In such an example, thermally stable UFG and/or nano grains can provide for Hall-Petch strengthening. As an example, a multimodal microstructure can promote grain boundary sliding and dislocation arrest, which may, for example, result in strengthening (e.g., at UFG and/or nano grain interfaces). Such strengthening may result in better ductility of component.

As an example, a method can include blending water reactive or degradable powder with material that includes highly thermally stable nanocrystalline grains processed by cryomilling and optionally further blending dispersoids (e.g., SiC, $B_4C$, $Al_2O_3$, etc.), which may produce a metal matrix composite (MMC).

As an example, a MMC may include a mechanism of crack blunting, for example, if a crack is initiated in the matrix, such a mechanism may act to blunt the crack (e.g., tip of the crack). Such a mechanism may help to enhance potential shear failure of a high strength UFG and/or nano alloy with less ductility.

As an example, a method can include producing a high strength water reactive alloy through one or more PM processes where improvement of its mechanical properties may occur when deployed in a wellbore, for example, by allowing a component formed of the alloy to be partially solution annealed for a short duration to put coarse grains into solution while retaining highly thermally stable nanocrystalline grains; noting that some grain growth of the nanocrystalline grains may be expected. As an example, a method can include ageing of a partially solution annealed component, for example, to yield higher strength than as a consolidated alloy or direct aged alloy.

FIG. 11 shows an example plot 1100 of component dimension versus time of degradation for various temperatures and an example of an assembly 1110 that includes components that may be made by consolidating particulate materials. As indicated, degradation of a component may be determined by a physical characteristic of the component and an environmental condition such as, for example, temperature. For example, fluid at a temperature of about 120 degrees C. may cause a component to degrade more rapidly than fluid at a temperature of about 66 degrees C. As an example, a component may be constructed to include one or more layers where at least one layer includes a degradable material, which may include a dimension (e.g., thickness, etc.) that is based at least in part on information such as the information of the plot 1100 of FIG. 11.

As an example, the assembly 1110 may include one component that degrades at a rate that differs from another component. For example, a plug 1112 (e.g., a ball, etc.) may degrade more rapidly than a plug seat 1114 (e.g., a ring that can include a plug seat and that may act to locate the plug seat). As shown in FIG. 11, the assembly 1110 can include a plurality of pieces where such pieces may be formed according to desired dissolution rate, strength and/or ductility.

Figure 12:
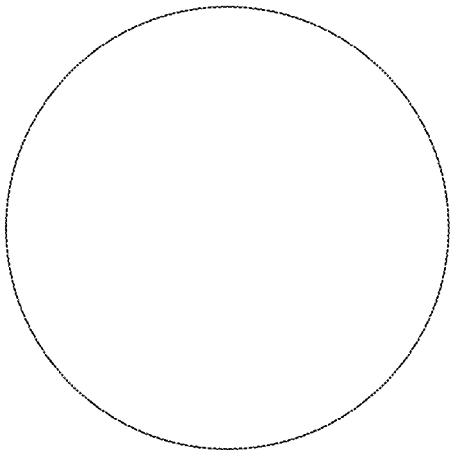
FIG. 12 illustrates an example of a particle.
Figure 12:
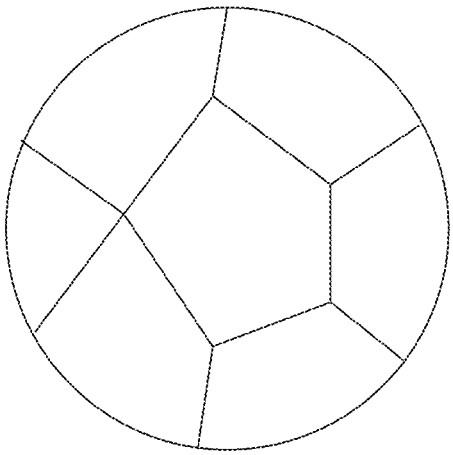
Figure 12:
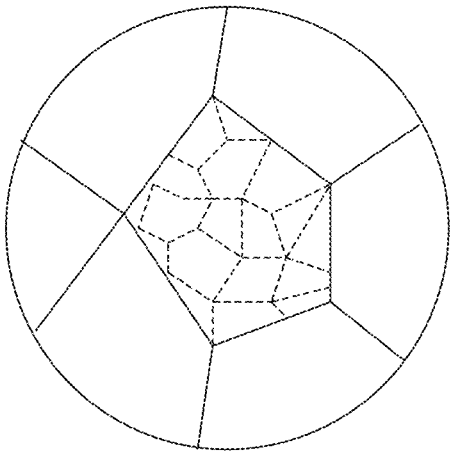

Referring again to the example SPD processes 510 of FIG. 5, consider a simplified model of a particle as shown in FIG. 12, which includes a particle 1210, boundaries 1220 and subboundaries 1230. The particle 1210 may be considered to be a particle that is polycrystalline. As an example, within individual grains with boundaries 1220, dislocation boundaries can exist, which may be referred to as subboundaries 1230.

Figure 13:
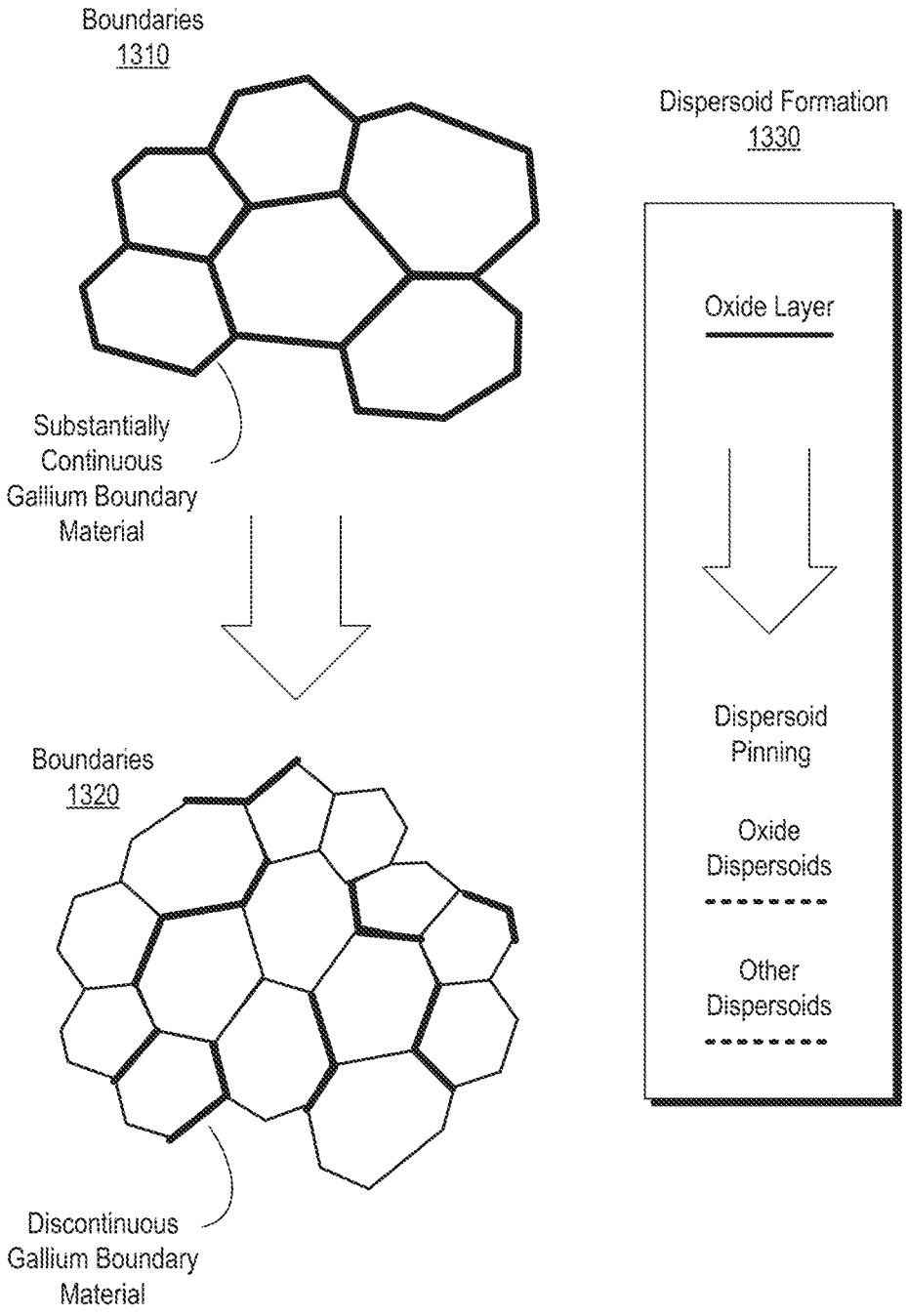
FIG. 13 illustrates examples of substantially continuous boundary material, discontinuous boundary material and dispersoid formation.

FIG. 13 shows an example of grain refinement where boundaries are disrupted as grain refinement occurs. As shown, boundaries 1310, which may be substantially continuous as to gallium boundary material, become boundaries 1320, which are discontinuous as to gallium boundary material (e.g., where thicker lines represent gallium boundary material). Thus, the degradability of the material is affected due to introduction of discontinuities in the gallium boundary material that, in turn, affect galvanic coupling. Thus, refinement in grain size can be accompanied by generation of discontinuities in boundary material.

FIG. 13 also shows an example of dispersoid formation 1330. For example, an oxide layer on an alloy may be disrupted via an SPD process to form oxide dispersoids. As an example, an SPD process may be performed in an environment and/or with equipment (e.g., components, etc.) that cause formation of one or more types of dispersoids. As explained, dispersoids can act to pin grain boundaries.

Figure 14:
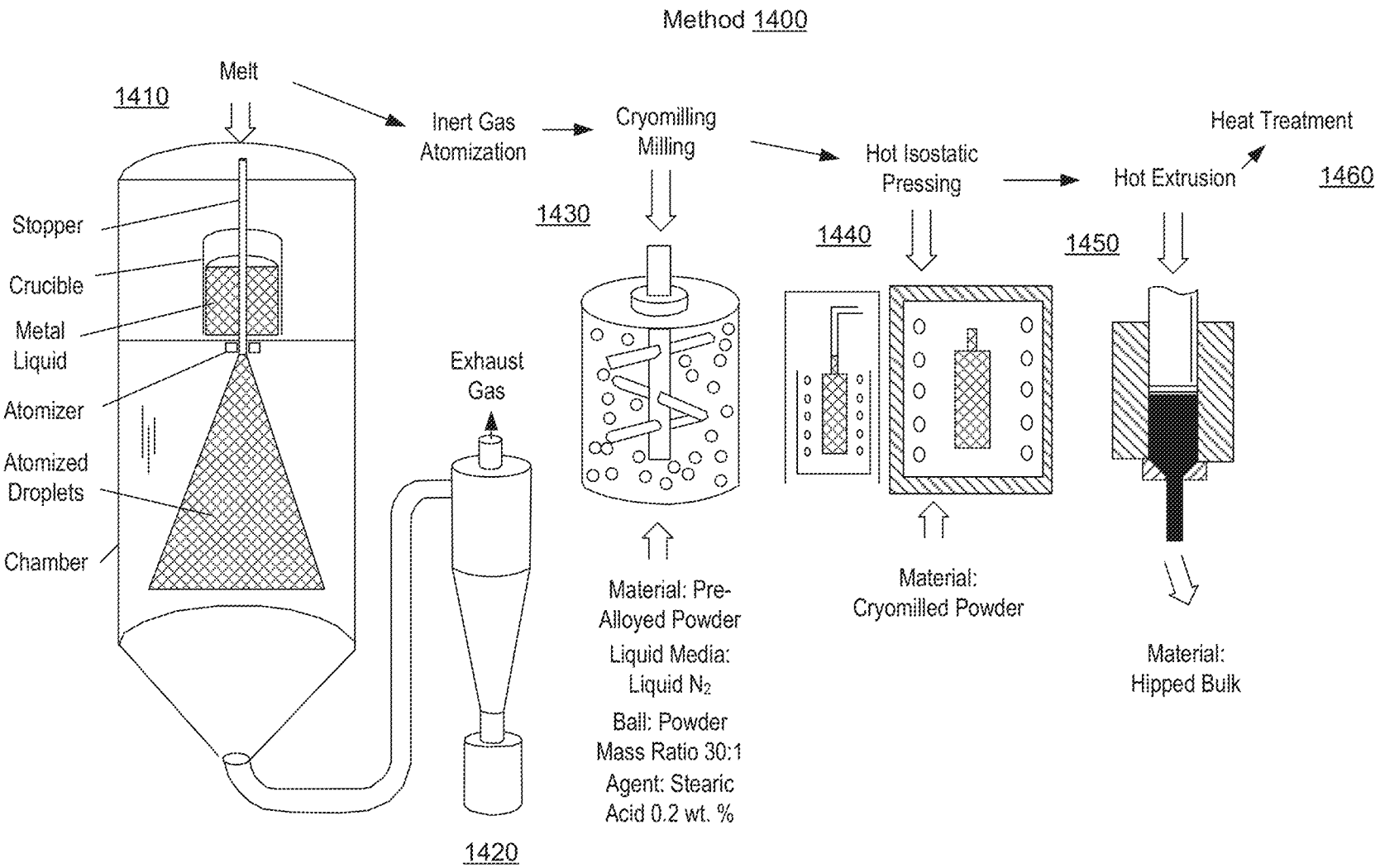
FIG. 14 illustrates an example of a method.

FIG. 14 shows an example of a method 1400 that includes atomizing material 1410 in an inert gas atomization system with, for example, a cyclone separator for separating atomized particles and gas 1420. In the method 1400, powder, as atomized and separated, may be subjected to cryomilling 1430, for example, in liquid nitrogen. In such an example, a powder mass ratio of about 30:1 may be used and an agent such as stearic acid (e.g., at about 0.2 weight percent) may be introduced. As shown in FIG. 14, the method 1400 can include hot isostatic pressing (HIPing) 1440 of the cryomilled powder. The example method 1400 can include hot extruding 1450 of the hot isostatic pressed (HIPed) cryomilled powder, for example, to produce hipped bulk material that may then be subjected to, for example, heat treating 1460.

As an example, a material that includes aluminum and one or more elements that impart degradability may be spray-atomized. The resulting spray-atomized powder may have a particle size less than about 150 microns, which may be mechanically milled in liquid nitrogen (e.g., cryomilling), for example, to reduce the micron-sized grains in the atomized powder to nanocrystalline size. The nanograined cryomilled particulates may be subsequently hot isostatic pressed (HIPed or hipped) and extruded at a temperature of about 473 K to produce a bulk ultra-fine grain (UFG) material.

As an example, a process may introduce dispersoids that act to inhibited grain growth and/or to pin grains. For example, a method that includes gas atomizing and/or cryomilling may introduce one or more types of dispersoids. The presence of such dispersoids can contribute to UFG stability in consolidated nanocrystalline materials.

As an example, a method may include processing a material below its incipient melting temperature. For example, consider an alloy with an incipient melting temperature of about 340 degrees C. Such a material may be processed at a lesser temperature where such processing introduces severe plastic deformation (SPD).

As mentioned, a material may be formed of a plurality of alloys. For example, consider the data of Table 2 below, which indicates application of severe plastic deformation for materials that include one or more of 5083 Al and 7075 Al. In such an example, the resulting properties indicate that a method can include tailoring, for example, to meet one or more desired properties of at least a portion of component. For example, consider the 25/75, 50/50 and 75/25 examples of 5083/7075, which provide for different ultimate tensile strengths (UTS), as presented in units ksi. Table 2 also shows data for percent elongation (% e), which may be considered a measure of ductility. Accordingly, as shown in Table 2, severe plastic deformation may be applied to a mixture of alloys to tailor strength and/or ductility.

TABLE 2

Tailored Material Properties

| 5083 Al % | SPD | AR | 7075 Al % | SPD | AR | UTS ksi | % e |
|---|---|---|---|---|---|---|---|
| 100 | | x | | | | 47.4 | 20 |
| 100 | x | | | | | 96 | 10 |
| 100 | | | | | x | 56.5 | 23 |
| 100 | | | | x | | 77 | 7 |
| 25 | x | | 75 | | x | 58 | 9.3 |
| 50 | x | | 50 | | x | 61.2 | 7.2 |
| 75 | x | | 25 | | x | 68 | 9.3 |

Figure 15:
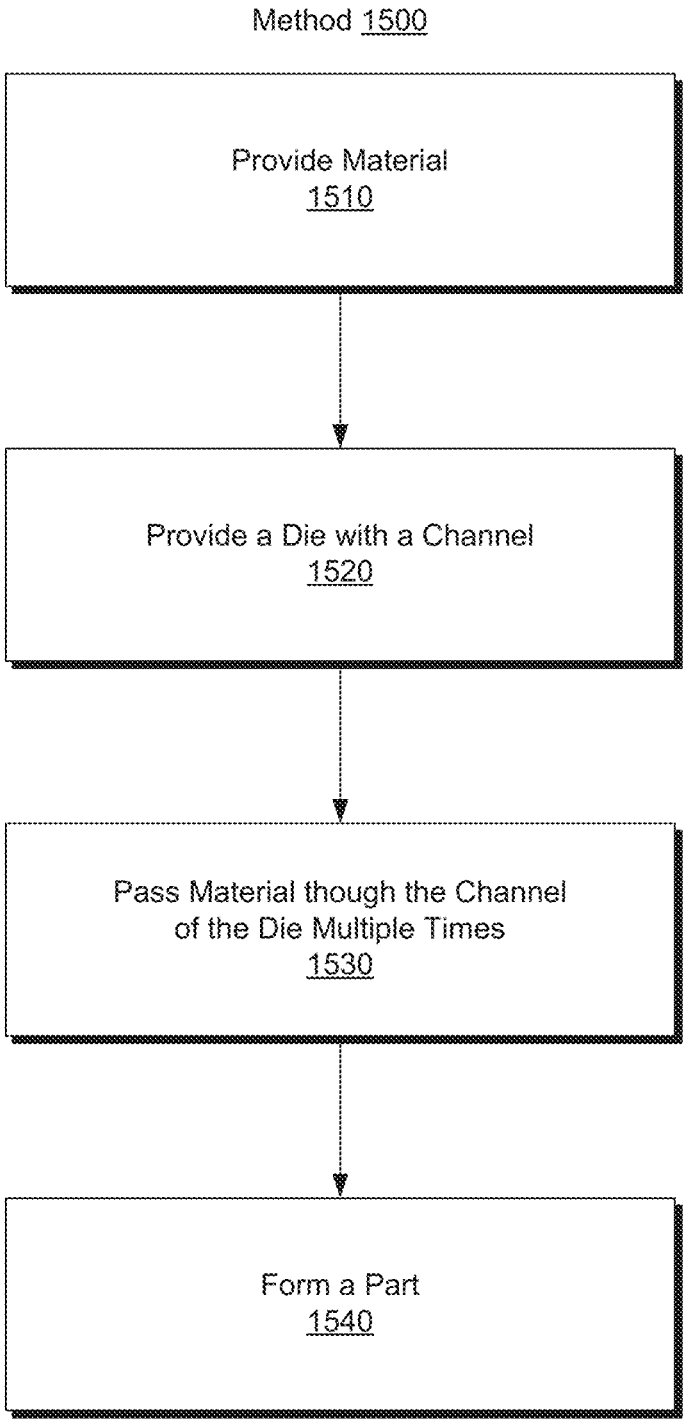
FIG. 15 illustrates an example of a method.

As to a SPD process such as ECAP, FIG. 15 shows an example of a method 1500 that includes a provision block 1510 for providing material, a provision block 1520 for providing a die that includes a channel, a passage block 1530 for passing the material through the channel of the die multiple times, and a formation block 1540 for forming a part.

Figure 16:
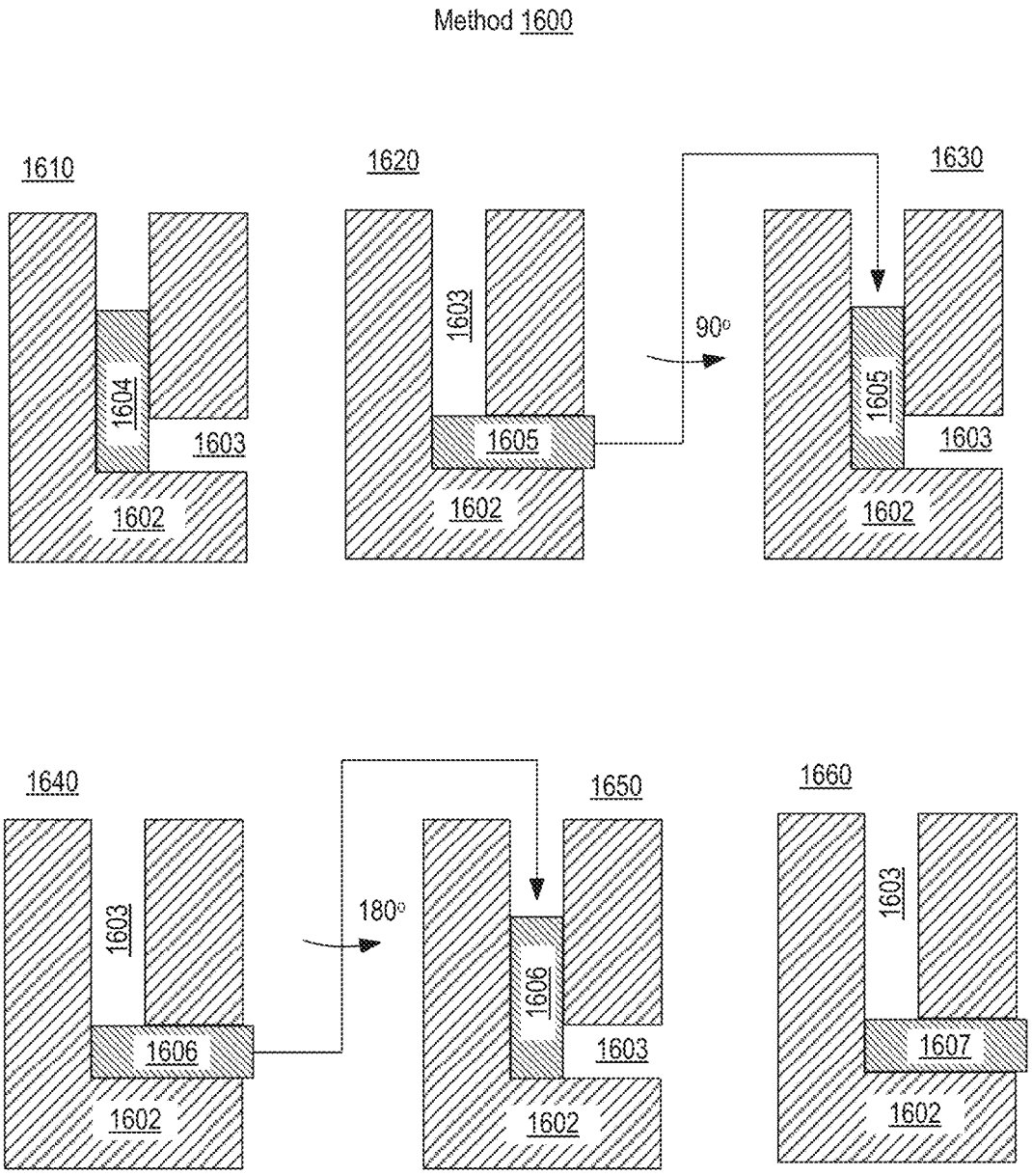
FIG. 16 illustrates an example of a method.

FIG. 16 shows an example of a method 1600 that includes ECAP. As shown, a die 1602 with a channel 1603 is provided along with material 1604. In an introduction block 1610, the material 1604 is introduced to the channel 1603 of the die 1602. In a first pass block 1620, the material 1604 is passed through the channel 1603 of the die 1602 to expose the material 1604 to deformation to produce deformed material 1605. In another introduction block 1630, the material 1605 is rotated about a longitudinal axis (e.g., about 90 degrees) and introduced to the channel 1603. In a second pass block 1640, the material 1605 is passed through the channel 1603 of the die 1602 to expose the material 1605 to deformation to produce deformed material 1606. In another introduction block 1650, the material 1606 is rotated about a longitudinal axis (e.g., about another 90 degrees for a total of 180 degrees from the introduction block 1610) and introduced to the channel 1603. In a third pass block 1660, the material 1606 is passed through the channel 1603 of the die 1602 to expose the material 1606 to deformation to produce deformed material 1607.

As an example, the material 1604 may be stock material, for example, a bar, a rod, etc. In the example method 1600, the resulting material 1605, 1606 or 1607 may be processed material, for example, as a processed bar or a processed rod. As an example, the processed material may be machined. As an example, the processed material may be machined to form a part. As an example, a part may be a ball, a plug, a plug tool, a portion of a tool, etc.

Figure 17:
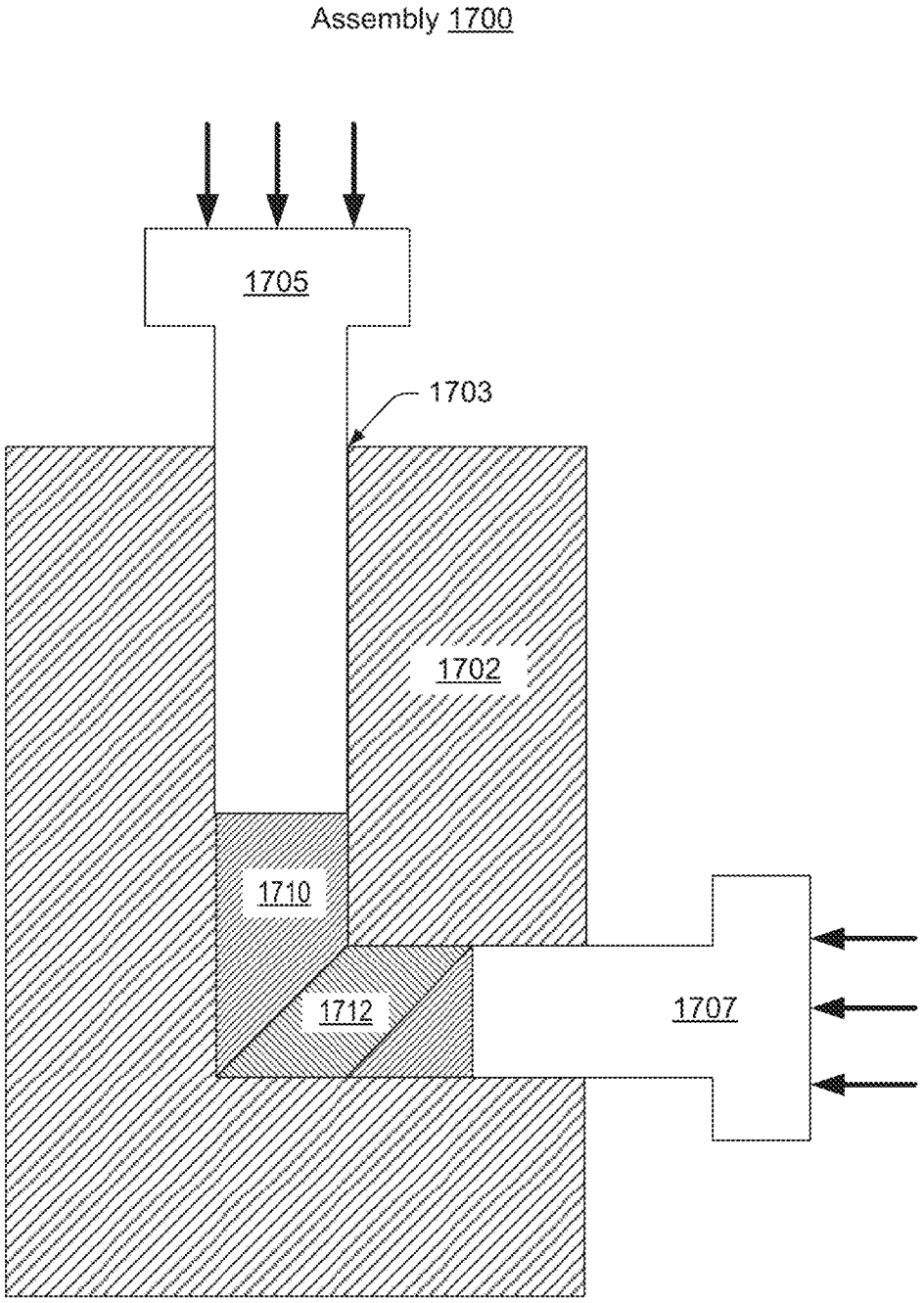
FIG. 17 illustrates an example of an assembly.

FIG. 17 shows an example of an assembly 1700 that includes a die 1702 that includes a channel 1703, a forward punch 1705 and a backward punch 1707. As shown powder 1710 can be introduced to the channel 1703 where the powder 1710 may be passed through the channel 1703 to deform the powder to form deformed powder 1712.

As an example, the channel 1703 may include an entry portion and an exit portion where the forward punch 1705 is received at least in part by the entry portion of the channel 1703 and where the backward punch 1707 is received at least in part by the exit portion of the channel 1703. As an example, a method can include controlling at least one of a force applied to a forward punch and force applied to a backward punch.

Figure 18:
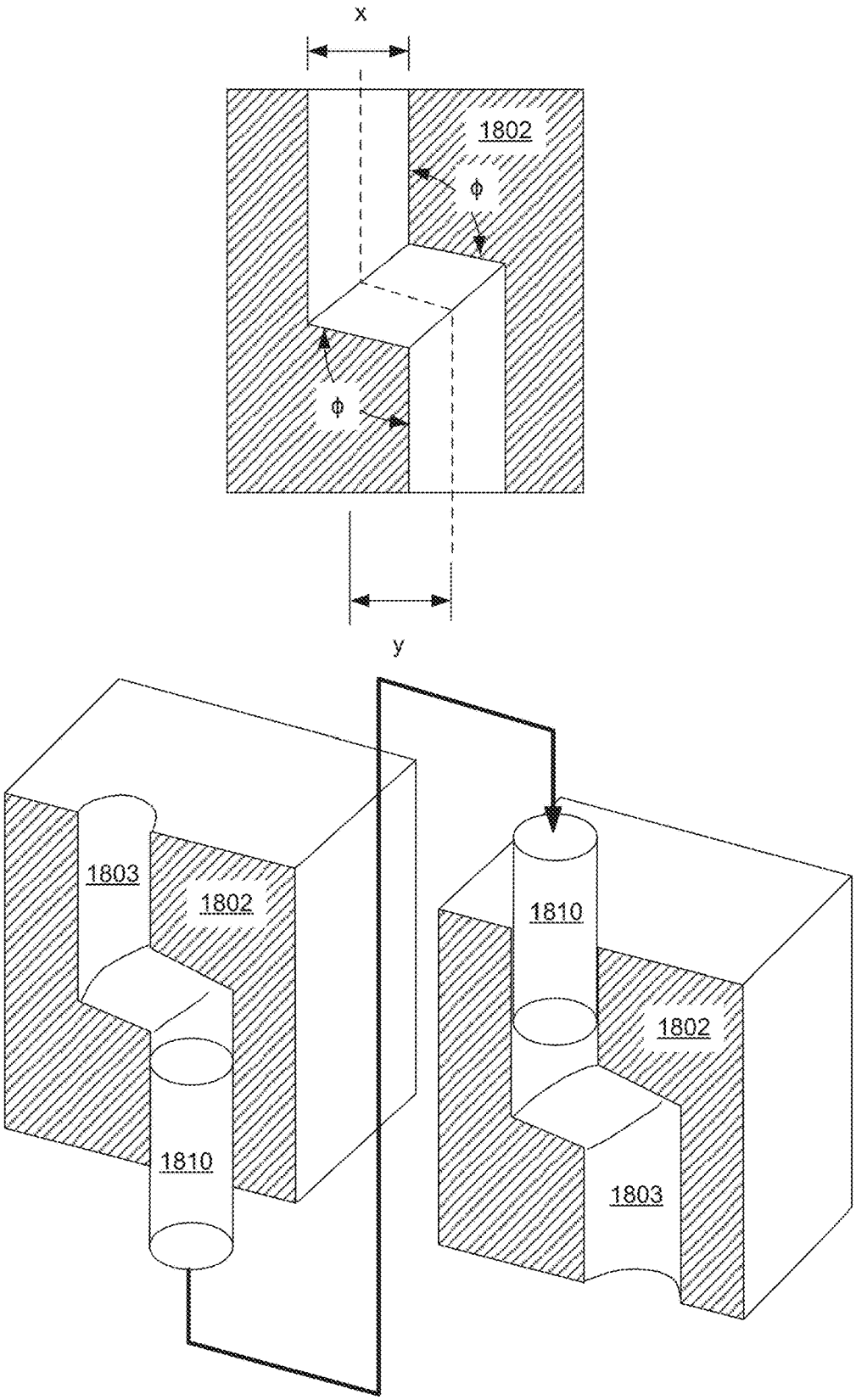
FIG. 18 illustrates an example of equipment.

FIG. 18 shows an example of a die 1802 that includes a channel 1803. As shown, the die 1802 includes various dimensions including an x dimension and a y dimension, as well as an angle $\phi$. As shown, a workpiece 1810 may be passed through the channel 1803. In the example of FIG. 18, the channel diameter per the dimension x is equal to the horizontal displacement between the two center lines of the channels, per the dimension y.

Figure 19:
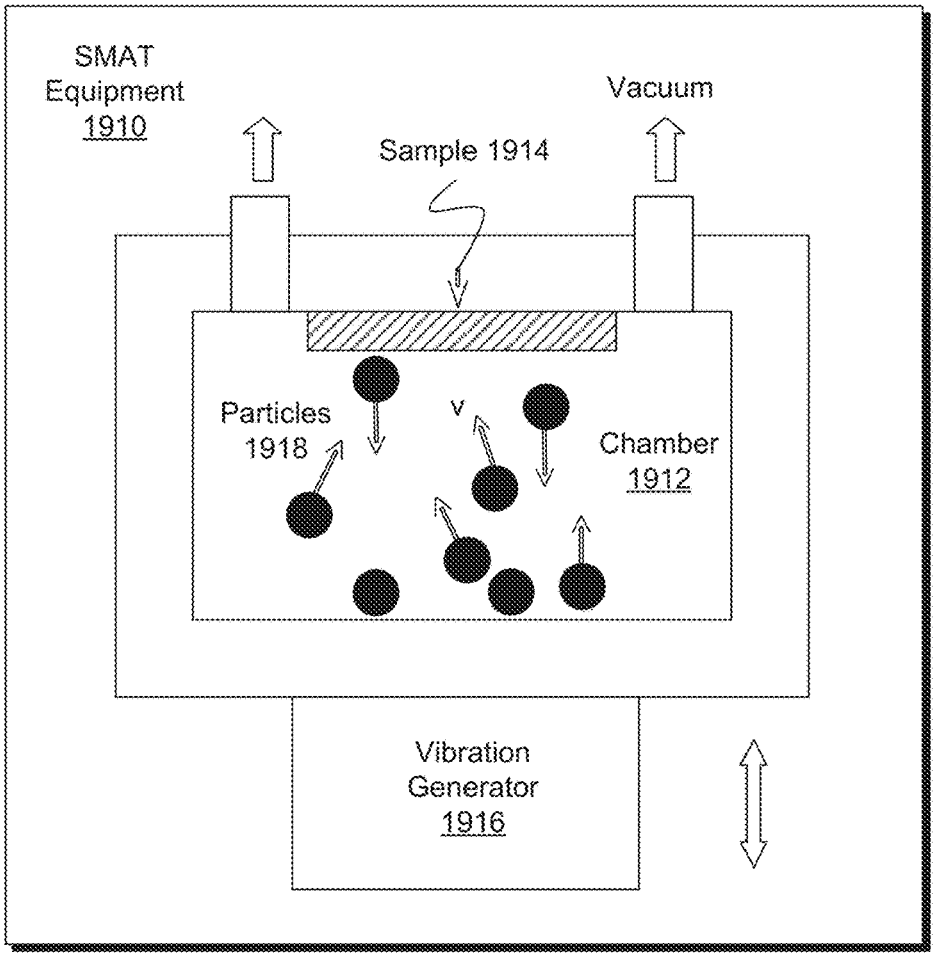
FIG. 19 illustrates an example of equipment and an example of a surface mechanical attrition treatment process.
Figure 19:
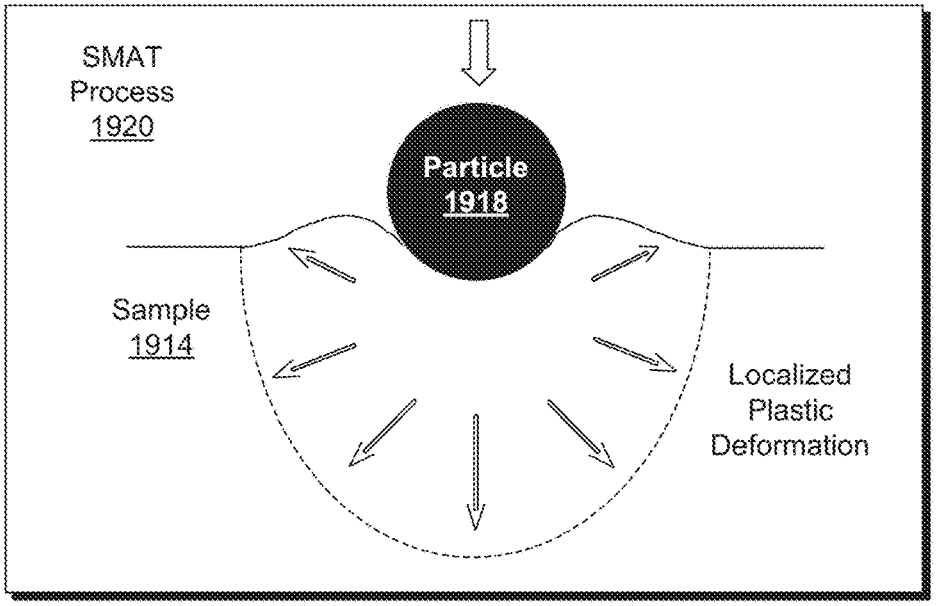

FIG. 19 shows an example of SMAT equipment 1910, which includes a chamber 1912 for a sample 1914 and a vibration generator 1916 that can vibrate particles 1918 that can impact the sample 1914. FIG. 19 also shows a simplified schematic illustration of a SMAT process 1920 where one of the particles 1918 impacts the sample 1914 to cause localized plastic deformation.

As an example, SMAT equipment may include an ultrasonic horn with an ultrasonic (e.g., consider a frequency of about 20 kHz or more, etc.) transducer. Such equipment may be provided with balls and a mount or mounts for one or more workpieces. During operation, the ultrasonic energy can drive the balls to cause collisions between the balls and the surface(s) of the one or more workpieces. SMAT may be considered to be a regionally selective process. Other regionally selective processes can include, for example, shot or hammer peening; noting that kinetic energy of balls in SMAT may exceed that of shot peening.

Figure 20:
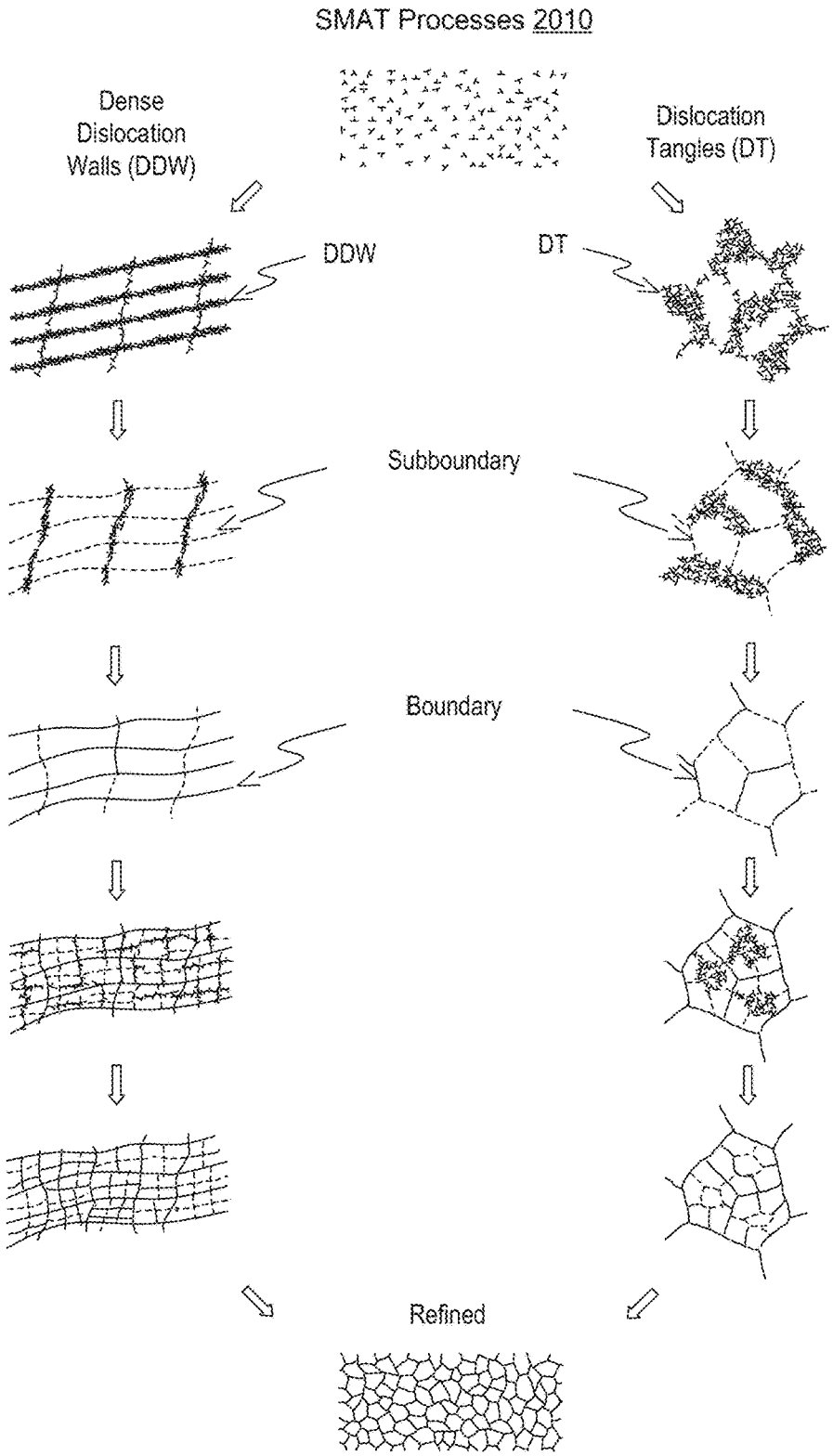
FIG. 20 illustrates examples of surface mechanical attrition treatment processes.

FIG. 20 shows an example of a simplified schematic illustration of grain refinement for an SMAT process. In such a process, strain decreases spatially from a maximum at a surface of a workpiece to zero at some distance within the workpiece. As an example, grain refinement in an SMAT process can include development of dense dislocation walls (DDWs) and dislocation tangles (DTs) where plastic deformation is accommodated by dislocation slip. In such an example, to accommodate dislocation slip, one or more dislocation activities may occur (e.g., generation, accumulation, annihilation, rearrangement, etc.). As an example, strain-induced numerous dislocations may form DDWs along slip planes and DTs in coarse grains, for example, depending on grain orientations. Repeated multi-directional impacts by balls on a surface of a workpiece may lead to a change of slip systems. As an example, during SMAT, coarse grains may be divided by DDWs and DTs where DDWs and DTs may be transformed into subboundaries with misorientations. As strain increases, misorientations may increase, becoming highly-misoriented, and further DDWs and DTs may form inside the inner of refined subgrains or grains, with subsequent subdivision to a generate finer scale structures. As an example, a stabilized structure size (e.g., a lower limit) may be obtained for SMAT when dislocation multiplication rate is balanced by annihilation rate.

As an example, a method can include employing SMAT to form a structural gradient within a material, which may be a stock material (e.g., a billet, etc.) and/or a component. In such an example, a near surface layer of the material may be of a finer structural size than a core of the material. As an example, a near surface layer may be nanostructured at least in part via an SMAT process.

As an example, a method may employ an SMAT process that includes bombarding one or more surfaces of material with particles where a driver or drivers operate at frequencies of between about 50 Hz and about 25 kHz to propel the particles. In such an example, a suitable particle size may be selected, for example, to control kinetic energy per impact. As an example, consider particle sizes in a range from the order of nanometers to about tens of millimeters. As an example, density and size (e.g., mass) and optionally shape of particles may be selected to alter impact on a material surface, which can affect depth of a compressive layer (e.g., a nanostructured layer). As an example, particles made of, for example, ceramic, steel and chromium, etc., may be employed.

As an example, during an SMAT process, a material may be in a gas environment and/or in a substantial vacuum. As to a gas environment, a gas may include an element that may form a passivation layer with one or more elements of the material. For example, consider oxygen forming an aluminum oxide. As an example, oxides may exist on the surface of a material or within a material where an SMAT process may interact with such oxides.

As an example, an SMAT process may include one or more of a heater, an insulator and a cooler. As an example, an SMAT process may include a temperature controller that can control one or more temperatures (e.g., chamber, workpiece, etc.). As an example, an SMAT process may be implemented in a cryogenic environment (e.g., consider a cryogenically cooled chamber).

As an example, SMAT equipment may include one or more mechanisms for suspending material, moving material (e.g., translating and/or rotating), introducing material, removing material, etc. As an example, where material has a shape with an "inside" surface (e.g., consider a tube, etc.), SMAT equipment may be configured to bombard the inside surface with particles and, for example, optionally be configured to bombard another surface of the material with particles (e.g., optionally particles of different characteristics, different velocities, different angles of flight, etc.). As an example, SMAT equipment may be configured to bombard an interior surface of a workpiece and/or an exterior surface of a workpiece.

As an example, a SMAT process may be employed to alter near surface properties of a material. In such an example, a depth of an SMAT altered layer may be of the order of up to several millimeters. As an example, a SMAT process may be employed to harden a layer of a component, which may, for example, increase durability of the component. In such an example, consider a degradable component that may include a seat that seats another component where SMAT processing acts to increase the durability of the seat of the degradable component without substantially affecting degradability characteristics of the component.

Figure 21:
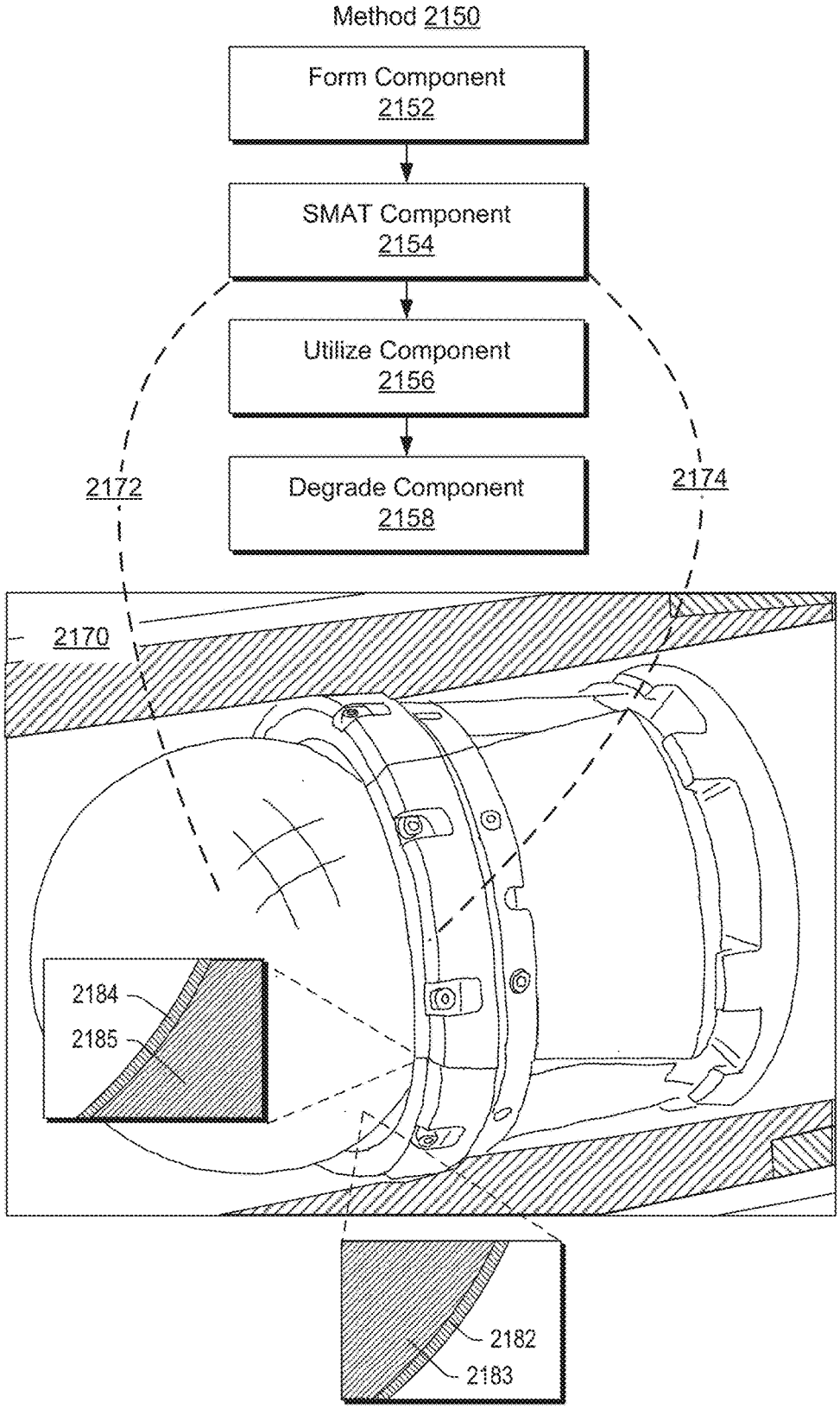
FIG. 21 illustrates an example of a method and an example of equipment.

FIG. 21 shows an example of a method 2150 and an example of an assembly 2170 that includes a plug 2172 and a seat 2174. The method 2150 includes a formation block 2152 for forming a component, a SMAT block 2154 for subjecting the formed component to SMAT processing to produce an SMAT processed component, a utilization block 2156 for utilizing the SMAT processed component and a degradation block 2158 for degrading the SMAT processed component.

As shown, the assembly 2170 includes cooperating parts or pieces such as the plug 2172 and the seat 2174. In such an example, at least one of the plug 2172 and the seat 2174 may be an SMAT processed component, for example, per the SMAT block 2154 of the method 2150. As an example, an SMAT processed degradable component may include a near surface layer that degrades at a slower rate than a more interior layer (e.g., an adjacent layer). In such an example, SMAT processing of the degradable component may act to harden the near surface layer and thereby enhance its durability. For example, the seat 2174 may be made more durable via SMAT processing such that less wear occurs when the plug 2172 contacts the seat 2174. Using a process such as SMAT, an increase in durability of the seat 2174 can be achieved without substantially altering the degradability of seat 2174.

FIG. 21 also shows two enlarged cross-sectional views of a portion of the plug 2172 and a portion of the seat 2174. As shown in these schematic views, the plug 2172 can include multiple regions including a near surface region 2182 and an adjacent region 2183 where the near surface region 2182 may differ from the region 2183 in terms of structure size and the plug 2172 can include multiple regions including a near surface region 2184 and an adjacent region 2185 where the near surface region 2184 may differ from the region 2185 in terms of structure size. For example, the near surface regions 2182 and 2184 may be finer grained due to being subjected to one or more SMAT processes. In such an example, the near surface regions 2182 and 2184 may be of greater hardness than their respective adjacent regions 2183 and 2185.

As an example, SMAT equipment may process a seat in a directional manner such that a seating surface is bombarded while one or more other surfaces remain unaffected. In such an example, the seating surface may be more durable than the one or more other surfaces and the degradation characteristics of the seat may remain substantially unaffected by the SMAT processing (e.g., the one or more unaffected surfaces retain their degradation characteristics).

As an example, a plug may be processed using SMAT equipment. For example, a dart plug may be directional with a head and vanes. In such an example, a portion of the head may be subject SMAT to increase its hardness within a near surface layer. For example, a front facing portion (e.g., a lead portion) may be subjected to bombardment via an SMAT process.

As an example, a plug may be processed using SMAT equipment, for example, to subject an entire exterior surface of the plug to bombardment. In such an example, a near surface layer of the plug (e.g., a ball, etc.) may be hardened and, for example, the degradation characteristics of the near surface layer may be altered (e.g., compared to an adjacent interior layer). Such alteration of degradation characteristics may act, for example, to slow down dissolution rate of the near surface layer. However, once the near surface layer has dissolved, the dissolution rate may, for example, increase (e.g., per characteristics of the adjacent interior layer when it becomes exposed).

As an example, a degradable component can include a near surface layer with a hardness that is greater than an adjacent interior layer. In such an example, the near surface layer may be of a thickness of approximately 5 mm or less, optionally in a range from about 0.5 mm to about 3 mm. As an example, a near surface layer may span an entire degradable component or may span a portion (e.g., a region) of a degradable component.

Referring again to the method 2150 of FIG. 21, the formation block 2152 may optionally include one or more SPD processes. For example, a component may be formed at least in part via ECAP. In such an example, one or more surfaces of material processed via ECAP may be subjected to an SMAT process (e.g., or SMAT processes).

As an example, material may be processed via ECAP followed, directly or indirectly, by SMAT. In such an example, grain refinement may occur via ECAP and further grain refinement may occur in a near surface layer of the material via SMAT.

As an example, a method can include adding scandium, thallium or other element(s) to material that includes aluminum. In such an example, the mixture may be subjected to one or more SPD processes. As an example, scandium may be added to a powder material that includes aluminum to form a mixture that can then be subjected to ECAP. In such an example, the number of ECAP passes may optionally be reduced with scandium versus without scandium. As an example, scandium may enhance grain refinement of material and, for example, allow for formation of finer grains when compared to such material without scandium.

As an example, where a bulk material includes dispersoids, a process such as SMAT may be applied to alter a near surface layer of the bulk material. In such an example, structures in the near surface layer may be refined, including breaking of dispersoids into finer structures.

As an example, material may be processed via one or more SPD processes to alter creep of a component formed at least in part from such material. For example, SPD processing may result in a harder component that exhibits less creep when subject to loading during utilization of the component. In such an example, consider a component such as, for example, a plug, a seat for a plug, etc.

Figure 22:
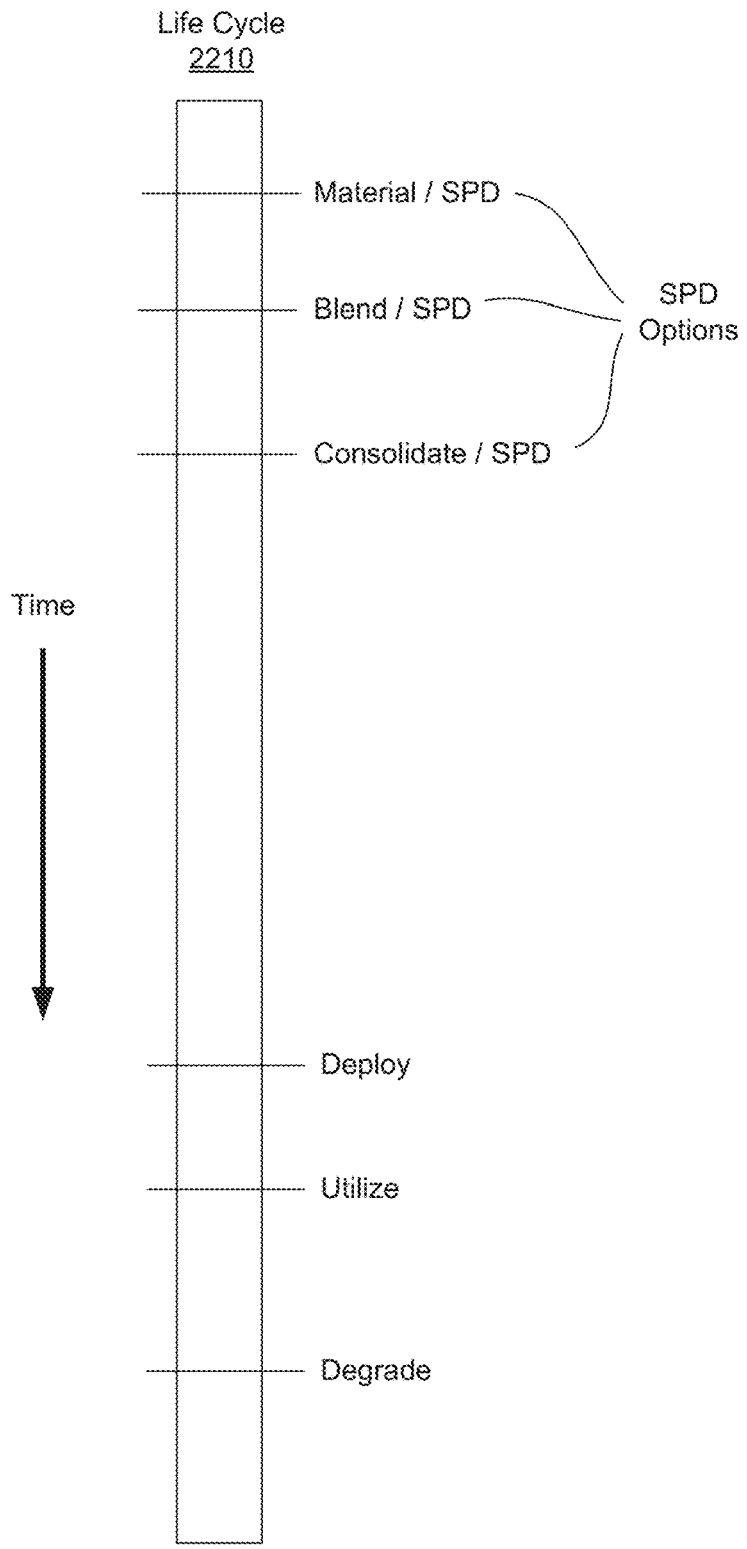
FIG. 22 illustrates an example of a life cycle.

FIG. 22 shows an example of a life cycle 2210. In the life cycle 2210, various times are illustrated as to stages or phases. For example, material may be processed via one or more SPD process, a blend may be made and be processed via one or more SPD process and/or material may be consolidated via one or more SPD process and/or subjected to one or more SPD process after consolidation (e.g., consider SMAT, etc.). A component, as consolidated, may be deployed, utilized and then degraded. As an example, the life cycle 2210 may optionally include ageing, for example, to heat treat material, consolidated material, etc. In the life cycle 2210, ageing may occur before, after and/or during deployment of a component and, for example, optionally into utilization. Thereafter, the component may degrade.

Figure 23:
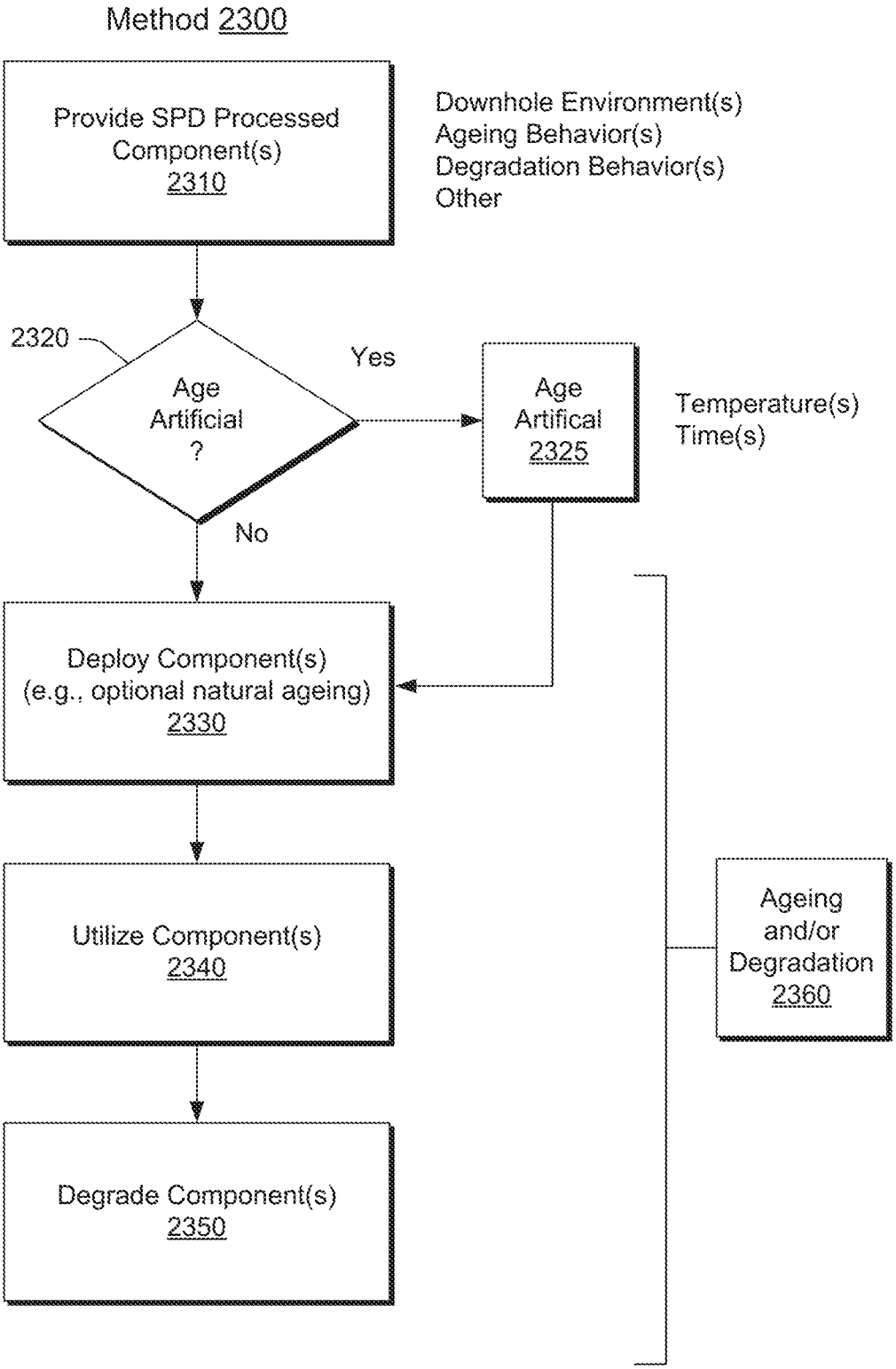
FIG. 23 illustrates an example of a method.

FIG. 23 shows an example of a method 2300 that includes a provision block 2310 for providing one or more SPD processed components (e.g., optionally an assembly, etc.), a decision block 2320 for deciding whether to artificially age at least one of the one or more SPD processed components, an artificial ageing block 2325 for artificially ageing at least one of the one or more SPD processed components, a deployment block 2330 for deploying at least one of the one or more SPD processed components, a utilization block 2340 for utilizing at least one of the one or more SPD processed components and a degradation block 2350 for degrading at least one of the one or more SPD processed components. As shown in the example of FIG. 23, an ageing and/or degradation block 2360 can provide for ageing and/or degradation after a decision is made via the decision block 2320 where such ageing and/or degradation may be considered downhole processes that may commence, for example, at time of deployment, during deployment and/or after deployment via the deployment block 2330.

As shown in the example of FIG. 23, the provision block 2310 can include providing information such as, for example, information as to conditions in a downhole environment, information as to ageing behavior, information as to degradation behavior, etc. Such information may be used, for example, in making a decision per the decision block 2320 and/or for determining one or more parameters of the artificial ageing block 2325 (e.g., time, temperature, etc.). For example, where a temperature of a downhole environment is considered "low", sufficient ageing may not occur in the downhole environment prior to one or more of utilization, degradation, etc. In such an example, a decision may be made via the decision block 2320 to artificially age one or more components prior to deployment per the deployment block 2330, for example, to achieve a desired level of age-hardening prior to utilization per the utilization block 2340.

As an example, consider a scenario where a downhole environment has a temperature of about 20 degrees C. (e.g., about 70 degrees F.). Such a temperature may achieve sufficient ageing, however, on a time scale that is not practical and/or economical. In such an example, artificial ageing may be employed, for example, at a temperature greater than about 20 degrees C. (e.g., about 70 degrees F.). As an example, consider artificial ageing at a temperature greater than about 40 degrees C. (e.g., about 100 degrees F.).

As an example, ageing, whether artificial and/or downhole, may occur at temperatures greater than about 20 degrees C. (e.g., about 70 degrees F.) to about 230 degrees C. (e.g., about 450 degrees F.). As an example, ageing may occur according to a time-temperature profile, which may include one or more time periods (e.g., surface and/or downhole) and one or more different temperatures (e.g., surface/artificial and/or downhole). As an example, where a field operation occurs in a cold environment (e.g., less than about 10 degrees C. or about 50 degrees F.), artificial ageing may employ a heater and optionally a heat chamber (e.g., an oven). As an example, where a field operation occurs in a warm or hot environment (e.g., greater than about 10 degrees C. or about 50 degrees F.), ageing may occur for one or more components prior to deployment to a downhole environment where such ageing may include, for example, exposure to sunlight, placement in a chamber exposed to sunlight, etc. As an example, ageing may include ageing via solar energy (e.g., directly and/or indirectly).

As an example, a component and/or an assembly may include a layer of material that is degradable at a rate that provides for ageing in a downhole environment. For example, consider a plug that is covered by a layer of material that degrades slowly in a downhole environment such that the plug can age via heat energy in the downhole environment without itself degrading (e.g., the plug being a core within a cover layer). Such an approach may allow for natural ageing where such natural ageing occurs while the cover layer degrades. In such an example, properties may be achieved (e.g., strength and/or ductility) before utilization.

As an example, a component may include a near surface layer with properties altered via one or more SMAT processes. In such an example, material of the near surface layer may degrade more slowly than material of an adjacent layer (e.g., as may be determined by a depth effect of SMAT bombardment). In such an example, the near surface layer may allow for extended ageing when compared to a component without an SMAT processed layer.

As an example, an ageing time may be about one hour or more. As an example, a degradation time may be about one hour or more.

As an example, a material may "intentionally" fail via liquid-metal embrittlement, for example, as in an alloy that includes gallium and/or indium. As an example, a degradable material may include an alloy or alloys and possess phases that may be susceptible to creep (e.g., superplastic) deformation (e.g., under intended force, etc.), possess phases that are brittle (e.g., which may rupture in response to impact, etc.).

As an example, a component may be formed of material that provides a desired degradation rate and desired mechanical properties (e.g., strength, etc.). As an example, a degradation rate may depend upon one or more conditions (e.g., temperature, pressure, fluid environments), which may be exist in an environment and/or may be achieved in an environment (e.g., via one or more types of intervention).

As an example, a degradable material may be suitable for use in an operation that may include stages. For example, consider a cementing operation, a fracturing operation, etc. As explained, a process may be associated with a completion where portions of the completion are constructed, managed, altered, etc. in one or more stages. For example, cementing may occur in stages that extend successively deeper into a drilled borehole and, for example, fracturing may occur in stages.

As an example, a method can include subjecting a material or materials to severe plastic deformation (SPD). As an example, a method can include consolidating powder via a process that includes severe plastic deforming (e.g., an SPD process or processes). As an example, a method can employ one or more metalworking techniques that involve introducing very large strains that may provide for complex stress state or high shear, resulting in a high defect density and equiaxed ultrafine grain (UFG) sizes (e.g., with a dimension less than about 500 nm or, for example, less than about 300 nm) and/or nanocrystalline (NC) structures (e.g., with a dimension less than about 100 nm).

As an example, a method can include equal channel angular pressing (ECAP). As an example, a method can include cyromilling. As an example, a method can include employing SMAT. As an example, a method can include one or more of ECAP, cyromilling, SMAT, HIP, VHP, HPT, etc. (see, e.g., FIG. 5).

As an example, a material may be processed to form a degradable component or a portion of a component that is degradable. For example, a method may include processing material that includes a degradable alloy to strengthen the material. In such an example, the resulting material may be used, for example, as a component or as a portion of a component in a stage or stages of a fracturing operation. As an example, such a material may be used as a component or as a portion of a component in a tensile-loaded application, for example, consider a bridge plug, etc. As an example, a bridge plug may be a tool, for example, a bridge plug tool. Such a tool may include one or more seats, which may, for example, provide for seating of one or more plugs.

As an example, a material produced via a method that includes ECAP may be of a size that includes a cross-sectional dimension of the order of inches. For example, consider a material with a cross-sectional dimension of the order of about 10 inches or less (e.g., about 25 cm or less). As an example, a material produced via a method that includes ECAP may form stock that can be machined into a spherical form, a plug form, a plug tool form, a seat form, a valve form, or other borehole tool form, etc. In such an example, the resulting component may include grains of relatively homogenous size and shape. Where the material is degradable in an environment, the degradation mechanics may be predictable via one or more models, for example, more so than a material produced without ECAP that includes a less homogeneous grain size and shape and, for example, larger grain sizes.

As an example, a method can include casting. As an example, a method can include forming a material from chips. As an example, a method can include forming a material from powder. As an example, a method can include forming a material from powder and chips. As an example, a method can include forming a near-net strengthened ball. As an example, a method can include forming a near-net strengthened dart. As an example, a method can include increasing strength of a material via processing that increases homogeneity of the material. As an example, a method can include processing that enhances degradability, for example, uniformity of degradation (e.g., CPL/PSG/WS).

As an example, a method can include reducing porosity in an alloy through severe plastic deformation (SPD). As an example, such an alloy may be a degradable alloy.

As an example, a material may be embedded with a material that is one or more of active, passive, chemical, functionalized, etc. As an example, an embedded material may alter thermal conductivity, electrical conductivity, etc. of a bulk phase of the material. As an example, an embedded material may operate at a grain boundary or grain boundaries.

As an example, a process material may be formed as part of a cable. For example, consider a power cable for an electric submersible pump. In such an example, the processed material may be armor, a strength member, a barrier, an insulator, etc.

As an example, a component formed from processed material may be a bridge plug. A bridge plug may be a downhole tool (e.g., a type of plug tool) that can be located and set to isolate a lower part of a wellbore. As an example, a bridge plug may be permanent, degradable, retrievable, etc. As an example, a bridge plug may be tailored to enable a lower wellbore to be permanently sealed from production or temporarily isolated, for example, from a treatment conducted on an upper zone.

A part, a component, etc. constructed of a processed material or processed materials may include be a fluid sampling bottle, a pressure housing, a pump shaft, a cable (e.g., wireline, a power cable, etc.), a bridge plug tool, a projectile (e.g., a drop ball, a dart, etc.), a drill stem stabilizer, etc.

As an example, a method can include making a centralizer using processed material. For example, a centralizer may exhibit enhanced wear resistance that can reduce surface damage and corrosion fatigue on a borehole assembly (e.g., BHA), for example, thereby increasing BHA lifetime. As an example, via improved abrasion wear resistance of a centralizer, reliability may be improved, for example, when drilling over extended deviated lengths.

As an example, where machining of stock material occurs, machine swarf (e.g., chips, etc.) may be processed. Swarf, also known as chips or by other process-specific names (such as turnings, filings, or shavings) may be pieces of material resulting from machining or similar subtractive (material-removing) manufacturing processes. As an example, a method can include recycling swarf. As an example, a method can include processing swarf from processed stock that is machined to form one or more components. In such an example, the processed stock may be a degradable material that is used to form one or more degradable components (e.g., parts, etc.). The swarf may be processed to form processed stock and then machined to form one or more parts. As an example, swarf may be subjected to cryomilling and/or one or more other processes.

As an example, a processed material may be machined or otherwise formed as a centralizer or as a part of a centralizer. As an example, one or more blades, one or more springs (e.g., bow springs), etc. may be formed using a processed material (e.g., processed via a severe plastic deformation process). As an example, a centralizer may be optionally formed from ECAP processed material. For example, consider a method that includes generating stock processed material with a cross-sectional dimension sufficient to machine at least a portion of a centralizer therefrom. In such an example, a bore may be machined into the stock processed material and, for example, surface protrusions may be machined (e.g., consider a hydraulic centralizer).

As an example, a plug tool may include an outer dimension (e.g., outer diameter) less than about six inches (e.g., less than about 15 cm). In such an example, a part of the plug tool may be formed from ECAP processed material. For example, consider a method that includes generating stock processed material with a cross-sectional dimension sufficient to machine at least a portion of a plug tool therefrom. In such an example, a bore may be machined into the stock processed material and, for example, appropriate apertures, openings, fittings, etc. may be machined.

As an example, a borehole tool may be a tool that is part of a borehole assembly (e.g., "BHA") or borehole system. As an example, a BHA may be a lower portion of the drillstring, including (e.g., from a bottom up in a vertical well) a bit, a bit sub, optionally a mud motor, stabilizers, a drill collar, a heavy-weight drillpipe, a jarring devices (e.g., jars) and crossovers for various threadforms. As BHA may provide force for a bit to break rock (e.g., weight on bit), survive a hostile mechanical environment and provide a driller with directional control of a borehole. As an example, an assembly may include one or more of a mud motor, directional drilling and measuring equipment, measurements-while-drilling tools, logging-while-drilling tools or other borehole tools.

As an example, a method can include producing stock material via one or more SPD processes and machining the stock material into at least one part. In such an example, the stock material can include an aluminum alloy. For example, consider an aluminum alloy that includes gallium.

As an example, a method may include machining stock material produced via one or more SPD processes to form at least one degradable part. As an example, a part may be a fracturing operation plug, which may optionally be a degradable fracturing operation plug. As an example, a fracturing operation plug may be a layered plug, optionally including at least one degradable layer. As an example, a fracturing operation plug may include a core and one or more layers where at least one of the layers is degradable and optionally where the core is degradable. As an example, degradable layers, a degradable core, etc. may differ in properties in a manner that effects degradability (e.g., with respect to one or more conditions). As an example, a method may include machining stock material produced via one or more SPD processes to form at least part of a borehole tool. For example, consider forming a plug tool or a portion of a plug tool such as a seat or seats of a plug tool that may be dimensioned to seat a plug or plugs.

As an example, an apparatus can include a shape and material that includes an aluminum alloy that has an average grain size less than about 1 micron or, for example, less than about 500 nanometers. In such an example, the apparatus may be a degradable apparatus. As an example, such an apparatus may be a degradable plug. In such an example, the degradable plug may include aluminum and gallium and, for example, indium.

As an example, a method can include producing stock material via one or more SPD processes where the stock material includes an alloy that includes an average grain size less than approximately 1 micron (e.g., or less than about 500 nanometers) and machining the stock material into at least one part of borehole tool. As an example, a borehole tool may be a tool such as, for example, a tool operable in a downhole operation. For example, consider a plug as a tool, a plug tool, a centralizer, a sampling bottle, a wireline, a slickline, etc.

As an example, an alloy may include one or more of the following group 13 elements: aluminum, gallium and indium. As an example, an alloy may include at least one of the following group 2 elements: magnesium and calcium.

As an example, a method can include providing particulate material that includes an aluminum alloy where the aluminum alloy is at least approximately eighty percent by weight of the first particulate material and that includes one or more metals selected from a group of alkali metals, alkaline earth metals, group 12 transition metals, and basic metals having an atomic number equal to or greater than 31, where the one or more metals selected from the group total at least approximately two percent by weight of the particulate material. Such a particulate material may optionally be blended with one or more other particulate materials. For example, consider blending with a second particulate material that includes at least one aluminum alloy selected from a group of series 2000, 5000, 6000, 7000, and 9000.

As an example, a particulate material can include at least one basic metal having an atomic number equal to or greater than 31 where, for example, the at least one basic metal having an atomic number equal to or greater than 31 is at least approximately two percent by weight of the particulate material.

As an example, particulate material can include gallium (e.g., as a basic metal). In such an example, the gallium can be at least approximately two percent by weight of the particulate material. In such an example, the presence of gallium may make the particulate material a degradable material (e.g., degradable in an aqueous environment). For example, gallium may coat grains (e.g., as grain boundary material). As an example, a particulate material can include indium. As an example, a particulate material can include gallium and/or indium, which may be present, for example, at at least approximately two percent by weight of the particulate material.

As an example, a particulate material can include at least one group 12 transition metal selected from a group of zinc and mercury. As an example, a particulate material can include at least one of gallium, indium, tin, bismuth, zinc, mercury, lithium, sodium and potassium.

As an example, a method can include processing material via at least one severe plastic deformation process to form a degradable component where the material includes aluminum and one or more metals selected from a group consisting of alkali metals, alkaline earth metals, group 12 transition metals, and basic metals having an atomic number equal to or greater than 31. In such an example, the at least one severe plastic deformation process can include, for example, one or more of equal channel angular pressing (ECAP), cryomilling, high pressure torsion (HPT), and surface mechanical attrition treatment (SMAT). As an example, SMAT can harden a near surface layer of a degradable component.

As an example, a method can include at least one severe plastic deformation process that is applied to material to increase yield strength of a degradable component formed at least in part from the material.

As an example, at least one severe plastic deformation process can be applied to material to increase ductility of a degradable component formed from at least in part from the material.

As an example, a method can include performing at least one severe plastic deformation process to material to alter at least one degradation characteristic of a degradable component formed at least in part from the material. In such an example, the material can include grain material and grain boundary material where the at least one severe plastic deformation process increases discontinuity of the grain boundary material to thereby decrease degradability of the material.

As an example, a method can include performing at least one severe plastic deformation process to material to increase yield strength of at least a portion of a degradable component formed at least in part from the material and to decrease degradation rate of at least the portion of the degradable component.

As an example, a material can include dispersoids. For example, a method can include cryomilling wherein the dispersoids are formed during the cryomilling. As an example, a method can include processing that acts to reduce the size of the dispersoids. For example, one or more severe plastic deformation processes may act to reduce the size of dispersoids in material. As an example, a material can include dispersoids where the dispersoids include at least one type of oxide.

As an example, a method can include processing material via at least one severe plastic deformation process to form a degradable component where the material includes aluminum and one or more metals selected from a group consisting of alkali metals, alkaline earth metals, group 12 transition metals, and basic metals having an atomic number equal to or greater than 31 where the one or more metals selected from the group include at least one basic metal having an atomic number equal to or greater than 31. In such an example, the at least one basic metal having an atomic number equal to or greater than 31 can be at least approximately two percent by weight of the material. As an example, one or more metals selected from a group can be or include gallium. As an example, particulate materials may be mixed where one of the particulate materials includes gallium at at least approximately two percent by weight of that particulate material.

As an example, a method can include processing material via at least one severe plastic deformation process to form a degradable component where the material includes aluminum and one or more metals selected from a group consisting of alkali metals, alkaline earth metals, group 12 transition metals, and basic metals having an atomic number equal to or greater than 31 where the one or more metals selected from the group include at least one member selected from a group consisting of gallium, indium, tin, bismuth, zinc, mercury, lithium, sodium and potassium.

As an example, a method can include processing material via at least one severe plastic deformation process to form a degradable component where the material includes aluminum and one or more metals selected from a group consisting of alkali metals, alkaline earth metals, group 12 transition metals, and basic metals having an atomic number equal to or greater than 31 where the degradable component is degradable in an aqueous environment.

As an example, a degradable component can include a metal matrix composite. As an example, a degradable component can be at least a portion of a borehole tool.

As an example, a degradable component of a borehole tool can include material that includes grain material that includes an aluminum alloy and discontinuous grain boundary material that includes one or more metals selected from a group consisting of alkali metals, alkaline earth metals, group 12 transition metals, and basic metals having an atomic number equal to or greater than 31. In such an example, the degradable component can include a near surface layer that includes the material that includes the grain material and that includes the discontinuous grain boundary material. In such an example, the near surface layer can be formed at least in part via a surface mechanical attrition treatment.

As an example, a degradable component can include discontinuous grain boundary material that includes gallium.

As an example, a degradable component of a borehole tool can include material that includes grain material that includes an aluminum alloy and discontinuous grain boundary material that includes one or more metals selected from a group consisting of alkali metals, alkaline earth metals, group 12 transition metals, and basic metals having an atomic number equal to or greater than 31; and can include material that includes grain material that includes an aluminum alloy and substantially continuous grain boundary material that includes one or more metals selected from a group consisting of alkali metals, alkaline earth metals, group 12 transition metals, and basic metals having an atomic number equal to or greater than 31. In such an example, the material that includes the discontinuous grain boundary material can have a degradation rate that is less than a degradation rate of the material that includes the substantially continuous grain boundary material.

As an example, a degradable component of a borehole tool can include dispersoids where, for example, the dispersoids can include a first population of dispersoids and a second population of dispersoids where the second population of dispersoids is of a smaller average size than the first population of dispersoids. In such an example, the second population of dispersoids can reside in a near surface layer of the degradable component and the first population of dispersoids can reside in an adjacent, interior layer of the degradable component.

As an example, a degradable component of a borehole tool can include a first layer of a first hardness and a second layer of a second, different hardness.

As an example, a degradable component of a borehole tool can include a first layer of a first average grain size and a second layer of a second, different average grain size.

As an example, a method can include deploying a degradable component of a borehole tool into a downhole environment; utilizing the degradable component in the downhole environment; degrading a near surface layer of the degradable component; and degrading an adjacent layer of the degradable component where the near surface layer has a hardness that exceeds a hardness of the adjacent layer. In such an example, the degradable component can be a plug or, for example, a seat (e.g., a seat for a plug or other component). As an example, such a degradable component can include dispersoids. For example, the dispersoids can include a population density, where degradation of the degradable component generates fragments and where fragment size of the fragments depends on the population density of the dispersoids. As an example, at least one severe plastic deformation process may be utilized to alter the population density of dispersoids.

As an example, at least one surface mechanical attrition treatment parameter can determine a thickness of the near surface layer.

As an example, hardness can be a measure of resistance to shape change in response to application of a compressive force.

As an example, a method can include processing material via equal channel angle pressing to generate processed material where the material includes aluminum and one or more metals selected from a group consisting of alkali metals, alkaline earth metals, group 12 transition metals, and basic metals having an atomic number equal to or greater than 31; and processing the processed material via surface mechanical attrition treatment processing to form a near surface layer that includes properties that differ from properties of an adjacent layer of the processed material. In such an example, the material can include gallium. As an example, such a material can include dispersoids.

As an example, a method can include making a degradable component of a borehole tool of at least one material that is processed via at least one severe plastic deformation process.

As an example, one or more methods described herein may include associated computer-readable storage media (CRM) blocks. Such blocks can include instructions suitable for execution by one or more processors (or cores) to instruct a computing device or system to perform one or more actions. As an example, equipment may include a processor (e.g., a microcontroller, etc.) and memory as a storage device for storing processor-executable instructions. In such an example, execution of the instructions may, in part, cause the equipment to perform one or more actions (e.g., consider a controller to control processing such as ECAP, cryomilling, machining, forming, cementing, fracturing, etc.). As an example, a computer-readable storage medium may be non-transitory and not a carrier wave.

According to an embodiment, one or more computer-readable media may include computer-executable instructions to instruct a computing system to output information for controlling a process. For example, such instructions may provide for output to sensing process, an injection process, drilling process, an extraction process, an extrusion process, a pumping process, a heating process, etc.

Figure 24:
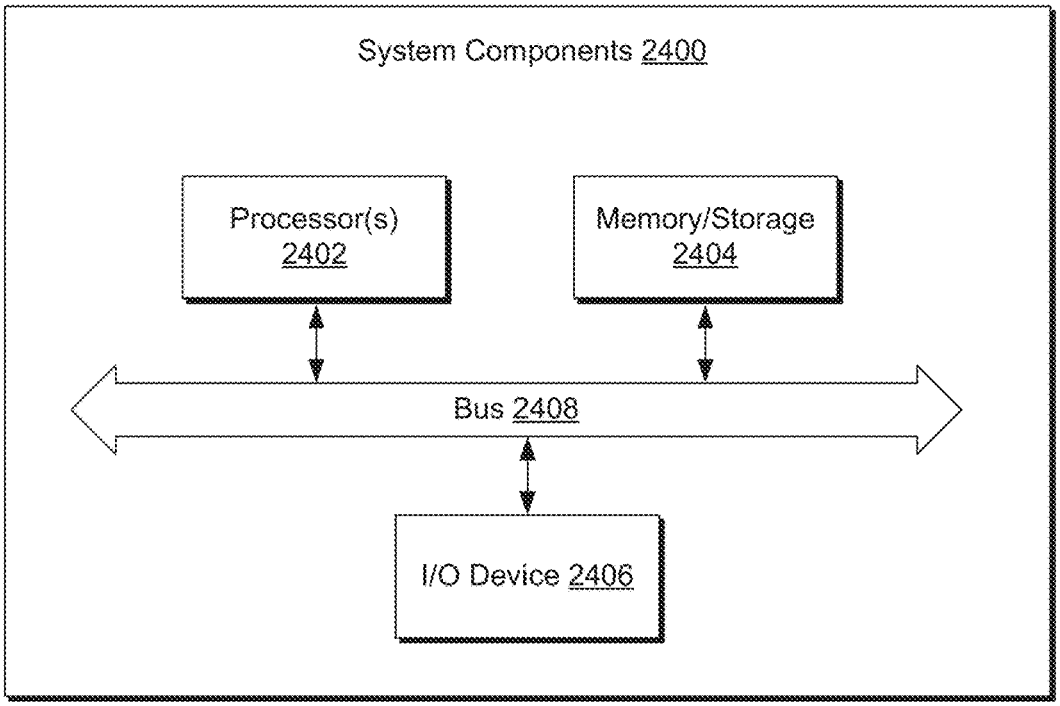
FIG. 24 illustrates example components of a system and a networked system.
Figure 24:
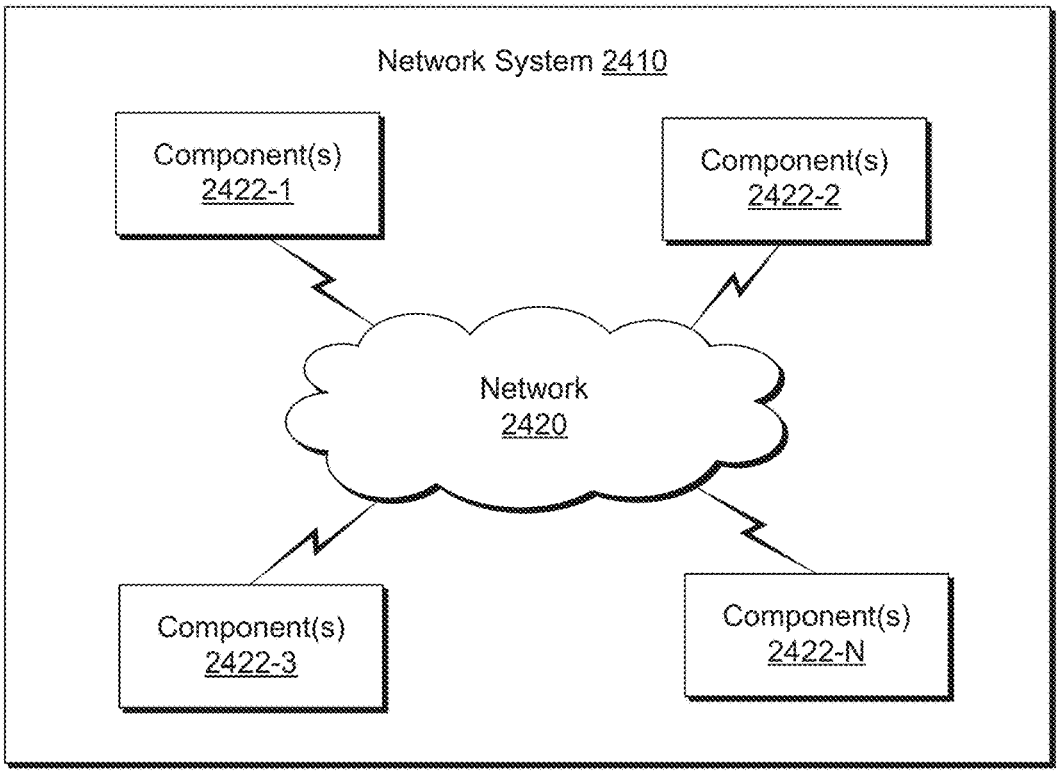

FIG. 24 shows components of a computing system 2400 and a networked system 2410. The system 2400 includes one or more processors 2402, memory and/or storage components 2404, one or more input and/or output devices 2406 and a bus 2408. According to an embodiment, instructions may be stored in one or more computer-readable media (e.g., memory/storage components 2404). Such instructions may be read by one or more processors (e.g., the processor(s) 2402) via a communication bus (e.g., the bus 2408), which may be wired or wireless. As an example, instructions may be stored as one or more modules. As an example, one or more processors may execute instructions to implement (wholly or in part) one or more attributes (e.g., as part of a method). A user may view output from and interact with a process via an I/O device (e.g., the device 2406). According to an embodiment, a computer-readable medium may be a storage component such as a physical memory storage device, for example, a chip, a chip on a package, a memory card, etc.

According to an embodiment, components may be distributed, such as in the network system 2410. The network system 2410 includes components 2422-1, 2422-2, 2422-3, . . . 2422-N. For example, the components 2422-1 may include the processor(s) 2402 while the component(s) 2422-3 may include memory accessible by the processor(s) 2402. Further, the component(s) 2402-2 may include an I/O device for display and optionally interaction with a method. The network may be or include the Internet, an intranet, a cellular network, a satellite network, etc.

CONCLUSION

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words "means for" together with an associated function.

What is claimed is:

1. An isolation device for use with a plug and a tubular having a tubular seal profile formed in an internal surface of the tubular, the isolation device comprising:

a body;

a ring coupled to the body and positioned such that, when the isolation device is positioned within the tubular, the ring is uphole of the body, the ring comprising:

an external seal profile shaped to contact and form a seal with the tubular seal profile to prevent flow between the tubular and the ring; and an internal seal profile shaped to receive and form a seal with the plug to prevent flow through a bore of the ring, wherein at least one of the body or the ring is a degradable component comprising a fine-grained material having a plurality of grains and a plurality of grain boundaries, wherein the plurality of grains comprises a first material and the plurality of grain boundaries comprises a second material rich in gallium relative to the first material, wherein the degradable component comprises dispersoids or is processed via a severe plastic deformation process, and wherein the severe plastic deformation process comprises at least one of equal channel angular pressing (ECAP), cryomilling, high pressure torsion (HPT), or surface mechanical attrition treatment (SMAT).

2. The isolation device of claim 1, wherein the degradable component is degradable upon contact with a selected fluid.

3. The isolation device of claim 1, wherein the degradable component is processed via the severe plastic deformation process and the degradable component comprises the dispersoids.

4. The isolation device of claim 1, wherein the degradable component is processed via the severe plastic deformation process comprising the at least one of equal channel angular pressing (ECAP), cryomilling, high pressure torsion (HPT), or surface mechanical attrition treatment (SMAT).

5. The isolation device of claim 1, wherein the degradable component comprises the dispersoids.

6. The isolation device of claim 1, wherein the degradable component comprises gallium, indium, tin, bismuth, zinc, mercury, lithium, sodium, or potassium.

7. The isolation device of claim 1, wherein the degradable component is an alloy comprising aluminum and gallium, and the alloy comprises 2 to 20% gallium.

8. The isolation device of claim 1, wherein the plurality of grain boundaries form a continuous grain boundary comprising about 90% gallium.

9. A isolation system for use within a well, the isolation system comprising:

a tubular positionable within the well and having a tubular seal profile formed in an internal surface of the tubular; and an isolation device positionable within the tubular and comprising:

a body;

a ring coupled to the body and positioned such that, when the isolation device is positioned within the tubular, the ring is uphole of the body, the ring comprising an external seal profile shaped to contact and form a seal with the tubular seal profile to prevent flow between the tubular and the ring; and a plug sized to travel through the tubular to contact an internal seal profile of the ring to form a seal and prevent flow through a bore of the ring;

wherein at least one of the plug, the body, or the ring is a degradable component comprising a fine-grained material having a plurality of grains and a plurality of grain boundaries;

wherein the plurality of grains comprises a first material and the plurality of grain boundaries comprises a second material rich in gallium relative to the first material;

wherein the degradable component comprises dispersoids or is processed via a severe plastic deformation process;

wherein the severe plastic deformation process comprises at least one of equal channel angular pressing (ECAP), cryomilling, high pressure torsion (HPT), or surface mechanical attrition treatment (SMAT).

10. The isolation system of claim 9, wherein the degradable component is degradable upon contact with a selected fluid.

11. The isolation system of claim 9, wherein the degradable component is processed via the severe plastic deformation process and the degradable component comprises the dispersoids.

12. The isolation system of claim 9, wherein the degradable component is processed via the severe plastic deformation process comprising at least one of equal channel angular pressing (ECAP), cryomilling, high pressure torsion (HPT), or surface mechanical attrition treatment (SMAT).

13. The isolation system of claim 9, wherein the degradable component comprises the dispersoids.

14. The isolation system of claim 9, wherein the degradable component comprises gallium, indium, tin, bismuth, zinc, mercury, lithium, sodium, or potassium.

15. A method of temporarily isolating a portion of a well, the method comprising:

positioning a tubular having a tubular seal profile formed in an internal surface of the tubular within the well;

positioning a ring of an isolation device within the tubular such that an external seal profile of the ring contacts and form a seal with the tubular seal profile to prevent flow between the tubular and the ring;

sealing a bore of the ring via a plug to prevent flow through a bore of the ring; and degrading a fine-grained material of at least one of the plug, a body of the isolation device or the ring to resume flow through the tubular, wherein the fine-grained material comprises a plurality of grains and a plurality of grain boundaries;

wherein the plurality of grains comprises a first material and the plurality of grain boundaries comprises a second material rich in gallium relative to the first material;

wherein the at least one of the plug, the body, or the ring comprises dispersoids or is processed via a severe plastic deformation process;

wherein the severe plastic deformation process comprises at least one of equal channel angular pressing (ECAP), cryomilling, high pressure torsion (HPT), or surface mechanical attrition treatment (SMAT).

16. The method of claim 15, wherein degrading the at least one of the plug, the body, or the ring to resume flow through the tubular comprises degrading the plug, the body, and the ring to resume flow through the tubular.

17. The method of claim 15, wherein degrading the at least one of the plug, the body, or the ring to resume flow through the tubular comprising degrading the at least one of the plug, the body, or the ring to resume flow through the tubular via flowing a selected fluid into the well.

18. The method of claim 15, further comprising processing at least one of the plug, the body, or the ring via the severe plastic deformation process, and wherein the at least one of the plug, the body, or the ring comprises the dispersoids.

19. The method of claim 15, comprising processing the at least one of the plug, the body, or the ring via the at least one of a-severe plastic deformation process comprising at least one of equal channel angular pressing (ECAP), cryomilling, high pressure torsion (HPT), or surface mechanical attrition treatment (SMAT).

20. The method of claim 15, comprising processing the at least one of the plug, the body, or the ring via the severe plastic deformation process comprising the cryomilling to form the dispersoids.

* * * * *